US008857644B2

(12) United States Patent
Phillips

(10) Patent No.: US 8,857,644 B2
(45) Date of Patent: Oct. 14, 2014

(54) CONTAINER

(75) Inventor: Evan Ira Phillips, Coral Springs, FL (US)

(73) Assignee: B.E. Inventive, LLC, Coral Springs, FL (US)

( * ) Notice: Subject to any disclaimer, the term of this patent is extended or adjusted under 35 U.S.C. 154(b) by 686 days.

(21) Appl. No.: 12/626,306

(22) Filed: Nov. 25, 2009

(65) Prior Publication Data

US 2010/0133275 A1 Jun. 3, 2010

Related U.S. Application Data

(63) Continuation-in-part of application No. 12/324,386, filed on Nov. 26, 2008, now abandoned.

(51) Int. Cl.

| | |
|---|---|
| ***B65D 43/06*** | (2006.01) |
| ***B65D 51/18*** | (2006.01) |
| ***B65D 41/62*** | (2006.01) |
| ***A47G 19/22*** | (2006.01) |
| ***B65D 6/40*** | (2006.01) |
| ***B65D 51/00*** | (2006.01) |
| ***B65D 39/00*** | (2006.01) |

(52) U.S. Cl.

CPC ..... *B65D 51/007* (2013.01); *B65D 7/40* (2013.01); *B65D 39/00* (2013.01)

USPC ..... 220/247; 220/249; 220/250; 220/719; 220/254.3; 220/254.4; 220/254.9; 220/713; 220/811; 220/812

(58) Field of Classification Search

USPC ..... 220/247, 249, 250, 251, 305, 238, 719, 220/254.3, 254.4, 254.9, 713, 71, 811

See application file for complete search history.

(56) References Cited

U.S. PATENT DOCUMENTS

| | | | | | |
|---|---|---|---|---|---|
| 2,600,086 | A | * | 6/1952 | Vastano | 215/316 |
| 2,880,899 | A | | 4/1959 | Bramming | |
| 2,963,187 | A | | 12/1960 | Bramming | |
| 3,017,047 | A | | 1/1962 | Payson et al. | |
| 3,086,675 | A | * | 4/1963 | Clark, Jr. | 220/238 |
| 3,158,279 | A | * | 11/1964 | Callegari | 220/318 |
| 3,399,810 | A | | 9/1968 | Burne | |
| 3,412,892 | A | * | 11/1968 | Waksman et al. | 220/714 |
| 3,578,198 | A | * | 5/1971 | Blechman | 220/246 |

(Continued)

FOREIGN PATENT DOCUMENTS

| | | |
|---|---|---|
| EP | 0305598 | 3/1989 |
| EP | 0513401 | 11/1992 |

(Continued)

OTHER PUBLICATIONS

International Preliminary Report on Patentability for PCT/US2008/064570 of Dec. 11, 2009.

(Continued)

*Primary Examiner* — Fenn Mathew
*Assistant Examiner* — Jennifer Castriotta
(74) *Attorney, Agent, or Firm* — Lando & Anastasi, LLP

(57) ABSTRACT

Containers comprising a closure system comprising a fixed element and a movable closure element are disclosed. The containers may be constructed to be resealable and improve sanitary conditions of the dispensing portion and allow for easier opening with the ability to be reclosed, over a conventional container.

18 Claims, 58 Drawing Sheets

(56) References Cited

U.S. PATENT DOCUMENTS 3,662,944 A 5/1972 Joosten, Sr.
3,727,787 A * 4/1973 Gregory ..... 220/243
3,967,752 A 7/1976 Cudzik
3,967,753 A 7/1976 Cudzik
3,979,025 A 9/1976 Friedrich et al.
3,982,656 A * 9/1976 Kusmierski et al. ..... 220/238
4,057,167 A 11/1977 Lee
4,127,212 A * 11/1978 Waterbury ..... 220/255.1
4,136,797 A * 1/1979 Potts ..... 220/271
4,183,443 A 1/1980 DeParales et al.
4,262,815 A 4/1981 Klein
4,269,321 A 5/1981 Ichinose et al.
4,309,921 A 1/1982 Miller
4,319,692 A 3/1982 Gundlach
4,333,582 A 6/1982 Bloeck et al.
4,370,190 A 1/1983 Ichinose et al.
4,410,102 A 10/1983 Lutzker
4,429,804 A * 2/1984 Pease ..... 220/247
4,431,111 A 2/1984 Prohaska
4,449,042 A 5/1984 Hampson et al.
4,465,203 A 8/1984 Lambert
D278,888 S 5/1985 Plumb
4,546,905 A 10/1985 Nandagiri et al.
4,560,081 A 12/1985 Adams
4,564,116 A 1/1986 Prohaska
4,579,257 A 4/1986 Brandlein
4,585,140 A 4/1986 Lambert
4,600,111 A 7/1986 Brown
4,609,123 A 9/1986 Poncy
4,681,238 A 7/1987 Sanchez
4,700,856 A 10/1987 Campbell et al.
4,717,037 A 1/1988 van der Meulen
4,720,022 A 1/1988 Gomes
4,723,684 A 2/1988 Lambert
4,746,032 A * 5/1988 Huang ..... 220/255
4,749,100 A 6/1988 Eberhart
4,796,774 A 1/1989 Nabinger
4,883,192 A 11/1989 Krugman
4,893,725 A 1/1990 Ball et al.
4,899,902 A 2/1990 DeMars
4,909,407 A 3/1990 Lambert et al.
4,911,323 A 3/1990 Arfert et al.
4,917,258 A 4/1990 Boyd et al.
4,928,844 A 5/1990 LaBarge
4,930,654 A 6/1990 Thibeault et al.
4,930,655 A 6/1990 Wells
4,930,658 A 6/1990 Mceldowney
4,932,555 A 6/1990 LaBarge
4,936,494 A 6/1990 Weidman
4,957,216 A 9/1990 LaBarge
4,967,622 A 11/1990 Phillips
4,982,862 A 1/1991 LaBarge
4,991,732 A 2/1991 LaBarge
5,005,717 A 4/1991 Oilar
5,035,343 A 7/1991 Morton
5,062,542 A 11/1991 Morton
5,071,019 A 12/1991 Sizemore
5,121,851 A 6/1992 Lyon et al.
5,139,163 A 8/1992 Diaz
5,143,248 A 9/1992 Sawatsky
5,148,937 A 9/1992 Huard
5,176,278 A 1/1993 Quarberg
5,186,348 A 2/1993 Steiner
5,199,597 A 4/1993 Gladish
5,273,176 A 12/1993 Diaz
D345,673 S 4/1994 Dark
5,299,604 A 4/1994 Pierce
5,402,904 A 4/1995 Close
5,439,103 A 8/1995 Howes
5,451,271 A 9/1995 Yoshida et al.
5,462,189 A * 10/1995 Pierce ..... 220/815
5,467,888 A 11/1995 Brandstrom et al.
D366,832 S 2/1996 Lo
5,547,275 A 8/1996 Lillelund et al.
5,555,993 A 9/1996 Borkowski et al.
5,562,205 A 10/1996 Diaz
5,609,277 A 3/1997 McDonald
D379,065 S 5/1997 Dotson
D379,148 S 5/1997 Robbins, III et al.
D379,434 S 5/1997 Robbins, III et al.
5,632,417 A 5/1997 Robbins, III et al.
D380,679 S 7/1997 Schreiber
5,671,875 A 9/1997 Robbins, III et al.
5,680,952 A 10/1997 Chasteen
5,690,246 A 11/1997 Anderson et al.
5,704,240 A 1/1998 Jordan
5,713,235 A 2/1998 Diekhoff
5,718,352 A 2/1998 Diekhoff et al.
5,720,408 A 2/1998 Schmid et al.
5,722,561 A 3/1998 Biondich
5,755,198 A 5/1998 Grob et al.
5,755,354 A 5/1998 Lang
5,778,723 A 7/1998 Diekhoff et al.
5,785,198 A 7/1998 Credle, Jr.
5,785,199 A 7/1998 Woidtke
5,791,503 A 8/1998 Lyons
5,791,528 A 8/1998 Robbins, III et al.
5,797,522 A 8/1998 Evans et al.
5,813,561 A 9/1998 Chang et al.
5,816,427 A 10/1998 Beckertgis
5,816,428 A 10/1998 Plester
5,822,843 A 10/1998 Diekhoff et al.
5,845,800 A * 12/1998 Shaw et al. ..... 220/210
5,850,944 A 12/1998 Robbins, III et al.
5,865,036 A 2/1999 Anthony
5,894,965 A 4/1999 Robbins, III et al.
D410,388 S 6/1999 Fisher et al.
5,911,331 A 6/1999 Boller
5,934,497 A 8/1999 Chang et al.
5,944,238 A 8/1999 Von Stark
5,946,930 A 9/1999 Anthony
5,947,324 A 9/1999 Palinchak
5,971,231 A 10/1999 Samz et al.
5,984,127 A 11/1999 Fenton
5,993,935 A 11/1999 Rasmussen et al.
D417,583 S 12/1999 Demore
6,010,026 A 1/2000 Diekhoff et al.
6,010,028 A 1/2000 Jordan et al.
6,015,062 A 1/2000 Bachmann et al.
6,041,982 A 3/2000 Cautereels et al.
6,079,588 A 6/2000 Khafizov
6,082,944 A 7/2000 Bachmann et al.
6,098,830 A 8/2000 Jamieson
6,102,242 A 8/2000 Jansen
6,106,757 A 8/2000 Ohlsson et al.
6,155,452 A 12/2000 Laurent
6,158,608 A 12/2000 Schlattl
6,164,503 A 12/2000 Forsyth et al.
D436,538 S 1/2001 Lang
6,170,283 B1 1/2001 Anthony
6,193,094 B1 2/2001 Diamond et al.
6,206,222 B1 3/2001 Cudzik
6,206,223 B1 3/2001 Wicker
6,247,608 B1 6/2001 Chang et al.
6,250,507 B1 6/2001 Ekkert
6,250,517 B1 6/2001 Samz et al.
D446,722 S 8/2001 Morrow
D448,296 S 9/2001 Bried et al.
6,286,703 B1 9/2001 Munro
D448,668 S 10/2001 Baerenwald et al.
D448,669 S 10/2001 Carducci et al.
6,308,870 B2 10/2001 Samz et al.
D450,584 S 11/2001 Schmidt et al.
D450,586 S 11/2001 Kick
6,311,865 B1 11/2001 Laurent
6,338,418 B1 1/2002 Derose
6,341,720 B1 1/2002 Schmidt et al.
D453,892 S 2/2002 Lindsay et al.
6,347,720 B1 2/2002 Schley
6,354,458 B1 3/2002 Policappelli
RE37,634 E 4/2002 Hickman et al.
D456,713 S 5/2002 Bried et al.
6,409,033 B1 6/2002 Wilhite et al.
D462,613 S 9/2002 Bried et al.

(56) References Cited

U.S. PATENT DOCUMENTS

| | | | | |
|---|---|---|---|---|
| 6,443,323 | B1 | 9/2002 | DeRose | |
| 6,450,359 | B1 | 9/2002 | Chang et al. | |
| D464,567 | S | 10/2002 | Baerenwald et al. | |
| D464,886 | S | 10/2002 | Bried et al. | |
| 6,460,718 | B1 | 10/2002 | Vogel | |
| D465,732 | S | 11/2002 | Kick | |
| 6,478,179 | B1 | 11/2002 | Alexander | |
| D466,408 | S | 12/2002 | Baerenwald et al. | |
| D467,801 | S | 12/2002 | Baerenwald et al. | |
| 6,488,187 | B2 | 12/2002 | Sheffler et al. | |
| 6,510,971 | B1 | 1/2003 | Martin | |
| D474,402 | S | 5/2003 | Baerenwald | |
| 6,575,323 | B1 | 6/2003 | Martin et al. | |
| 6,575,684 | B2 | 6/2003 | Heinicke et al. | |
| 6,626,314 | B1 | 9/2003 | McHenry et al. | |
| 6,691,901 | B2 | 2/2004 | Parve et al. | |
| 6,722,517 | B1 * | 4/2004 | Steeber et al. | 220/251 |
| 6,732,873 | B2 | 5/2004 | Bried et al. | |
| 6,742,666 | B1 | 6/2004 | Bried et al. | |
| 6,783,020 | B2 | 8/2004 | Featherston et al. | |
| D498,419 | S | 11/2004 | Martin | |
| 6,830,721 | B2 | 12/2004 | Martin | |
| 6,837,392 | B2 | 1/2005 | Laurent | |
| 6,889,861 | B2 | 5/2005 | Arcati et al. | |
| D509,426 | S | 9/2005 | Samz et al. | |
| D509,934 | S | 9/2005 | Santiago et al. | |
| 6,968,724 | B2 | 11/2005 | Hubball | |
| D513,452 | S | 1/2006 | Parve | |
| D513,585 | S | 1/2006 | Biesecker et al. | |
| 7,007,830 | B2 | 3/2006 | Parve et al. | |
| 7,014,060 | B2 | 3/2006 | Richardson | |
| D522,362 | S | 6/2006 | Liebe | |
| 7,059,490 | B2 | 6/2006 | Son | |
| 7,089,825 | B2 | 8/2006 | Klosterman | |
| D527,627 | S | 9/2006 | Liebe | |
| D529,800 | S | 10/2006 | Liebe | |
| D530,610 | S | 10/2006 | Samz et al. | |
| 7,121,438 | B2 | 10/2006 | Hoepner et al. | |
| 7,128,227 | B2 | 10/2006 | Skillin et al. | |
| 7,152,753 | B2 | 12/2006 | Huffman et al. | |
| 7,152,766 | B1 | 12/2006 | Walsh et al. | |
| 7,175,042 | B2 | 2/2007 | Durdon | |
| 7,191,911 | B2 | 3/2007 | O'Neill | |
| 7,246,716 | B2 | 7/2007 | Durdon | |
| 7,275,653 | B2 | 10/2007 | Tedford, Jr. | |
| 7,513,380 | B2 * | 4/2009 | Canedo | 220/230 |
| 2001/0035417 | A1 | 11/2001 | Kantor | |
| 2002/0027139 | A1 | 3/2002 | O'Neill | |
| 2003/0029891 | A1 | 2/2003 | Alexander | |
| 2003/0089713 | A1 | 5/2003 | Belt et al. | |
| 2003/0089714 | A1 | 5/2003 | Dart et al. | |
| 2003/0116524 | A1 | 6/2003 | Robinson et al. | |
| 2003/0178433 | A1 | 9/2003 | Adams | |
| 2003/0230575 | A1 | 12/2003 | Laurent | |
| 2004/0060935 | A1 | 4/2004 | Perra | |
| 2005/0006334 | A1 | 1/2005 | Luker | |
| 2005/0092748 | A1 | 5/2005 | Durdon | |
| 2005/0092749 | A1 | 5/2005 | Durdon | |
| 2005/0092755 | A1 | 5/2005 | Brown et al. | |
| 2005/0098561 | A1 | 5/2005 | Schwoebel | |
| 2005/0127075 | A1 | 6/2005 | Smith et al. | |
| 2005/0139597 | A1 | 6/2005 | O'Neill | |
| 2005/0150889 | A1 | 7/2005 | Perra | |
| 2006/0000832 | A1 | 1/2006 | Smith et al. | |
| 2006/0081633 | A1 | 4/2006 | Schmidtner et al. | |
| 2006/0096983 | A1 | 5/2006 | Patterson | |
| 2006/0180585 | A1 | 8/2006 | Cunningham et al. | |
| 2006/0201944 | A1 | 9/2006 | Shibasaka et al. | |
| 2006/0201945 | A1 | 9/2006 | Tedford | |
| 2006/0237471 | A1 | 10/2006 | Aafjes | |
| 2006/0261068 | A1 | 11/2006 | Schmidtner et al. | |
| 2007/0012698 | A1 | 1/2007 | Durdon | |
| 2007/0029322 | A1 | 2/2007 | Durdon et al. | |
| 2007/0131691 | A1 | 6/2007 | Evans | |
| 2007/0145055 | A1 | 6/2007 | Gardiner | |
| 2007/0215625 | A1 | 9/2007 | Schmidtner et al. | |
| 2007/0257037 | A1 | 11/2007 | Scarborough | |
| 2007/0262079 | A1 * | 11/2007 | Paris et al. | 220/254.4 |
| 2008/0029512 | A1 | 2/2008 | Smith et al. | |
| 2008/0053997 | A1 | 3/2008 | Perra | |
| 2008/0245806 | A1 * | 10/2008 | Strube | 220/780 |
| 2008/0314904 | A1 | 12/2008 | Perra | |
| 2009/0173737 | A1 | 7/2009 | Ramsey et al. | |
| 2012/0152949 | A1 | 6/2012 | Bratsch | |

FOREIGN PATENT DOCUMENTS

| | | |
|---|---|---|
| EP | 0865993 | 10/1999 |
| EP | 1097087 | 10/2002 |
| EP | 01247752 | 2/2004 |
| EP | 01746042 | 1/2007 |
| FR | 02828478 | 6/2008 |
| GB | 02258208 | 2/1993 |
| GB | 2317882 | 4/1998 |
| GB | 2355644 | 5/2001 |
| JP | 09095351 | 4/1997 |
| JP | 10264931 | 10/1998 |
| NL | 1021536 | 6/2004 |
| NL | 1024270 | 3/2005 |
| WO | 9009930 | 2/1990 |
| WO | 9407755 | 4/1994 |
| WO | 9747525 | 12/1997 |
| WO | WO 9747525 | 12/1997 |
| WO | 9805570 | 2/1998 |
| WO | 9967150 | 12/1999 |
| WO | 0002785 | 1/2000 |
| WO | 0039001 | 7/2000 |
| WO | 0131266 | 5/2001 |
| WO | 0214180 | 2/2002 |
| WO | 2002081322 | 10/2002 |
| WO | 03042058 | 5/2003 |
| WO | 03047994 | 6/2003 |
| WO | 2004106187 | 12/2004 |
| WO | 2005023666 | 3/2005 |
| WO | 2005044676 | 5/2005 |
| WO | 2005056400 | 6/2005 |
| WO | 2005068312 | 7/2005 |
| WO | 2005068313 | 7/2005 |
| WO | 2005092728 | 10/2005 |
| WO | 2006009450 | 1/2006 |
| WO | 2006039044 | 4/2006 |
| WO | 2007047590 | 4/2007 |
| WO | 2009062004 | 5/2009 |
| WO | 2011124552 A1 | 10/2011 |
| WO | 2012150301 A1 | 11/2012 |

OTHER PUBLICATIONS

International Search Report for PCT/US2009/065963 of Jan. 26, 2010.

Partial English language translation of Mexican Office Action No. Mx/a/2011/005562, dated Jan. 8, 2014.

* cited by examiner

FIG. 7A
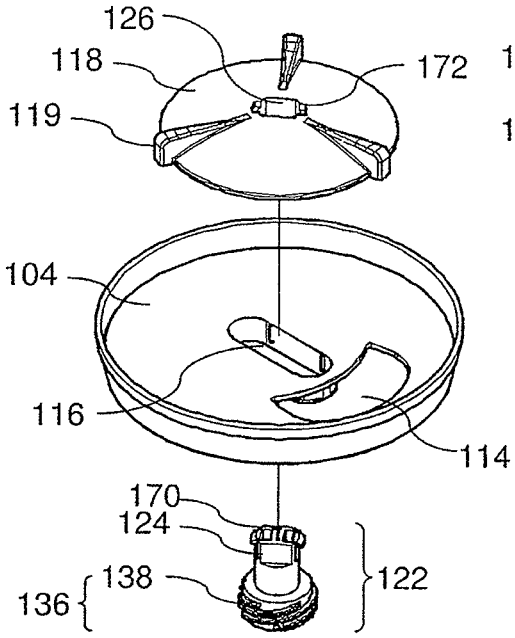
FIG. 7B
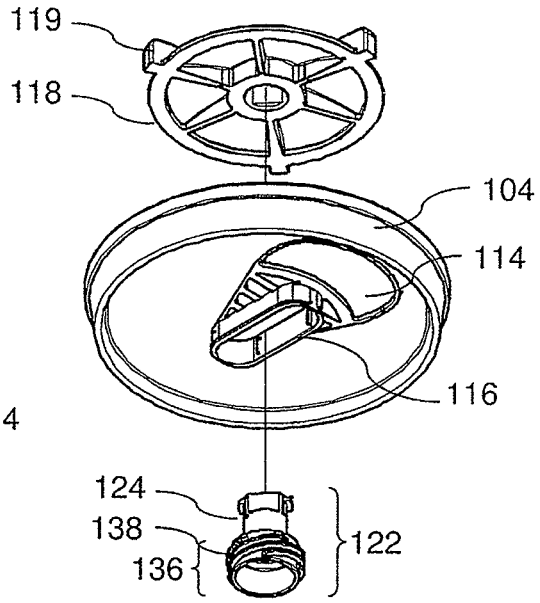
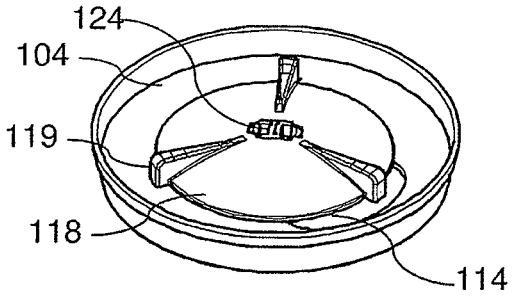
FIG. 8A
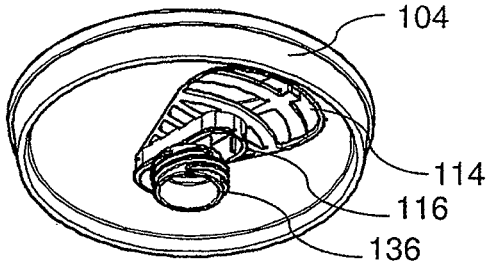
FIG. 8B

FIG. 13A
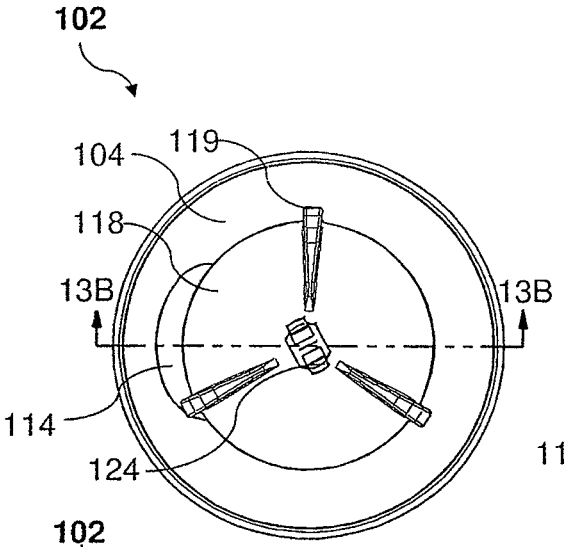
FIG. 14A
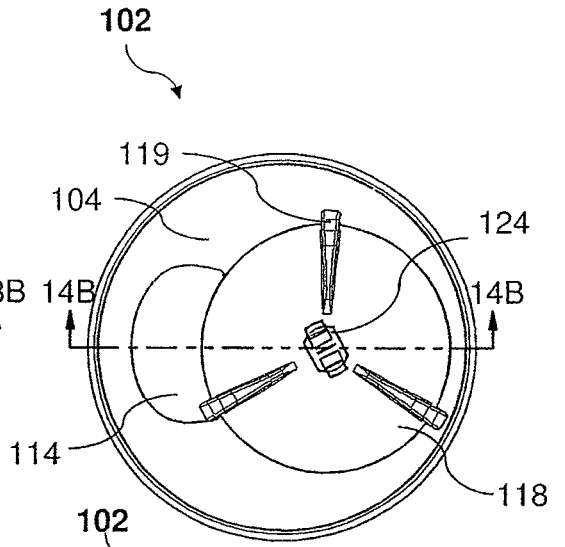
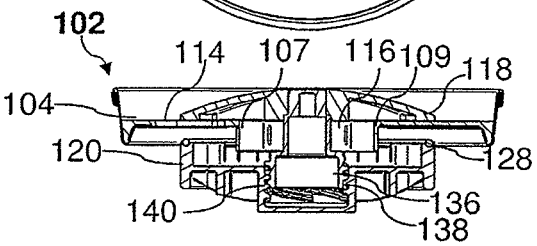
FIG. 13B
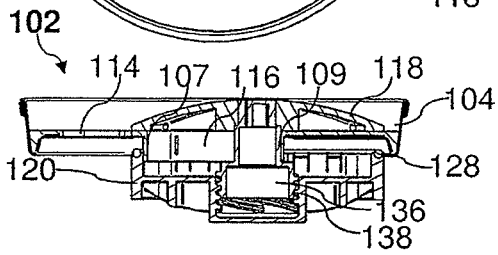
FIG. 14B

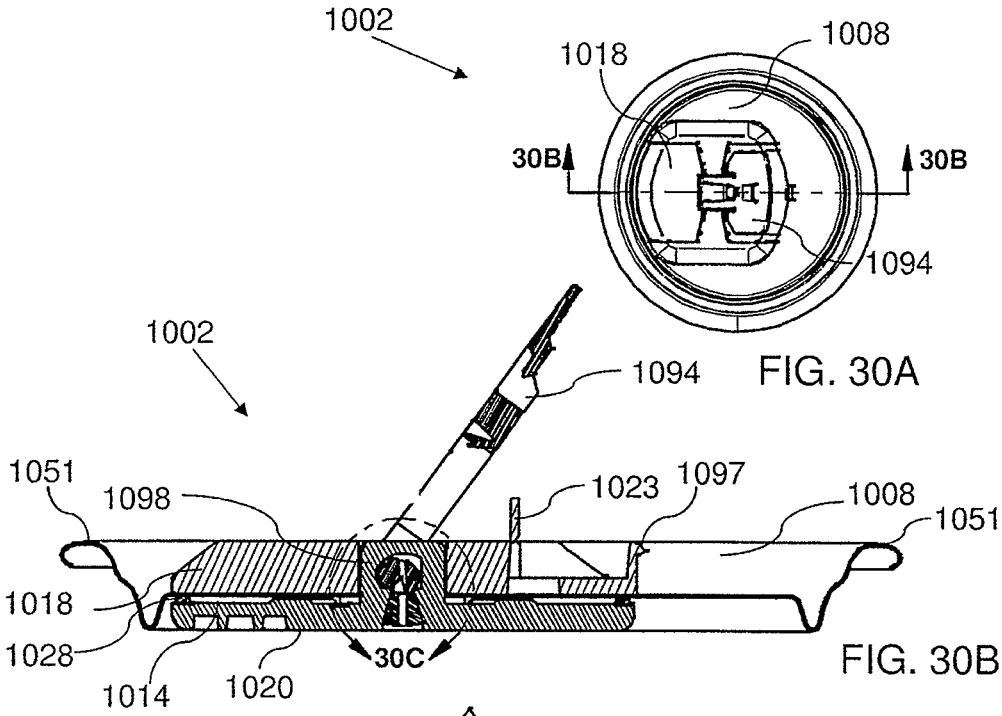
FIG. 30A
FIG. 30B
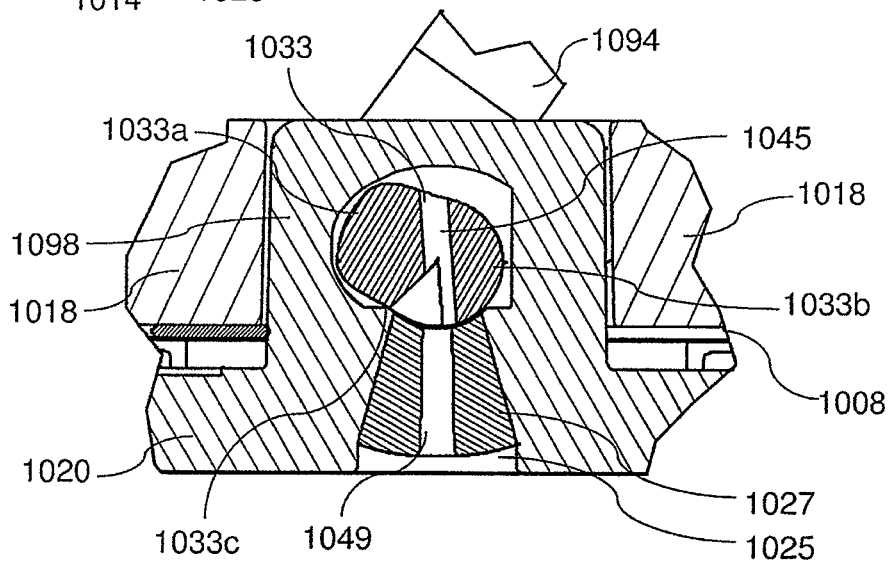
FIG. 30C

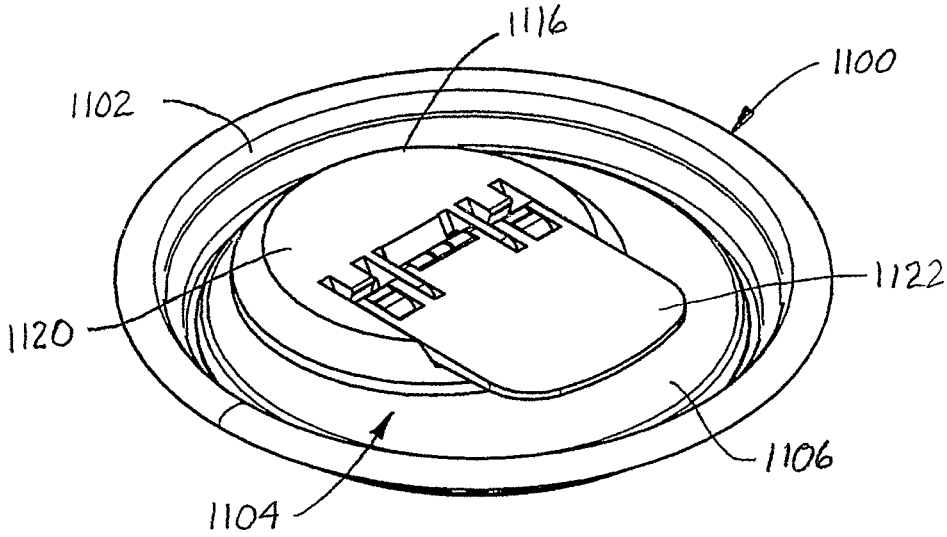
FIG. 37A
FIG. 37B
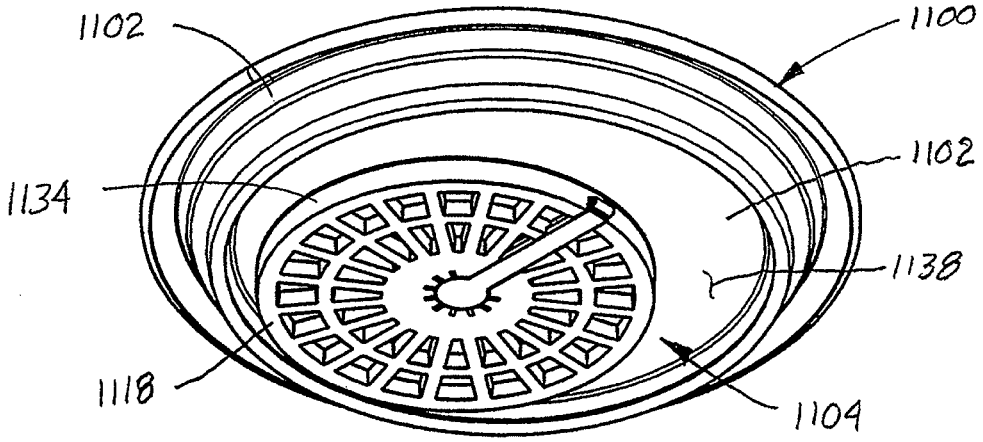

CONTAINER

CROSS-REFERENCE TO RELATED APPLICATIONS

This application is a continuation-in-part application of co-pending U.S. patent application Ser. No. 12/324,386, filed Nov. 26, 2008, titled CONTAINER, the entire contents of which is incorporated herein by reference for all purposes.

BACKGROUND OF THE INVENTION

1. Field of the Technology

At least one example of the present invention relates generally to a container. More particularly, certain examples relate to a container or a closure system for a resealable container having a sanitary, enclosed dispensing portion, such that the dispensing portion remains protected from the environment during, for example, shipping and storage of the container, and may be protected from the environment during use by the consumer.

2. Discussion of Related Art

Beverages, foods, and other consumer goods come in a variety of containers for distribution and sale to consumers. In particular, conventional beverage cans having a stay-on-tab type closure are widely used because of their ease of manufacture, low manufacturing costs, and reliability. However, sanitary concerns exist with regard to the unprotected outside portion of the can that comes into contact with the contents while pouring from the beverage can, or comes directly into contact with the consumers while drinking from the beverage can. Additionally, some consumers have difficulty opening beverage cans, and once this beverage can has been opened, it cannot be resealed, or requires substantial effort to reseal, so that protection of the unprotected outside portion and storage after opening are not feasible.

BRIEF SUMMARY OF THE INVENTION

Certain aspects and examples disclosed herein provide sanitary containers, and methods of making them.

In accordance with a first aspect, a container is provided comprising a container body and a closure system. The closure system comprises a fixed element and a movable closure element. The fixed element comprises a can end comprising a dispensing portion and a channel guide having a first end and a second end. The fixed element is secured to an end of the container body. The movable closure element comprises a top cover comprising a grip, a sealing portion residing within the container body and comprising a channel constructed and arranged to accept the channel guide, and a stem positioned within the channel and having a top end constructed and arranged to be mated with the top cover and a bottom end constructed and arranged to be mated with the sealing portion.

In accordance with this first aspect, at a first position the top cover covers the dispensing portion, the sealing portion is in contact with a bottom surface of the can end, and the stem is positioned at the first end of the channel guide.

In accordance with this first aspect, at a second position the top cover covers the dispensing portion and is rotated relative to the first position, the sealing portion is spaced a predetermined distance from the bottom surface of the can end, and the stem is positioned at the first end of the channel guide.

In accordance with this first aspect, at a third position the top cover exposes the dispensing portion, the sealing portion is spaced a predetermined distance from the bottom surface of the can end, and the stem is positioned at the second end of the channel guide.

In accordance with an additional aspect, a closure system for sealing a container constructed and arranged to be mated with a container body is provided comprising a fixed element and a movable closure element. The fixed element comprises a can end comprising a dispensing portion and a channel guide having a first end and a second end, the fixed element constructed and arranged to be secured to an end of the container body. The movable closure element comprises a top cover comprising a grip, a sealing portion comprising a channel constructed and arranged to accept the channel guide, and a stem residing within the channel and having a top end constructed and arranged to be mated with the top cover and a bottom end constructed and arranged to be mated with the sealing portion. In accordance with this additional aspect, as the top cover and stem are rotated, the sealing portion moves vertically along the stem, and as the top cover and stem are moved in a horizontal direction, the sealing portion moves in the horizontal direction.

In accordance with an additional aspect, a closure system for sealing a container constructed and arranged to be mated with a container body is disclosed. The closure system comprises a fixed element comprising a can end comprising a dispensing portion and a channel guide having a first end and a second end, the fixed element constructed and arranged to be secured to an end of the container body. The closure element also comprises a movable closure element comprising a top cover comprising a grip comprising a lever. The movable closure element also comprises a sealing portion comprising a channel constructed and arranged to accept the channel guide and a lever receiving portion constructed and arranged to accept the lever. In accordance with this aspect, as the lever of the top cover is lifted, the lever moves to allow the sealing portion to move vertically, and as the lever is moved in a horizontal direction the sealing portion moves in the horizontal direction.

In accordance with an additional aspect, a closure system for sealing a container is constructed and arranged to be mated with a container body. The closure system comprises a fixed element and a movable closure element. The fixed element comprises a can end comprising a dispensing portion and a channel guide having a first end and a second end. The fixed element is constructed and arranged to be secured to an end of the container body. The movable closure element comprises a top cover comprising a lever, and a sealing portion comprising a lever receiving portion. The lever receiving portion is constructed and arranged to accept the lever such that, as the lever is lifted, the sealing portion moves in a downward direction away from the can end. The sealing portion is also constructed and arranged such that, as the top cover is moved horizontally from the first end of the channel guide to the second end of the channel guide the dispensing portion is exposed.

In accordance with an additional aspect, a closure system for sealing a container constructed and arranged to be mated with a container body. The closure system comprises a fixed element and a movable closure element. The fixed element comprises a can end comprising a dispensing portion and a channel guide. The fixed element is constructed and arranged to be secured to an end of the container body. The movable closure comprises a top cover comprising a grip, and a sealing portion. The sealing portion is constructed and arranged to operatively interact with the top cover, such that as the top cover is engaged, the sealing portion moves in a vertical direction, and as the top cover is moved in a horizontal direction along the channel guide, the sealing portion moves in the horizontal direction.

Other advantages, novel features and objects of the invention will become apparent from the following detailed description of the invention when considered in conjunction with the accompanying drawings.

BRIEF DESCRIPTION OF THE DRAWINGS

Certain illustrative examples are described below with reference to the accompanying figures in which:

FIG. 7A illustrates an exploded perspective view of a portion of the closure system, in accordance with certain examples;

FIG. 7B illustrates an exploded perspective view of a portion of the closure system, in accordance with certain examples;

FIG. 8A illustrates a perspective assembled view of the portion of the closure system of FIG. 7A, in accordance with certain examples;

FIG. 8B illustrates a perspective assembled view of the portion of the closure system shown in FIG. 7B, in accordance with certain examples;

FIG. 13A illustrates an aerial view of a closure system, in accordance with certain examples;

FIG. 13B illustrates a cross-sectional view of the closure system shown in FIG. 13A along section line 13B-13B, in accordance with certain examples;

FIG. 14A illustrates an aerial view of a closure system, in accordance with certain examples;

FIG. 14B illustrates a cross-sectional view of the closure system shown in FIG. 14A along section line 14B-14B, in accordance with certain examples;

FIG. 30A illustrates an top plan view of a closure system, in accordance with certain examples;

FIG. 30B illustrates a cross-sectional side view along section line 30B-30B of the closure system of FIG. 30A, in accordance with certain examples;

FIG. 30C illustrates a cross-sectional view of the closure system of FIG. 30A, showing detail 30C of FIG. 30B, in accordance with certain examples;

FIG. 37A illustrates a top perspective view of a closure system, in accordance with certain examples;

FIG. 37B illustrates a bottom perspective view of the closure system of FIG. 37A, in accordance with certain examples;

FIG. 44D illustrates a top perspective view of the sealing portion of FIG. 44C, in accordance with certain examples;

FIG. 44E illustrates a cross-sectional side view along section line 44E-44E of the sealing portion of FIG. 44D, in accordance with certain examples;

FIG. 45A illustrates a side view of the sealing portion of FIG. 44D in a third position, in accordance with certain examples;

FIG. 45B illustrates a cross-sectional side view along section line 45B-45B of the sealing portion of FIG. 45A, in accordance with certain examples;

FIG. 46A illustrates a top perspective view of a top cover, in accordance with certain examples;

FIG. 46B illustrates a bottom perspective view of the top cover of FIG. 46A, in accordance with certain examples;

FIG. 47A illustrates a top perspective view of installation of a lever on a top cover, in accordance with certain examples;

FIG. 47B illustrates a top perspective view of the lever and top cover in a first position, in accordance with certain examples;

FIG. 47C illustrates a top perspective view of the lever and top cover in a second position, in accordance with certain examples;

FIG. 47D illustrates a top perspective view of the lever and top cover in a third position, in accordance with certain examples;

FIG. 47E illustrates a top perspective view of the lever and top cover in a fourth position, in accordance with certain examples;

FIG. 48A illustrates a cross-sectional side view along section line 48A-48A of the lever and top cover of FIG. 47B, in accordance with certain examples;

Figure 47A:
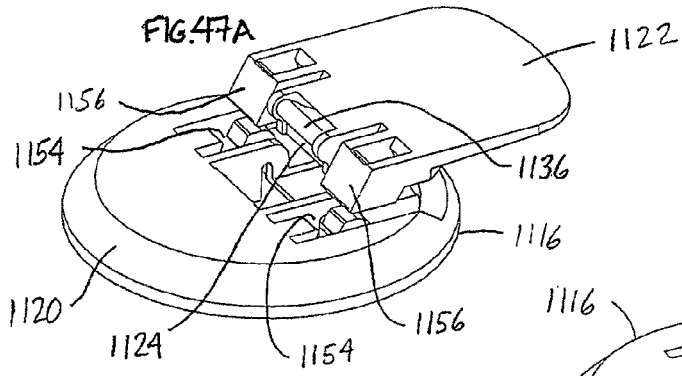
Figure 47B:
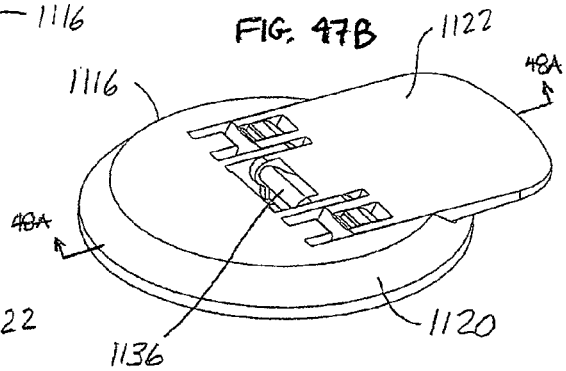
Figure 47C:
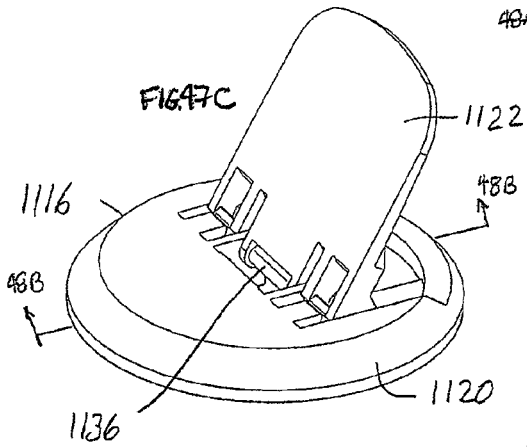
Figure 47D:
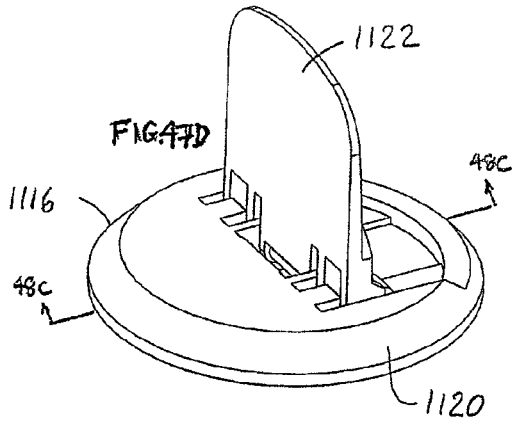
Figure 47E:
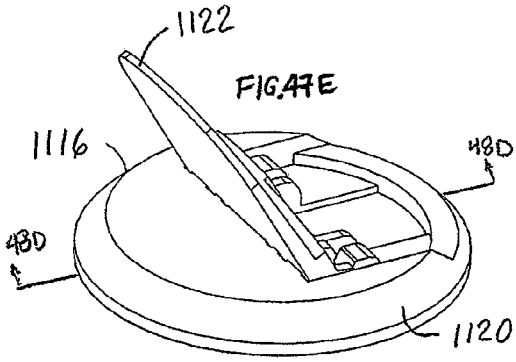
Figure 48A:
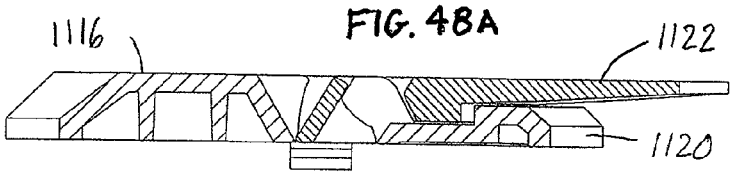
Figure 48B:
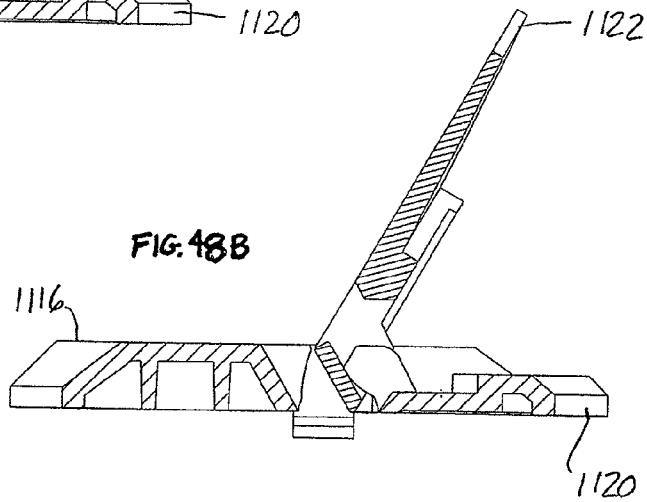
Figure 48C:
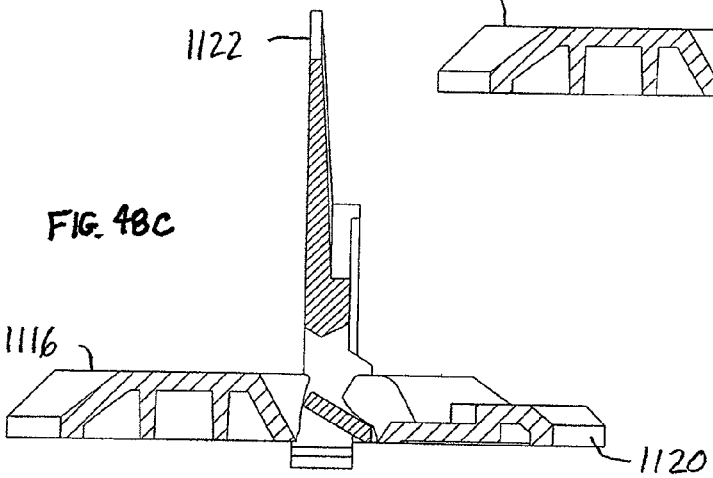
Figure 48D:
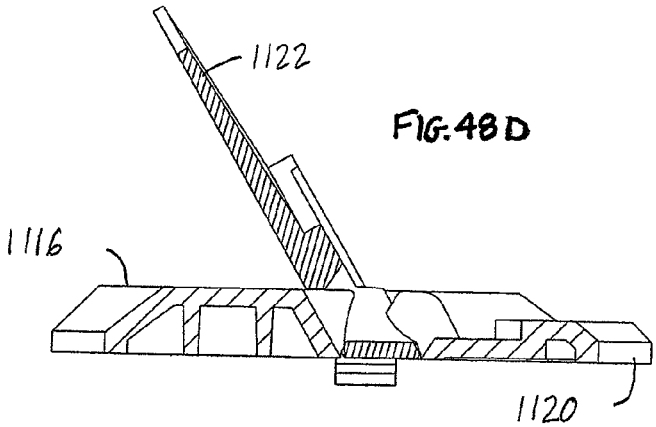
Figure 49A:
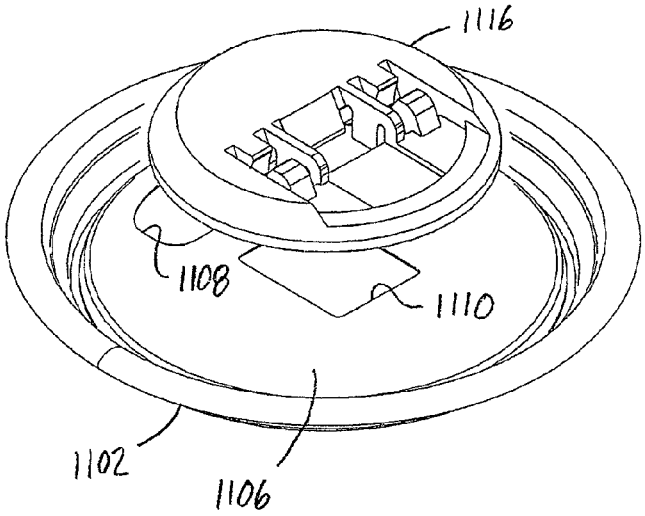
Figure 49B:
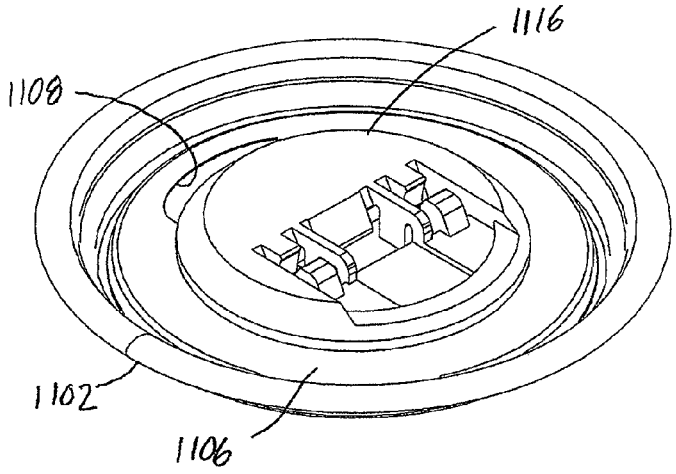
Figure 49C:
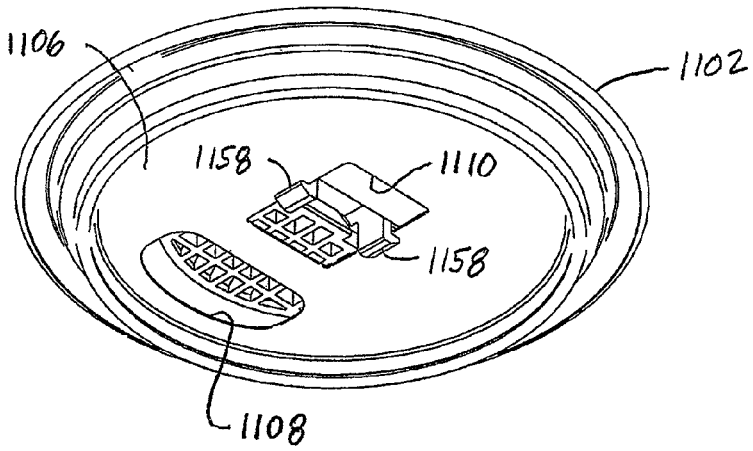
Figure 50A:
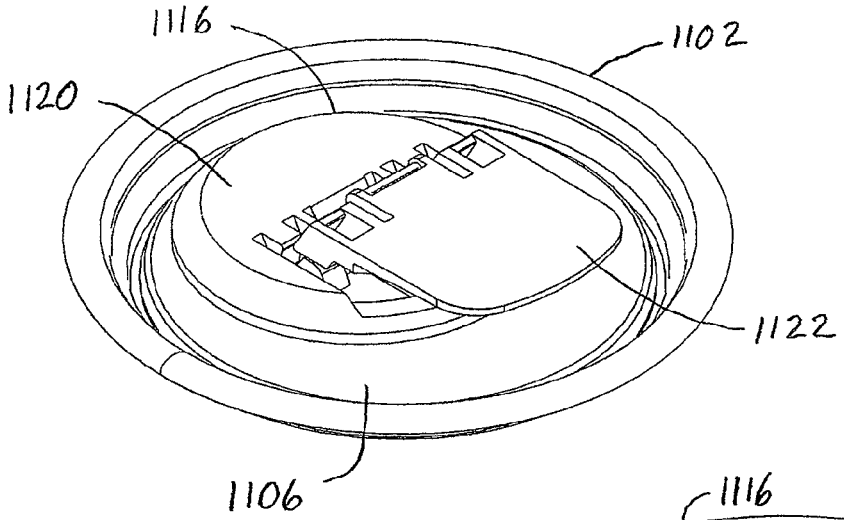
Figure 50B:
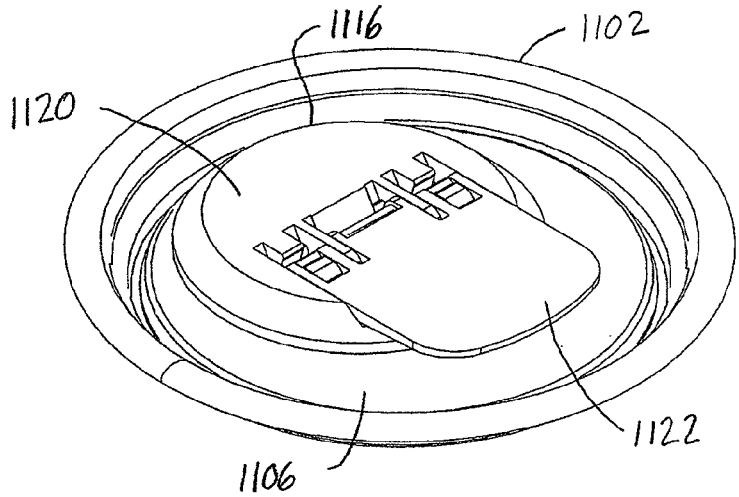
Figure 50C:
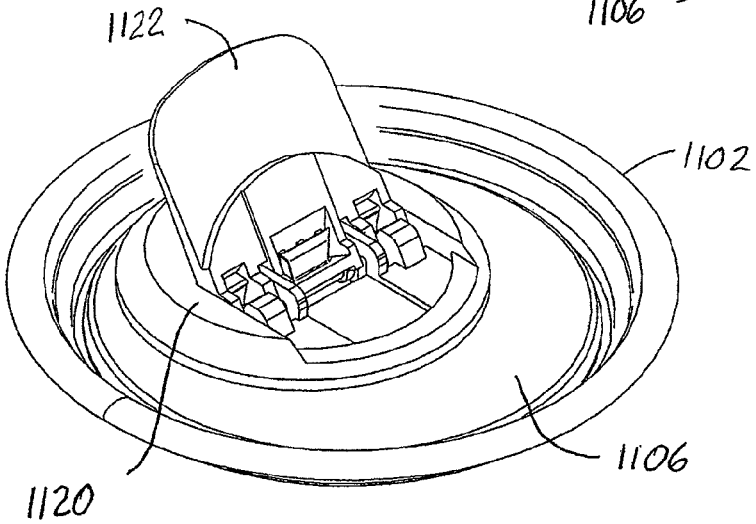
Figure 51A:
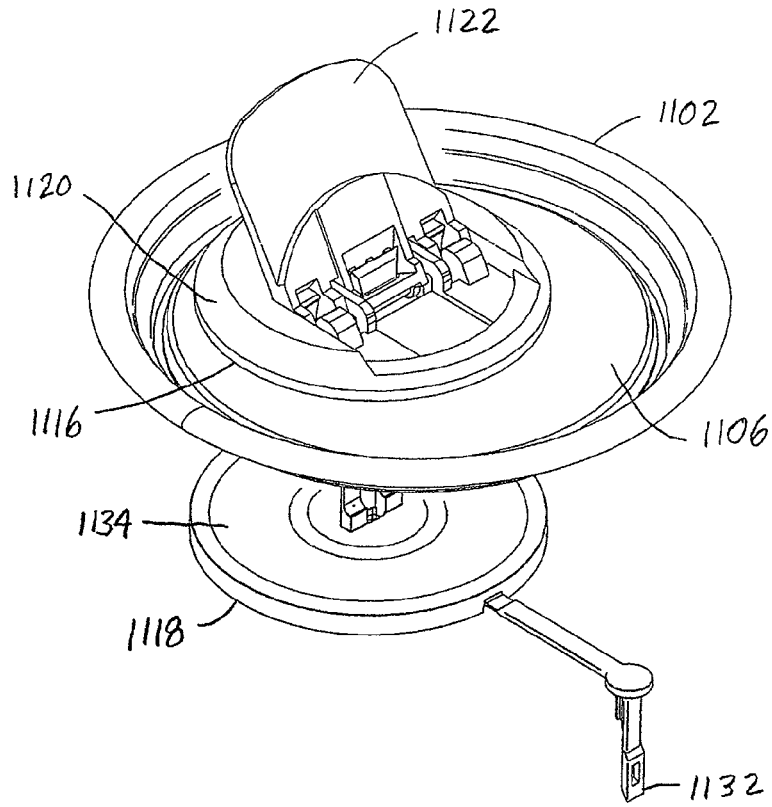
Figure 51B:
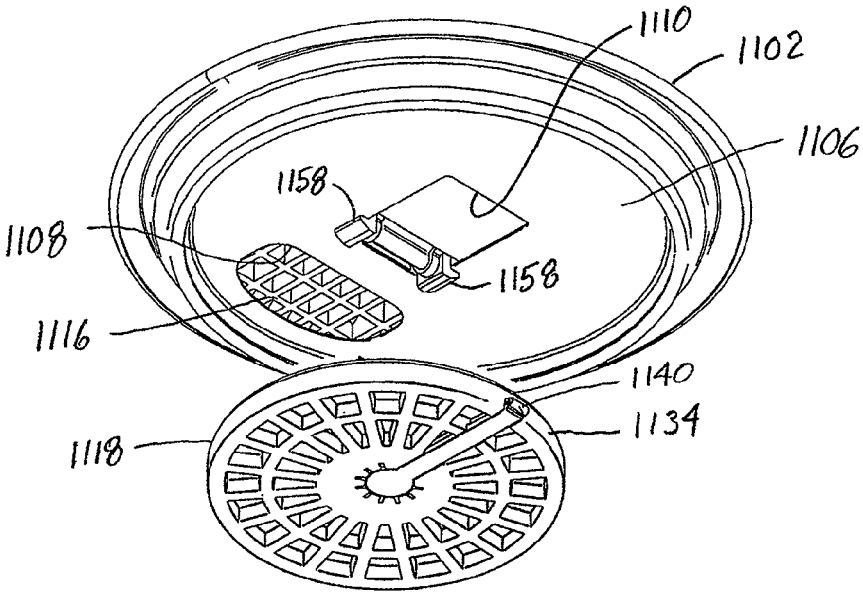
Figure 51C:
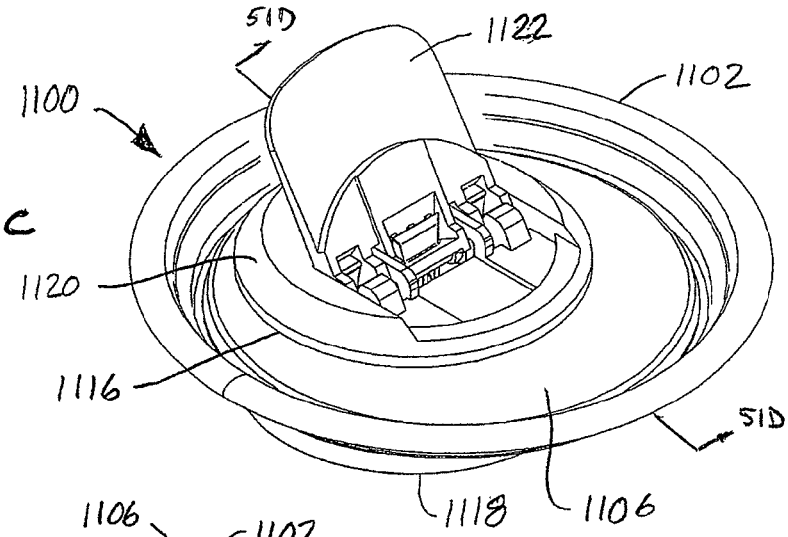
Figure 51D:
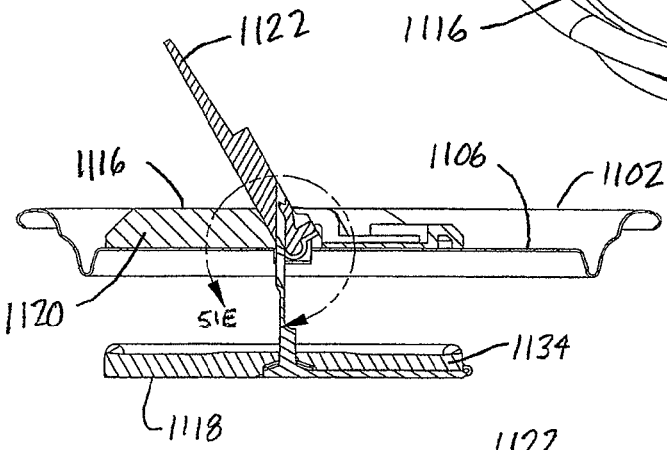
Figure 51E:
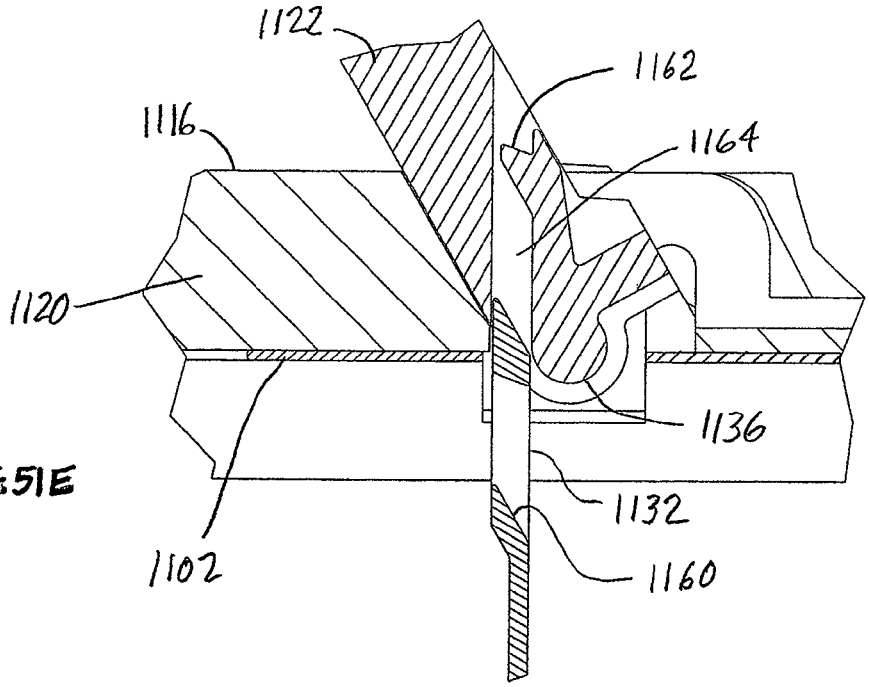
Figure 52A:
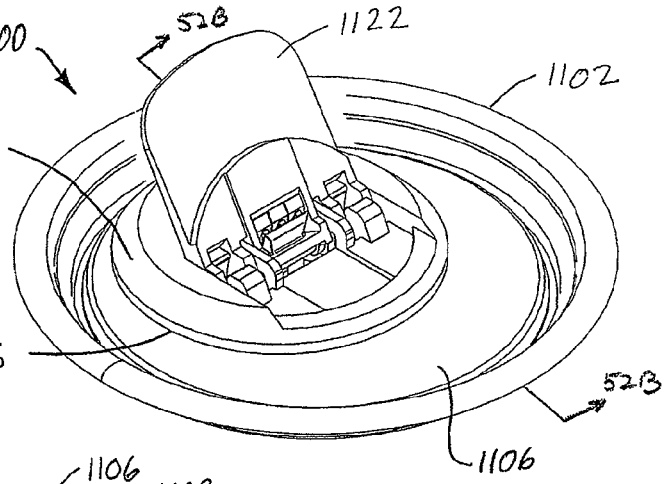
Figure 52B:
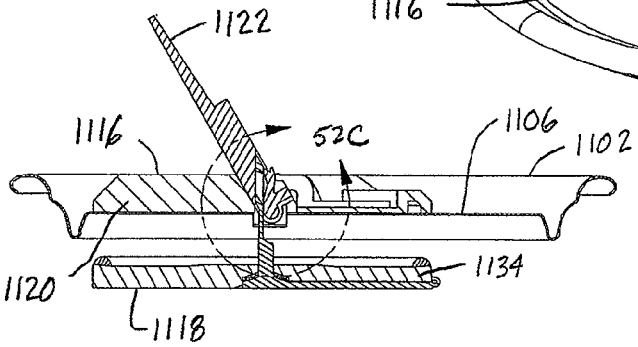
Figure 52C:
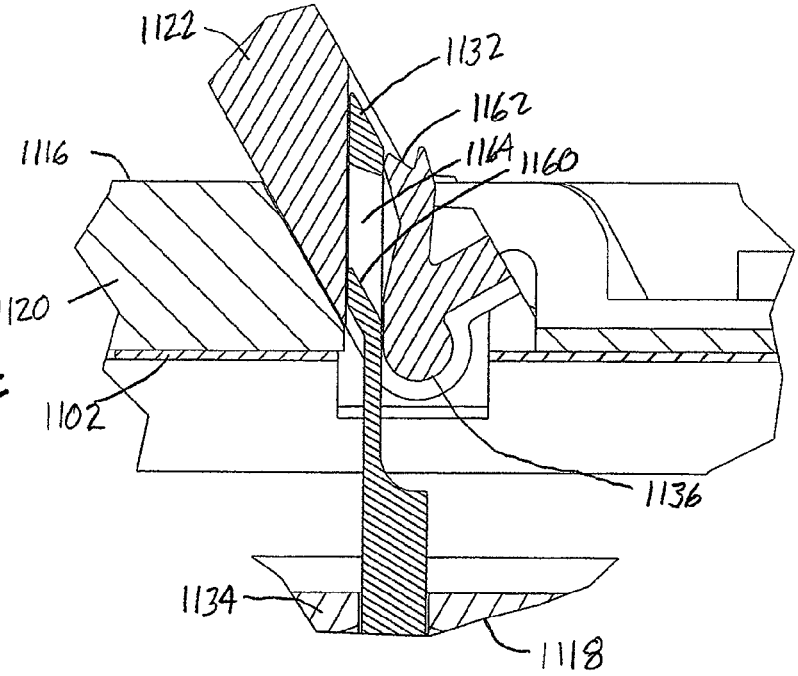
Figure 53A:
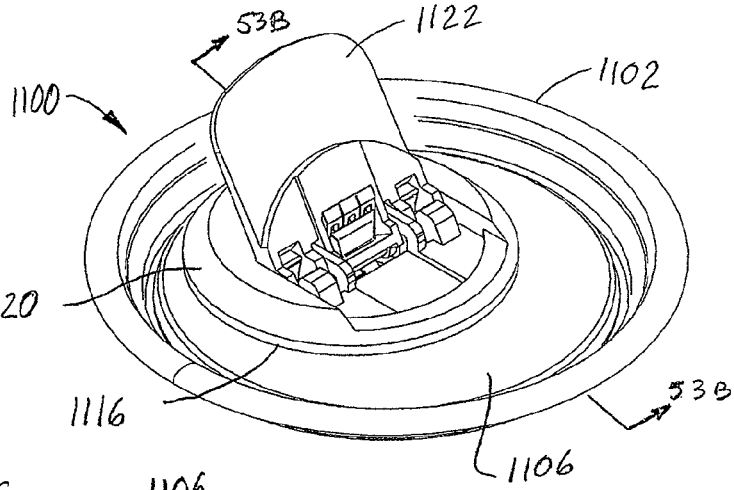
Figure 53B:
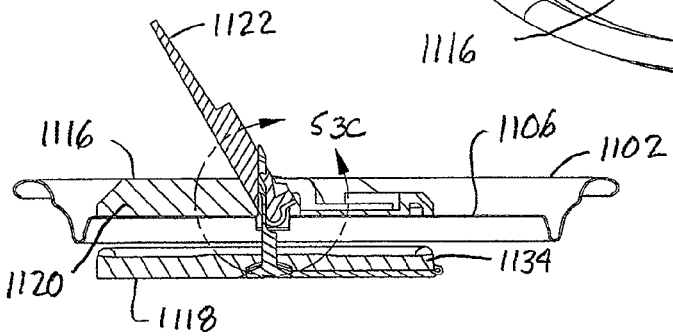
Figure 53C:
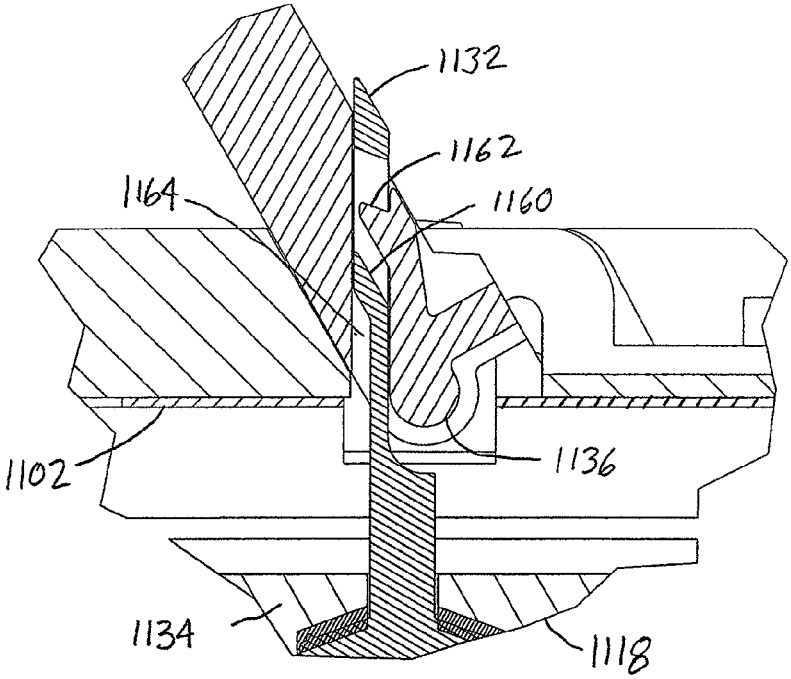
Figure 54A:
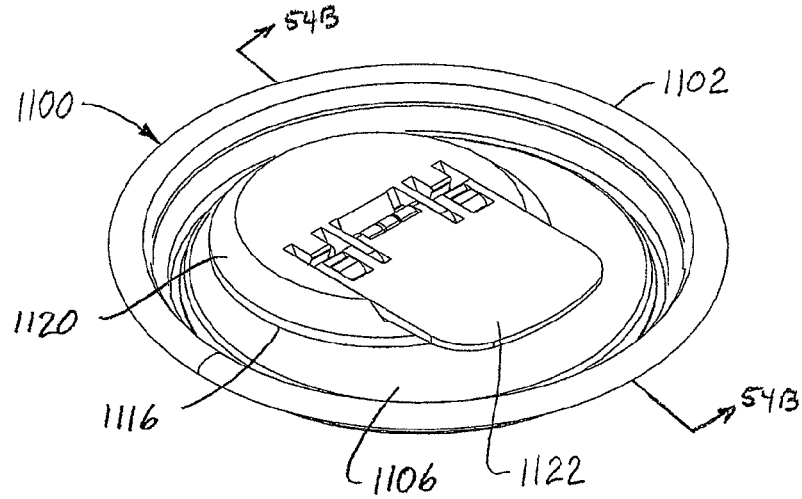
Figure 54B:
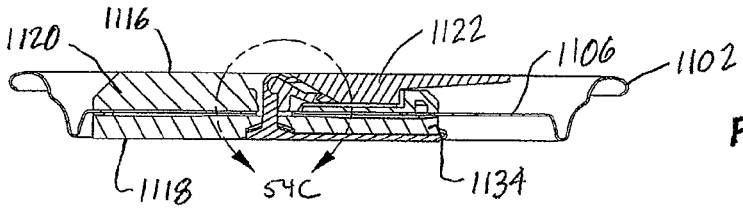
Figure 54C:
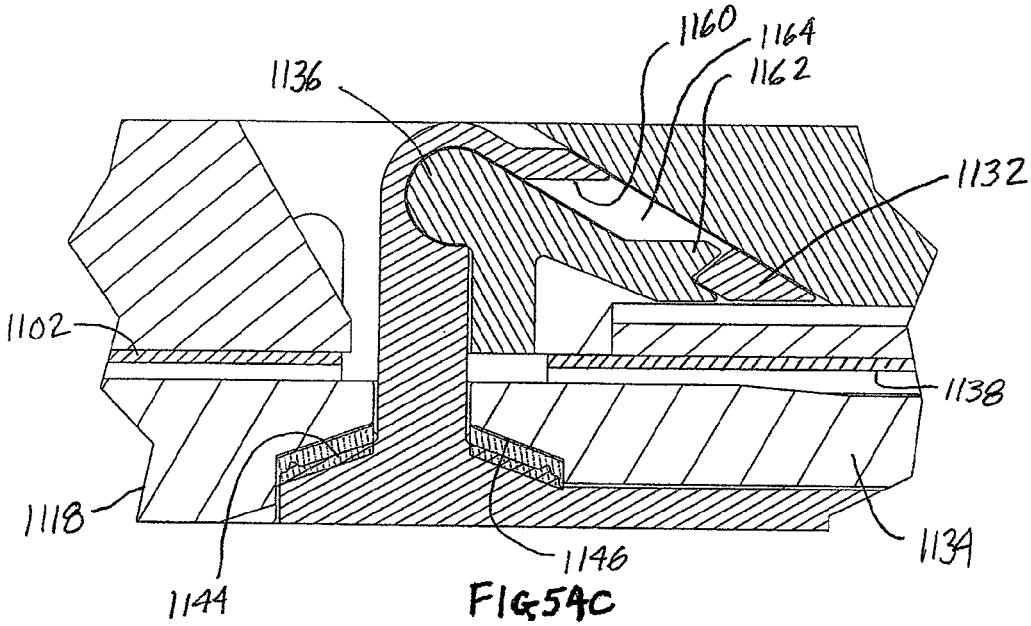

FIG. 48B illustrates a cross-sectional side view along section line 48B-48B of the lever and top cover of FIG. 47C, in accordance with certain examples;

FIG. 48C illustrates a cross-sectional side view along section line 48C-48C of the lever and top cover of FIG. 47D, in accordance with certain examples;

FIG. 48D illustrates a cross-sectional side view along section line 48D-48D of the lever and top cover of FIG. 47E, in accordance with certain examples;

FIG. 49A illustrates a top perspective view of installation of a top cover on a can end, in accordance with certain examples;

FIG. 49B illustrates a top perspective view of the top cover and can end, in accordance with certain examples;

FIG. 49C illustrates a bottom perspective view of the top cover and can end, in accordance with certain examples;

FIG. 50A illustrates a top perspective view of installation of a lever on a top cover on a can end, in accordance with certain examples;

FIG. 50B illustrates a top perspective view of the lever, top cover and can end in a first position, in accordance with certain examples;

FIG. 50C illustrates a top perspective view of the top cover and can end in a second position, in accordance with certain examples;

FIG. 51A illustrates a top perspective view of installation of a closure system, in accordance with certain examples;

FIG. 51B illustrates a bottom perspective view of installation of a closure system, in accordance with certain examples;

FIG. 51C illustrates a top perspective view of installation of a closure system in a first position, in accordance with certain examples;

FIG. 51D illustrates a cross-sectional side view along section line 51D-51D of the closure system installation of FIG. 51C, in accordance with certain examples;

FIG. 51E illustrates a cross-sectional view of the closure system of FIG. 51C, showing detail 51E of FIG. 51D, in accordance with certain examples;

FIG. 52A illustrates a top perspective view of installation of a closure system in a second position, in accordance with certain examples;

FIG. 52B illustrates a cross-sectional side view along section line 52B-52B of the closure system installation of FIG. 52A, in accordance with certain examples;

FIG. 52C illustrates a cross-sectional view of the closure system of FIG. 52A, showing detail 52C of FIG. 52B, in accordance with certain examples;

FIG. 53A illustrates a top perspective view of installation of a closure system in a third position, in accordance with certain examples;

FIG. 53B illustrates a cross-sectional side view along section line 53B-53B of the closure system installation of FIG. 53A, in accordance with certain examples;

FIG. 53C illustrates a cross-sectional view of the closure system of FIG. 53A, showing detail 53C of FIG. 53B, in accordance with certain examples;

FIG. 54A illustrates a top perspective view of installation of a closure system in a fourth position, in accordance with certain examples;

FIG. 54B illustrates a cross-sectional side view along section line 54B-54B of the closure system installation of FIG. 54A, in accordance with certain examples; and FIG. 54C illustrates a cross-sectional view of the closure system of FIG. 54A, showing detail 54C of FIG. 54B, in accordance with certain examples.

Certain features or components of the illustrative containers and devices shown in the figures may have been enlarged, distorted or otherwise shown in a non-conventional manner relative to other features or components to facilitate a better understanding of the novel containers and devices disclosed herein. It will be recognized by the person of ordinary skill in the art, given the benefit of this disclosure, that the containers and devices disclosed herein can be used in any orientation relative to gravity and suitable orientations will be readily selected by the person of ordinary skill in the art, given the benefit of this disclosure. References made to beverage containers herein is not intended to limit the disclosure to beverage containers, but instead refers to containers that may be used to hold various contents, including consumable and non-consumable goods.

DETAILED DESCRIPTION OF THE INVENTION

Certain examples of the devices and methods disclosed herein will be recognized by the person of ordinary skill in the art, given the benefit of this disclosure to provide sanitary, cost-effective containers. In particular, beverage containers are provided that have a sanitary cover, are easier to open than conventional cans, and can be repeatedly and securely resealed. The beverage container of certain examples disclosed herein will prevent the dispensing portion of the beverage container from exposure to the environment and ensure a safe and contaminant-free product. The current manufacturing process for beverage cans may be adapted to include the present invention, with reduced, minimal or no additional cost.

Conventional beverage containers, such as aluminum cans, are manufactured by well-known processes. In one process, aluminum cans are made from an aluminum coiled sheet which is fed through a cupping press that cuts discs and forms them into cup-like containers. These cups drop from the press onto a conveyor, and are fed into an ironing press where successive rings redraw and iron the cup, reducing the sidewall thickness, and achieving a full length can. The tops of the can bodies are then trimmed to eliminate rough edges and ensure height uniformity. The can bodies are then cleaned and dried. Subsequently, the can bodies are labeled and coated with a clear protective layer of varnish. The cans are then baked, treated with a coating, and re-baked. The top portion of each can body is narrowed to form a neck with an outward flange at the top edge. The bottom portions are domed to obtain the strength required to withstand internal pressure if a carbonated liquid will be added to the can. After testing for pin-holes and defects, the can bodies are placed on pallets and shipped to a beverage supplier.

The lids of conventional aluminum cans, typically referred to as "can ends," are made by stamping shells from an aluminum coiled sheet. The shells are coated with a sealant, and subsequently a rivet is placed in each can end. On those cans using a stay-on-tab type closure, the process further includes inserting a separate piece of metal as the tab under the rivet to secure it in place. The edges of the can ends generally have a curved flange. The can ends are also scored to define the opening of the can end in the finished product. The can ends are then shipped to the beverage supplier, along with the can bodies.

At the beverage supplier, a filling machine is used to pour the beverage into the can body. The process is completed after filling when the can end is added, and secured to the can body by forming a double seam with the can body. A double seam is formed by interlocking edges of the two components, the outward top edge of the can body and the curved flange at the edge of the can end, curling the can end flange around the can body edge so that the can end flange is partially rolled up and under the can body edge to form a partial seam, and crimping and flattening the partial seam against the can body to form a hermetic seal.

Most beverage cans have a stay-on-tab type closure such as those disclosed in U.S. Pat. Nos. 3,967,752 and 3,967,753 to Cudzik, and described above. However, there are many aspects of the conventional stay-on-tab closure that make it undesirable. The stay-on-tab closure does not provide for a sanitary drinking environment because the outer surface of the can and the top of the can, which comprises the stay-on-tab closure, comes into contact with the environment during storage, shipping, distribution, display, handling, and ultimately, use by the consumer. When the beverage is poured directly from the can through the opening formed from the stay-on-tab closure, the beverage comes in contact with the top and surface of the can, making for a potentially unsanitary drinking environment. Additionally, if a consumer drinks the beverage from the can directly, both the beverage and the mouth of the consumer come into contact with the surface and top of the can, also making for an unsanitary drinking environment. Additionally, the stay-on-tab type closure does not allow for reclosing the beverage container.

The present invention provides a beverage container that may be manufactured by commercially available processes and machinery with minimal retrofitting, low material and manufacturing costs, ease of stacking during shipping and storage, increased sanitary conditions of the dispensing portion, reliability and ease of opening, closing, and resealing by consumers, pourability, drinkability, recyclability, and decreased likelihood of spilling the contents of the container. These advantages of the present invention overcome the noted deficiencies of the conventional stay-on-tab type closure beverage containers.

The present invention also provides a resealable closure system to use with a beverage container that allows for locking of the system in a secure, closed, sealed position, as well as locking the device in various secure open positions. Additionally, after the beverage container is initially opened, the user may recover and protect the dispensing portion of the container to prevent contaminants from residing in the dispensing portion area.

As used herein, the term "mate" or "mating" may describe any manner of connecting or joining two or more components together. The term "mate" or "mating" may describe any mechanical, thermal, or chemical process that connect or join two or more components together. In the examples disclosed herein, the term "mate" or "mating" may mean welding, soldering, molding, adhering, crimping, folding, double seaming, clamping, snapping, interlocking, fastening or otherwise connecting two components. For example, two or more components of the container may be welded, soldered, molded, adhered, crimped, folded, double seamed, clamped, snapped, or interlocked together. In certain examples, two or more components may be mated by being fastened together with the assistance of another component, thereby forming a rigid or flexible, hinge connection. "Mating" may also mean connecting or joining at least two components having compatible threaded surfaces. The mating may be permanent or temporary.

In accordance with certain examples, a container is disclosed. The container may be used to hold various contents including, but not limited to consumable goods, and may have the ability to reliably seal and reseal the goods within the container. The goods may be in the form of at least one of a solid, liquid or gas. In certain examples, the contents may be a food, beverage, for example, a carbonated beverage, or other consumable. In other examples, the contents may be other than a food or beverage, but may still require sanitary conditions and protection from contamination while dispensing and/or storing.

In accordance with certain examples, a closure system comprising a fixed element and a movable closure system is disclosed. The movable closure element may comprise a top cover and a sealing portion. A component of the movable closure element, such as the top cover, sealing portion, or another component of the movable closure element, may secure other portions of the movable closure element to each other. This component may allow the top cover and sealing portion to operatively interact with one another, directly or indirectly. The top cover and the sealing portion may operatively interact with one another to allow movement of the sealing portion together with the top cover. The top cover and the sealing portion may operatively interact with one another to allow movement of the sealing portion in a direction that is the same as the direction in which the top cover is moved, for example, in a horizontal direction along a channel guide formed in the fixed element. Additionally, the top cover and the sealing portion may operatively interact with one another to allow movement of the sealing portion in a direction that is not the same direction as the direction in which the top cover is moved. For example, engaging the top cover by, for example, turning lifting, or otherwise moving at least a portion of the top cover, may allow the sealing portion to move in a vertical direction.

In accordance with certain examples, a container may comprise a container body and a closure system. The closure system may comprise a fixed element and a movable closure element. In certain examples, the fixed element may comprise a can end comprising a dispensing portion, and a channel guide having a first end and a second end. The fixed element may be secured to an end of the container body. The beverage container may additionally comprise a movable closure element comprising a top cover, a sealing portion and a stem. The top cover may comprise a grip. The sealing portion may reside within the container body and comprise a channel constructed and arranged to accept the channel guide of the fixed element. The stem may be positioned within the channel and have a top end constructed and arranged to be mated with the top cover and a bottom end constructed and arranged to be mated with the sealing portion. In certain examples, the stem may be formed as a portion of the top cover and/or the sealing portion, and thus may not be a separate component of the closure system.

In accordance with certain examples, at a first position, the top cover covers the dispensing portion, the sealing portion is in contact with a bottom surface of the can end, and the stem is positioned at the first end of the channel guide. At a second position, the top cover covers the dispensing portion and is rotated relative to the first position, the sealing portion is spaced a predetermined distance from the bottom surface of the can end, and the stem is positioned at the first end of the channel guide. At a third position the top cover exposes the dispensing portion, the sealing portion is spaced a predetermined distance from the bottom surface of the can end, and the stem is positioned at the second end of the channel guide.

In accordance with certain examples, a closure system for sealing a container may be constructed and arranged to be mated with a container body. The closure system may comprise a fixed element comprising a can end comprising a dispensing portion and a channel guide having a first end and a second end. The fixed element may be constructed and arranged to be secured to an end of the container body. The closure system may also comprise a movable closure element. The movable closure element may comprise a top cover comprising a grip and a sealing portion comprising a channel constructed and arranged to accept the channel guide. The movable closure element may also comprise a stem residing within the channel and having a top end constructed and arranged to be mated with the top cover and a bottom end constructed and arranged to be mated with the sealing portion. The closure system may be constructed and arranged such that as the top cover and stem are rotated the sealing portion moves vertically along the stem, and as the top cover and stem are moved in a horizontal direction the sealing portion moves in a horizontal direction.

In accordance with certain examples, a closure system for sealing a container may be constructed and arranged to be mated with a container body. The closure system may comprise a fixed element comprising a can end comprising a dispensing portion and a channel guide having a first end and a second end. The fixed element may be constructed and arranged to be secured to an end of the container body. The closure element may also comprise a movable closure element comprising a top cover comprising a grip comprising a lever. The lever may comprise a ring. The movable closure element may also comprise a sealing portion comprising a channel constructed and arranged to accept the channel guide and a lever receiving portion constructed and arranged to accept the lever. In accordance with certain examples, as the lever of the top cover is lifted, the lever may move to allow the sealing portion to move vertically, and as the lever is moved in a horizontal direction the sealing portion may move in the horizontal direction.

In accordance with certain examples, a closure system for sealing a container is constructed and arranged to be mated with a container body. The closure system comprises a fixed element and a movable closure element. The fixed element comprises a can end comprising a dispensing portion and a channel guide having a first end and a second end. The fixed element is constructed and arranged to be secured to an end of the container body. The movable closure element comprises a top cover comprising a lever, and a sealing portion comprising a lever receiving portion. The lever receiving portion is constructed and arranged to accept the lever such that, as the lever is lifted, the sealing portion moves in a downward direction away from the can end. The sealing portion is also constructed and arranged such that, as the top cover is moved horizontally from the first end of the channel guide to the second end of the channel guide the dispensing portion is exposed.

In accordance with an additional aspect, a closure system for sealing a container constructed and arranged to be mated with a container body. The closure system comprises a fixed element and a movable closure element. The fixed element comprises a can end comprising a dispensing portion and a channel guide. The fixed element is constructed and arranged to be secured to an end of the container body. The movable closure comprises a top cover comprising a grip, and a sealing portion. The sealing portion is constructed and arranged to operatively interact with the top cover, such that as the top cover is engaged, the sealing portion moves in a vertical direction, and as the top cover is moved in a horizontal direction along the channel guide, the sealing portion moves in the horizontal direction.

In accordance with certain examples, the beverage container may be configured to have a container body defining at least a portion of the container that holds the contents of the container. The container body may have an opening for filling and/or dispensing, for example, that may be positioned at a first end portion thereof. The container body may include a plurality of such openings, each with similar or different functions. For example, the container body may include a second opening positioned at a second end portion thereof that may be opposite an opening positioned at a first end portion. The container body may be made from any suitable material for holding, storing, dispensing and/or cooling or heating its contents in a cost-effective manner, ensuring the integrity of the contents, without the risk of contamination. The material may include, but not be limited to, metals and plastics. For example, the container body may be made of glass, steel, tin, aluminum, or plastic materials such as polyethylene terephthalate (PET), high-density polyethylene, low-density polyethylene, polysulfone, polyvinyl chloride, polypropylene, polystyrene, polycarbonate, and the like. The container body may be manufactured as a single component or from multiple components. Container bodies manufactured from a single component may include a seam or joint to provide a structural seal; alternatively, such bodies may be seamless. Container bodies manufactured from multiple components may be assembled by mating or otherwise joining sub-components in various ways. The container body may be formed of a variety of functional and/or ornamental shapes. It will be within the ability of the person of ordinary skill in the art, given the benefit of the disclosure, to select or to design suitable shapes, sizes and materials for construction of the container body disclosed herein. The container body may also be configured to be filled or refilled.

The container may comprise a component to enclose and/or seal the contents of the beverage container. The component may be used to close a container body and to ensure the integrity of the contents of the container, without risk of contamination. In certain examples, the component may be constructed and arranged to attach to the container body. The component may be a base plate. The base plate may be attached opposite an end of the container body that may be used for dispensing the contents of the container. The base plate may be constructed of materials compatible with the container body, such that the base plate may be mated with the container body. In some examples, the base plate may be flat. In certain other examples, the base plate may be domed to protrude into the container to alleviate pressure within the container if the contents are sealed under pressure or, for example, are carbonated. Attachment of the base plate to the container body may occur by temporarily or permanently mating the base plate and the container body.

The container may comprise a closure system. The closure system may be constructed and arranged, in conjunction with the container body, to enclose the various contents inside the container. The closure system may be constructed and arranged to seal the contents inside the container to ensure the integrity of the contents, without the risk of contamination prior to, during, and after a consumer has used the container. In certain examples, the closer system may be constructed and arranged to hermetically seal the contents inside the container. The closure system may be configured to provide an opening so that the contents of the container may be dispensed, and to provide a sanitary surface for dispensing and/or consuming the contents. The closure system may be configured to be resealable to allow a user to open and close the container as desired, to control the size of the opening as desired, and to lock and unlock the closure system in a specific position to assist the user in dispensing a desired flow of contents out of the container, or to allow the user to contain the contents within the container.

The closure system may be formed of various functional and/or ornamental shapes and sizes to be compatible with and to mate with the container body. The closure system may be made, for example, of any material to provide for sealing of the beverage container, to ensure the integrity of the contents, without the risk of contamination, and for holding, storing, and/or cooling or heating the contents of the beverage container. The closure system may be made of the same material as the container body or a different material. It will be within the ability of the person of ordinary skill in the art, given the benefit of the disclosure, to select or to design suitable shapes, sizes and materials for construction of the closure system disclosed herein.

The closure system may comprise one or more components that enclose and seal the contents inside the container. The closure system may also comprise one or more components that allow the contents within the container to be dispensed. Closure systems that comprise more than one component may comprise a first component constructed of one material and a second component constructed of a different, compatible material so that the first component and the second component may be mated. Either of the first component or the second component and any other additional components of the closure system may be the same or different material from the container body, so long as there exists a seal between at least one component of the closure system and the container body. The seal may be formed in various manners, including, but not limited to, a mechanical seal, a thermal seal, a chemical seal, or the like. The components of the closure system may be pre-assembled prior to securing the closure system to the container body, or may be attached consecutively, either to the container body, to the components of the closure system, or both. For example, components of the closure system may be attached to each other and one or more of the components of the closure system may be attached to the container body. Each component of the closure system may be permanently or temporarily attached to one or more other components of the closure system, the container body, or both. The closure system may be secured to the container body by various methods. The securing may be accomplished by mating.

The closure system may comprise a component that provides the seal between the closure system and the container body to ensure the integrity of the contents of the container, without risk of contamination, in conjunction with the other components of the closure system. The component may be configured to provide a sanitary opening for allowing contents to exit or enter the container. The component may provide a sanitary opening for direct consumption, for example, drinking, from the container. The component may provide for stabilization of other components of the closure system, for example to prevent movement of one component relative to another. The component may be secured permanently to the container body and may be constructed and arranged to accept overflow or spillage from the container. The component may be a fixed element that may comprise one or more sub-components. A fixed element that comprises more than one sub-component may be preassembled and attached to the container body as a collective fixed element, or may be attached to the container body in consecutive order. The fixed element may be secured to the container body by mating.

Each component of the fixed element may be made of the same or different material from each other and from the container body. The fixed element may provide a surface for indicia for labeling the contents of the container, marketing, to facilitate opening of the container, or the like. The fixed element may provide a surface that is easily printed on using conventional printing methods.

As noted above, the fixed element may comprise one or more sub-components. For example, the fixed element may comprise a can end that may be one or more components. The can end may comprise a sub-component that provides an opening for allowing contents to exit or enter the container. The opening may be constructed and arranged to provide a sanitary area for direct consumption from the container. The sub-component may be a dispensing portion constructed and arranged to be compatible with and to be mated with one or more components or sub-components of the closure system or to the container body. The dispensing portion may be of various functional and/or ornamental shapes and sizes suitable for dispensing various fluids and solids. The dispensing portion may be constructed and arranged to deliver contents directly to a consumer (i.e., by mouth) or to deliver contents to another container, for example, a cup or a bowl in the case of beverages or foods. In the case of non-consumable goods, the dispensing portion may be constructed and arranged to deliver contents to another container, for example, a tray in the case of dispensing paint from a paint can. The dispensing portion may be constructed and arranged to be suitable for dispensing the contents in a reliable, accurate, and easy manner. In certain examples, the dispensing portion may be constructed and arranged to provide ease in drinking and/or pouring directly from the container, and the dimensions of the dispensing portion may be selected and adjusted by the consumer. The dispensing portion may also allow passage of implements easily through this portion, with clear access and in a non-tortuous path. For example the dispensing portion may allow passage of a funnel, straw, or the like to assist with addition or dispensing the contents of the container. It will be within the ability of the person of ordinary skill in the art, given the benefit of the disclosure, to select or to design suitable shapes, sizes and materials for construction of the dispensing portion disclosed herein.

The can end may be constructed and arranged to cooperate with other components of the closure system. The can end may provide a sub-component that allows cooperation with other components of the closure system. The sub-component may allow other components of the closure system to interact with it to accomplish adequate sealing of the container. The sub-component may be constructed and arranged to mate with other components of the closure system to ensure that each component does or does not move relative to a third component. In one embodiment, the sub-component may be an aligner, guide, or connector to control the rate of adjustment of this sub-component to another component. The sub-component may also allow other components of the closure system to fit through this sub-component, allowing various components of the closure system to mate, for example, during assembly of the closure system. The sub-component may be a channel guide. The channel guide may be constructed and arranged to mate with other portions of the closure system, such as portions of the movable closure element. The channel guide may have a first end that participates in a sealing or opening process of the container, and a second end that participates in another sealing or opening process of the container. In some examples, the channel guide may comprise an edge or lip that mates or cooperates with one or more other components of the system. In other examples, the channel guide may be constructed to allow communication between the inside and the outside of the container. The channel guide and dispensing portion may be constructed and arranged such that each opening provides structural integrity to the can end and the beverage container. In certain examples, this may be accomplished by having the channel guide and dispensing portion be combined into one opening. In certain examples, the channel guide and dispensing portion are constructed as at least two openings. This may allow less metal to be removed from the can end, and strengthen it, as compared to another construction that may include one opening comprising the channel guide and dispensing portion.

The can end comprising more than one sub-component may be preassembled and attached to the container body as a collective can end. Alternatively, it may be attached to the container body in consecutive order, along with other components of the closure system. The sub-components of the can end may be both secured to the container body, or one sub-component of the can end may be attached to another sub-component of the can end, which then may be secured to the container body. The securing may be accomplished by mating. Each component of the can may be made of the same or different material from each other and from the other components of the closure system, and the container body.

In a two-component can end, the first component may have a dispensing portion and the second component may have a dispensing portion. The dispensing portion of the first component may be aligned with the dispensing portion of the second component. The first component and the second component may be made of the same or different, compatible materials. For example, the first and second component may be made entirely of aluminum or a polymeric material. In the alternative, the first component may be made of aluminum, while the second component may be made of a polymeric material. The dispensing portions of the first and second component may be the same or different size and shape, so long as they provide a clear path to the contents of the container.

The first component of the can end may comprise the channel guide. The channel guide may be positioned in the first component so that it resides in a portion of the dispensing portion of the second component of the can end. The first and second component may both comprise a portion of the channel guide, so that mating of the first and second components of the can end create the channel guide. In certain examples the first component may be referred to as a can cover, and the second component may be referred to as a can end.

The sub-components of the can end may be secured to each other in various ways. For example, the first component may be attached to the second component by way of an adhesive. For example, if the container will be used for foodstuffs or liquids, a Food and Drug Administration approved adhesive may be used. These components may also be secured to one another by mating complementary parts to one another. For example, mating may occur by matching up openings within the first component with raised portions, such as pins or pegs in the second component which are then flattened to secure the components to each other. The first component and second component may have edges that may be crimped to one another, for example, in the case of aluminum components. Snap hooks may alternatively be used to snap the first component into the second component. One or more tabs may be used to engage and hold the first and second components of the can end in place. The one or more tabs that are engaged to hold the first and second components in place may be held by being forced up against the inside one of the first and second component. Of course, those skilled in the art may recognize other means for securing the first and second components which may be used to assemble this portion of the closure system.

The closure system may comprise a component to secure the fixed element to the container body, and to retain the contents within the container to ensure the integrity of the contents. The component may be constructed and arranged to secure the fixed element to the container body. In certain examples, the component may be made as one piece as a part of the can end. As noted above, beverage containers of the present invention may be manufactured by commercially available processes with minimal retrofitting. The fixed element may comprise a component that may be mated and secured to the container body by conventional beverage can manufacturing processes. For example, the component may be mated with the container body to form a seam. The seam may be a double seam that provides a hermetic seal. In other examples, the component may be mated with the container body by snapping latches in one component or sub-component into the grooves of another component or sub-component. In certain examples, the component may be a rim. The rim may be constructed and arranged to secure the fixed element to the container body. The rim may be made of the same or different material as any one of the components of the container and/or closure system. The rim may have a perimeter that is the same or different shape as the perimeter of the top portion of the container body. For example, the rim may have a circular outer circumference, and may have a diameter the same as or larger than the diameter of the top portion of the container body. As noted above, the rim may be made as part of the can end. In certain other examples, the rim may be made as a separate component. The rim may comprise at least one opening. The opening may be constructed and arranged of a shape, size and material to ultimately allow the contents of the container to be dispensed smoothly and efficiently from the container. The opening may allow for a can end to fit within the opening. The opening may be a pre-determined shape, for example, the opening may be in the shape of a circle that is centered with respect to the outer perimeter of the rim. In other examples, the opening may be off-set with respect to the outer perimeter of the rim. The shape of the opening may be the same or different shape as the outer perimeter of the rim. The shape of the opening of the rim may be the same or different shape as the outer perimeter of the spout.

The closure system may comprise a component that provides a closure to the beverage container. The component may ensure the integrity of the contents and enclose the contents of the container, without risk of contamination, during holding, storing, shipping, dispensing, and/or cooling or heating the contents by, for example, the manufacturer, the distributor and/or the consumer. Additionally, the component may protect the dispensing portion of the container from the environment, thereby ensuring sanitary conditions until a user opens the container. The component may also protect the portion of the container from the environment after opening, as desired by the user. The component may work together with the fixed element to provide for a secure closure that ensures the integrity of the contents of the container, without the risk of contamination. The component may be a movable closure element that may seal off the contents of the container from the environment. The movable closure element may seal off the contents of the container initially, and, subsequent to opening, may be used again to seal off contents and further protect the dispensing portion from the environment. The movable closure element may be constructed and arranged to mate with one or more components of the fixed element, the container body or both. In certain examples, the movable closure element may be constructed and arranged to be mated with the dispensing portion and/or the bottom surface of the can end. The movable closure element may be constructed and arranged to be used in a locked or unlocked position. The movable closure element may be of various functional and/or ornamental shapes and sizes to be mated with the other components of the closure system and/or container body, and may be constructed of a material suitable for such purposes. The movable closure element may be sized and shaped to facilitate opening and closing of the container. The movable closure element may provide a surface for indicia for labeling the contents of the container, for marketing purposes, to facilitate opening of the container, or the like. At least a portion of the movable closure element may provide a surface that is easily printed on using conventional printing methods.

The movable closure element may comprise one or more components that may be permanently or temporarily attached to each other. The movable closure element may comprise a component to cover the dispensing portion or an area of the fixed element larger than the dispensing portion, and retain the contents inside the container. In certain examples, the component may reveal the entire dispensing portion, or a section thereof. The component may be in contact with the fixed element at one or more points. The component may have the ability to move from a first position to one or more other positions to, for example, cover or reveal the dispensing portion. Moving may involve, for example, one or more of sliding, twisting, shifting, turning, pulling, pushing, transferring, removing, engaging or otherwise modifying the position of one or more components of the closure system, for example, the top cover. The component may reside outside the container and may serve as a top cover for the container. The top cover may be of various functional and/or ornamental shapes and sizes to provide protection to the dispensing portion from the environment and to retain contents within the container.

The top cover may comprise one or more sub-components to assist a consumer in moving the top cover. For example, this sub-component may assist the consumer in turning or twisting the top cover to a position, or assist the consumer in shifting or sliding the top cover to another position. The sub-component may be a grip which may include, for example, one or more of any of an edge, ridge, rim, notch, groove, cavity, depression, indentation, pitted or rough surface, ring or lever that is on, in or attached to the top cover suitable for assisting a consumer in moving the top cover as desired. The grip may be manufactured as part of the top cover, for example, in a molding process, or may be manufactured separately, to be mated with the top cover during manufacturing of the closure system. In certain examples, the grip may be a portion of the top cover that may be manipulated by the user into a position that may then allow for moving the top cover, for example, turning or shifting the top cover. The manipulation may be performed by flipping a portion of the top cover that is engaged with a hinge, which allows the portion of the top cover to move from a horizontal position to a vertical position, thereby forming a sort of handle, lever, or the like. The top cover may comprise a portion that may be mated with other portions of the movable closure element, which may, together, assist in the opening and closing of the container, and covering and revealing the dispensing portion using the closure system. The top cover may also comprise a portion that provides a seal between the top cover and the top surface of the fixed element. In certain examples, this portion may be a seal, such as a gasket or o-ring.

The top cover or fixed element may also comprise one or more components that allow a portion of the top cover to be secured to limit movement of the portion of the top cover. The one or more components may secure, lock, or fasten a portion of the top cover to another portion of the top cover. For example, a component of the top cover or fixed element may be constructed and arranged to mate with a portion of the top cover, such as a lever, to secure the lever in a position such that the lever is fixed in place or is secured in a resting position. A component of the top cover may be a groove that may mate with a snap hook on the lever to secure the lever in a resting position on the top cover. In another example a component of the top cover may be constructed and arranged to mate with another component of the top cover, to at least in part secure the top cover to the fixed element.

The movable closure element may also comprise a component to provide a seal and retain the contents in the container in conjunction with other components of the movable closure element. This component may provide a secure, reliable, leak-proof closure for the container. The component may also allow for dispensing of the contents from the container. The component may be a sealing portion comprising one or more components. The sealing portion may be of various functional and/or ornamental shapes and sizes to provide a seal for retaining contents inside the container. The sealing portion may also be of various functional and/or ornamental shapes and sizes to provide for a release of pressure from within the container, for example, if the contents within the container comprise a carbonated beverage. The sealing portion may reside within the container and have contact with the bottom surface of the can end. In certain examples, the sealing portion may reside within the container but not necessarily be in contact with the bottom surface of the can end. The sealing portion may provide for a seal for retaining contents inside the container, which may be enhanced by the internal pressure of the contents; however, the internal pressure is not required to provide the seal. The sealing portion may be constructed of materials that are compatible with the other components of the beverage container, and may also be constructed of materials that are compatible with the contents of the container. For example, the sealing portion may be constructed of a material that is inert or non-reactive with the contents of the container. In certain examples, the sealing portion may be made of polypropylene. Suitable shapes, sizes and materials for the sealing portion will be readily selected by a person of ordinary skill in the art, given the benefit of the disclosure. Other means may be used alternatively or in conjunction with the above described mechanical elements to secure the fixed element to the container body.

The sealing portion may comprise a sub-component that may assist with obtaining and maintaining the integrity of the seal of the container, initially, and after opening and during use by the consumer. The sub-component may enhance the sealing capability of the sealing portion. The sub-component may be manufactured separately from the sealing portion, or may be manufactured as part of the sealing portion. In the former circumstance, the sub-component may be mated with the sealing portion by various mating techniques discussed above, including the use of an adhesive, or through construction and arrangement of the sub-component and the sealing portion. The sealing portion may be constructed and arranged to accept the sub-component to ensure that the two components mate properly. For example, the sealing portion may contain a groove or other structure to accept the sub-component into the sealing portion. In the latter circumstance, the sub-component may be molded directly to the sealing portion through conventional molding processes. The sub-component may be an o-ring or gasket used to ensure a proper seal between the sealing portion and the bottom surface of the can end. The o-ring or gasket may be constructed of any suitable material to create such a seal, and that may be compatible with the other components of the closure system, such as the sealing portion and can end, as well as the contents of the container. For example, the o-ring may be made of a polymeric material that has a suitable flexibility to create the desired seal. The sealing portion and the sub-component may be made of the same material, as one piece, for example, an o-ring or gasket like material that may function as the sealing portion and as a seal.

The sealing portion may comprise one or more sub-components that may allow for release of pressure from within the container, for example, if the contents within the container comprise a carbonated beverage. The one or more sub-components may interact with other components or sub-components of the closure system to allow for release of pressure from within the container. The one or more sub-components may also participate in the sealing capability of the sealing portion. The sub-component may be manufactured separately from the sealing portion, or may be manufactured as part of the sealing portion. The one or more components can be of any suitable size or shape to accomplish release of pressure from within the container.

The one or more sub-components may form an opening in the sealing portion. The opening may be of any size or shape suitable for allowing any pressure from within the container to be released in a pre-determined desirable manner. The opening may extend through the entire thickness of the sealing portion. The diameter or width of the opening may be the same throughout the thickness of the sealing portion. In some examples, the diameter or width of the opening may decrease or increase throughout the thickness of the sealing portion, in a gradual or step-wise manner.

The sealing portion may also comprise an additional sub-component of the sealing portion that may allow for release of pressure from within the container, for example, if the contents within the container comprise a carbonated beverage. The sub-component may interact with other components or sub-components of the closure system to allow for release of pressure from within the container. The sub-component may also participate in the sealing capability of the sealing portion. The sub-component may be manufactured separately from the sealing portion, or may be manufactured as part of the sealing portion. For example, the sub-component may be manufactured as part of the sealing portion sub-component that may assist with obtaining and maintaining the integrity of the seal of the container, initially, and after opening and during use by the consumer, for example, the o-ring or gasket. The sub-component may be an over-mold that is constructed and arranged to be positioned within the opening of the sealing portion. The over-mold may comprise an opening that may align with the opening of the sealing portion to allow for release of pressure from within the container. The opening in the over-mold may also align with a portion of the top cover to allow for release of pressure from within the container. For example, as the lever of the top cover is lifted to a predetermined angle, the opening in the over-mold may align with an opening of the lever to allow for the release of pressure from within the container. A predetermined angle as discussed herein refers to an angle as measured between the bottom surface of a grip, for example a lever, and the horizontal plane extending across the fixed element or can end.

The over-mold may be mated with the sealing portion by various mating techniques discussed above, including the use of an adhesive, chemical or thermal bond, or through construction and arrangement of the sub-component and the sealing portion, such that an appropriate fit is achieved and an additional mating technique is not required. In certain examples, the pressure within the container may secure the over-mold in place within the opening of the sealing portion and up against another component of the closure system, for example the lever of the top cover. This may ensure a secure seal of the container prior to it being opened using the closure system. The over-mold may be molded directly to the sealing portion through conventional molding processes. The over-mold may be constructed of any suitable material to participate in adequate sealing of the closure system and release of pressure from within the container, and that may be compatible with the other components of the closure system, such as the sealing portion, top cover, can end, as well as the contents of the container. For example, the over-mold may be made of a polymeric material that has a suitable flexibility to create the desired seal. In certain examples, the over-mold may be made of a thermoplastic elastomer (TPE). If, for example the sealing portion, often referred to in the molding industry as a substrate, is made of polypropylene, and the over-mold is made of TPE, a thermal bond can be initiated between these two components by applying heat. The sealing portion and the one or more sub-components may be made of the same material, as one piece, for example, an o-ring or gasket-like material that may function as the sealing portion, a seal, and as a suitable opening for releasing pressure from within the container.

The sealing portion may comprise a sub-component that may allow for movement of the sealing portion in a given direction. The sub-component may also interact with other components of the closure system, such as the fixed element to prevent movement of the sealing portion in a different given direction. The sub-component may interact with other components of the closure system, such as the fixed element, can end, or channel guide to cover the dispensing portion, or to expose the dispensing portion. The sub-component may further be constructed and arranged to mate with or accept a component or sub-component of the fixed element. In one embodiment, the sub-component may be an aligner, guide, or connector to control the rate of adjustment of this sub-component to another component. For example, the sub-component may be a channel that may mate with a component of the fixed element, for example, the can end. The channel may mate with at least a portion of the channel guide of the can end. Alternatively, at least a portion of the channel may mate with the channel guide. The channel and channel guide may mate by various mechanisms. For example, the channel and channel guide may mate such that it allows for movement of the sealing portion relative to the channel guide. The movement of the sealing portion relative to the channel guide may be in the vertical direction, i.e., upwards or downwards. In certain embodiments, at least a portion of the sealing portion may move in a horizontal direction, parallel to the can end, without making contact with the can end during movement.

The channel or channel guide may contain a section that allows the sealing portion to move relative to each other, but that permits movement of the channel up to a certain predetermined distance. For example, the section of the channel or channel guide may be constructed and arranged to prevent the sealing portion from moving any further in a given direction. The section of the channel or channel guide may prevent the sealing portion from becoming separated from the other components of the closure system. The section may also prevent the sealing portion from falling into the container. These desired effects may be accomplished by mating or associating certain sub-components of at least one of the top cover, sealing portion, fixed element, or other components of the closure system with the channel or channel guide. In certain examples, at least one of the top cover or sealing portion may be associated with the channel guide such that at least a portion of the top cover or sealing portion may reside within the channel guide. The association may allow the top cover, for example, to glide along at least a portion of the channel guide, while restricting the movement of the top cover in other directions to maintain alignment of the top cover with the channel guide. The section of the channel or channel guide may comprise a device that may secure the sealing portion to the channel guide or the stem at a predetermined distance from the bottom surface of the can end. The section may comprise one or more snap-hooks to maintain the connection between the sealing portion and the other components of the closure system, such as the channel guide or the stem.

The movable closure element may also comprise a component that secures other portions of the movable closure element to each other. The component may allow for movement of the sealing portion together with the top cover. The component may allow for the movement of the sealing portion in a direction that is the same as the direction in which the top cover is moved. Alternatively, the component may allow for the movement of the sealing portion in a direction that is not the same as the direction in which the top cover is moved. The component may mate with the top cover and the sealing portion by the same or different mating methods. The component may be a stem, for example, that may be mated with the top cover and the sealing portion. The stem may be constructed and arranged to mate with the top cover by one mating method, and with the sealing portion by a different mating method. The stem may have a top end constructed and arranged to be mated with the top cover and a bottom end constructed and arranged to be mated with the sealing portion. The top end of the stem may mate with the top cover by extending through the dispensing portion and/or the channel guide of the can end. The mating of the top cover to the top end of the stem may ensure that movement of the stem occurs with movement of the top cover.

The stem may be mated with the top cover by way of various methods. In certain examples, the stem and top cover may be mated through the use of an adhesive. In other examples, snap hooks on either the top cover or the top portion of the stem may provide the mechanism for mating these two components. Yet in other examples, well-known techniques such as spin welding may be used to mate these two components, for example, if these components are constructed from polymeric materials. Mating these two components may include the use of a cross pin which would slide through holes in the top cover and top portion of the stem, to keep these two components in place. Other ways of mating involve crimping the two components to each other, using a rivet or otherwise.

The stem may be positioned within the channel of the sealing portion and may be constructed and arranged to mate with the sealing portion. The bottom end of the stem may be constructed and arranged to mate with a portion of the sealing portion in communication with the channel. The portion of the sealing portion may be constructed and arranged to accept and mate with the bottom end of the stem. The mating may be such that movement of the stem may cause movement of the sealing portion. In certain examples, a movement of the stem (for example in a horizontal direction) may cause movement of the sealing portion in a vertical direction, for example upward or downward. In one embodiment, rotation of the stem in one direction may cause movement of the sealing portion in a downward direction. Because the channel guide of the fixed element may be mated with the channel of the sealing portion, the sealing portion will not rotate with the stem, but instead will only move in a vertical direction. The bottom end of the stem may comprise a threaded surface that mates with a compatible threaded surface of the sealing portion. The bottom end of the stem may comprise a threaded surface having a female thread which is compatible with the threaded surface of the sealing portion having a male thread. Alternatively, the bottom end of the stem may comprise a threaded surface having a male thread which is compatible with the threaded surface of the sealing portion having a female thread. The stem may be of various functional and/or ornamental shapes and sizes to secure the desired components of the closure system together. It will be within the ability of the person of ordinary skill in the art, given the benefit of the disclosure, to select or to design suitable shapes, sizes and materials of the stem disclosed herein.

The component of the movable closure element that secures other portions of the movable closure element to each other may be a sub-component of at least one of the top cover and the sealing portion. As described above, this component may allow for movement of the sealing portion together with the top cover, for example in a horizontal or vertical direction. The component may allow for the movement of the sealing portion in a direction that is the same as the direction in which the top cover is moved. In addition, the component may allow for the movement of the sealing portion in a direction that is not the same direction as the direction in which the top cover is moved. For example, engaging the top cover can cause the sealing portion to move in a vertical direction. The component may be a lever receiving portion that may be attached to the sealing portion, or may be manufactured as a part of the sealing portion. The lever receiving portion may be constructed and arranged to accept another component of the movable closure element such as the top cover. By allowing the lever receiving portion to interact with the top cover, the closure system may suitably operate to allow for various opened and closed positions of the closure system. For example, the lever receiving portion may be constructed and arranged to accept the lever of the top cover. By moving the lever, which may operatively interact with the lever receiving portion, a user may operate the closure system to expose or cover the dispensing portion as desired.

In some embodiments, aspects of the lever receiving portion may comprise a structure to secure a portion of the top cover, for example a portion of the lever, to allow the lever to pivot relative to other portions of the top cover or sealing portion. This aspect of the lever receiving portion may receive a portion of the lever, such as a pin, allowing the components of the movable closure element to mate or cooperate with one another. The lever receiving portion and the lever can be designed to be any suitable shape, size and material such that these components may communicate with one another to allow the top cover and sealing portion to operatively interact and move in one or more desired directions.

In certain embodiments, the lever receiving portion may form an opening that may accept the pin of the lever to allow for movement of the sealing portion during operation of the closure system. The shape of the opening may be the same or different from the shape of the cross-section of the pin. In some examples, the shape of the opening may complement the shape of the cross-section of the pin to push or pull the sealing portion in a vertical direction, for example in a downward direction.

In this embodiment, in the closed position, the opening and the cross-section of the pin are constructed and arranged such that the pin contacts a portion of the lever receiving portion on a surface of the opening and also contacts the over-mold, such that there is no communication between the environment within and outside of the container. In this way, these components function as a valve for the closure system, wherein the movement of the pin relative to the lever receiving portion and the over-mold may allow for communication between the interior and exterior environment of the container. As the pin is rotated, by moving a grip, for example a lever, in a given direction, an opening in the pin may become aligned with the opening in the over-mold, thereby opening the valve, so as to initiate a release of any pressure within the container. Once the pressure has been released, the shape of the opening and the cross-section of the pin allow the pin to communicate with the over-mold, which initiates movement of the sealing portion in a downward direction. As the pin continues to rotate, the shape of the opening and the cross-section of the pin may prevent the grip, for example, the lever, from being moved further in the given direction. These actions may be reversed by moving the grip, for example, the lever, in a direction opposite the given direction, pulling up the sealing portion and blocking the opening of the over-mold using the pin, thereby closing the valve.

The movable closure element may also comprise a component that may provide an indication that the container has been at least partially opened or otherwise tampered with or altered. The component may provide an indication that the original seal from the manufacturer has been broken such that a user may assess the safety of the contents of the container, or whether the contents of the container have been altered. The indication may be any indication that notifies the user that the manufacturing seal has been at least partially broken, for example by movement of the component, or change in color of the component. The component can be a sub-component of the top cover, sealing portion, fixed element, or a combination thereof. For example, the sub-component can be a portion of the top cover, such that when a portion of the top cover or another portion of the closure system is manipulated in some way, the sub-component may indicate that the container has been at least partially opened, tampered with or altered. In certain examples, the sub-component may be a member of the top cover that is in communication with the lever. As the lever is lifted, the member may move from its original position, thereby indicating that the container has been at least partially opened or otherwise tampered with or altered.

To facilitate stacking of the containers for more convenient and cost-effective shipping and storing, the top of the container comprising a closure system may be constructed and arranged to accept the bottom of another container body, or the base plate attached to another container body. For example, the top cover of the closure system may reside below the top edge of the fixed element which mates with the container body such that the top cover does not interfere in the stacking of multiple containers on top of one another. In other examples, a side of the container body may be constructed and arranged to accept a side of another container body to facilitate stacking of the containers.

A container body may be provided of various functional and/or ornamental shapes and sizes suitable for holding, storing, handling, and/or cooling or heating the contents of the beverage container. Conventional manufacturing processes as described above are used for producing beverage can bodies may be used for providing a container body. The closure system may be disposed on the container body by placing, dropping, depositing, or the like. This may be accomplished through automated processes or manually. Securing may occur to ensure the integrity of the contents of the container through mating of the container body to the closure system. Mating may occur between the container body and the fixed element. Mating may also occur between various components and sub-components of the closure system and container body. The securing may also occur using conventional methods of manufacturing beverage cans, for example, by forming a double seam. A flange of the fixed element may curl around a first edge of the container body to form a partial seam. The partial seam may be crimped and flattened for form a hermetic seal.

To assemble the beverage container, by automatic processes or manually, all or part of the closure element may be pre-assembled to be mated with the container body or inserted through the container body and may be compatible with conventional manufacturing processes of an aluminum can. Alternatively, portions of the fixed element may be mated to each other and the container body without being pre-assembled.

The operation of the assembled closure system of a container is described below. In one embodiment, at a first position, the top cover covers the dispensing portion and may also cover a portion of the can end. At this first position, the sealing portion is in contact with a bottom surface of the can end in a locked position, and the stem is positioned at the first end of the channel guide. The stem may be mated to the top cover by any various means, including those described above such that as the top cover is moved, the stem moves in the same direction.

The user may use one or more of the grips of the top cover to move the top cover in a desired direction, for example, to a second position. As the top cover is moved in a desired direction, due to the mating of the top cover and the top end of the stem, the stem is moved in the same desired direction. Because the bottom end of the stem is mated with the sealing portion, this causes the sealing portion to move. For example, the bottom end of the stem may have a threaded surface that is compatible with the threaded surface of a portion of the sealing portion, which, upon movement of the top cover would thereby move the sealing portion along the threaded surface. For example, movement of the top cover would move the sealing portion along the threaded surface in a vertical downward direction away from the bottom surface of the can end. The closure system may be constructed and arranged to prevent the sealing portion from moving further away than a pre-determined distance from the bottom surface of the can end to an unlocked position at the first end of the channel guide.

The channel may contain a section that allows the sealing portion to move relative to the channel guide, but that permits movement of the channel up to a certain predetermined distance. For example, the section of the channel may be constructed and arranged to prevent the sealing portion from moving any further in a given direction. The section of the channel may prevent the sealing portion from becoming separated from the other components of the closure system. The section may also prevent the sealing portion from falling into the container. The section may comprise a device that may secure the sealing portion to the channel guide or the stem at a predetermined distance from the bottom surface of the can end. The section may comprise one or more snap-hooks to maintain the connection between the sealing portion and the other components of the closure system, such as the channel guide or the stem.

The user may again use one or more of the grips of the top cover to move the top cover in a desired direction, for example, to a third position. As the top cover is moved in a desired direction, due to the mating of the top cover and the top end of the stem, the stem is moved in the same desired direction. Because the bottom end of the stem is mated with the sealing portion, this in turn causes the sealing portion to move. At the third position the top cover exposes the dispensing portion, the sealing portion is spaced a predetermined distance from the bottom surface of the can end, and the stem is positioned at the second end of the channel guide.

The user may use one or more of the grips of the top cover to move the top cover in a desired direction, for example, to a fourth position. As the top cover is moved in a desired direction, due to the mating of the top cover and the top end of the stem, the stem is moved in the same desired direction. This desired direction may be opposite the direction that the top cover and top end of the screw are moved when transitioning from the first position to the second position. In moving to this fourth position, the sealing portion comes into contact with the bottom surface of the can end in a locked position, and the stem is positioned at the second end of the channel guide. In certain examples, a sub-component of the sealing portion comes into contact with the bottom surface of the can end. The sub-component may be an o-ring or gasket.

From the second position, the user may use one or more of the grips of the top cover to move the top cover in a desired direction, for example, to a fifth position. As the top cover is moved in a desired direction, due to the mating of the top cover and the top end of the stem, the stem is moved in the same desired direction. Because the bottom end of the stem is mated with the sealing portion, this in turn causes the sealing portion to move. At a fifth position the top cover exposes at least a portion of the dispensing portion, the sealing portion is spaced a predetermined distance from the bottom surface of the can end, and the stem is positioned at a predetermined distance from the first end of the channel guide.

From the fifth position, the user may use one or more of the grips of the top cover to move the top cover in a desired direction, for example, to a sixth position. As the top cover is moved in a desired direction, due to the mating of the top cover and the top end of the stem, the stem is moved in the same desired direction. This desired direction may be opposite the direction that the top cover and top end of the screw are moved in when transitioning from the first position to the second position. In moving to this sixth position, the sealing portion comes into contact with the bottom surface of the can end in a locked position, and the stem is positioned at a predetermined distance from the first end of the channel guide. In certain examples, a sub-component of the sealing portion comes into contact with the bottom surface of the can end. The sub-component may be an o-ring or gasket.

In another embodiment, at a first position, the top cover covers the dispensing portion and may also cover a portion of the can end. At this first position, the lever of the top cover is resting on the top cover, and the sealing portion is in contact with a bottom surface of the can end in a locked position.

The user may use the lever of the top cover to move the top cover in a desired direction, for example, to a second position. As the lever is moved in a desired direction, for example, as the lever is lifted relative to the first position, due to the mating of the top cover and the sealing portion, the sealing portion is spaced a predetermined distance from the bottom surface of the can end. If the contents of the container are sealed under pressure, the pressure is released from the container during transition from the first position to the second position.

The user may again use the lever of the top cover to move the top cover in a desired direction, for example, to a third position. As the top cover is moved in a desired direction, the sealing portion is also moved in the same desired direction. At the third position the top cover exposes the dispensing portion and the sealing portion is spaced a predetermined distance from the bottom surface of the can end.

The user may use the lever of the top cover to move the top cover in a desired direction, for example, to a fourth position. As the lever is moved in a desired direction, for example, as the lever is lowered, the sealing portion comes into contact with the bottom surface of the can end in a locked position. In certain examples, a sub-component of the sealing portion comes into contact with the bottom surface of the can end. The sub-component may be an o-ring or gasket.

From the second position, the user may use the lever of the top cover to move the top cover in a desired direction, for example, to a fifth position. As the top cover is moved in a desired direction, due to the mating of the top cover and the sealing portion, the sealing portion also is moved in a desired direction. At a fifth position the top cover exposes at least a portion of the dispensing portion, and the sealing portion is spaced a predetermined distance from the bottom surface of the can end.

As the lever is moved in a desired direction, for example, as the lever is lowered, the sealing portion comes into contact with the bottom surface of the can end in a locked position. In certain examples, a sub-component of the sealing portion comes into contact with the bottom surface of the can end. The sub-component may be an o-ring or gasket.

In another embodiment, a closure system is configured to seal a container constructed and arranged to be mated with a container body. In a particular embodiment, the closure system includes a can end having a dispensing portion and a channel guide formed therein. The channel guide includes a first end and a second end. The can end is constructed and arranged to be secured to an end of the container body. The closure system further includes a movable closure element having a top cover and a sealing portion. The top cover has a lever and the sealing portion has a lever receiving portion, which is constructed and arranged to accept the lever. The arrangement is such that, as the lever is lifted, the sealing portion moves in a downward direction away from the can end, and as the top cover is moved horizontally from the first end of the channel guide to the second end of the channel guide the dispensing portion is exposed.

The top cover is movable from first, second, third, fourth, fifth and sixth positions. In the first position, the top cover covers the dispensing portion and the lever of the top cover rests on the top cover, with the sealing portion being in contact with a bottom surface of the can end. In the second position, the top cover covers the dispensing portion and the lever is lifted relative to the first position, with the sealing portion being spaced a predetermined distance from the bottom surface of the can end. In the third position, the top cover and the sealing portion expose the dispensing portion, with the sealing portion being spaced a predetermined distance from the bottom surface of the can end. In the fourth position, the top cover and the sealing portion expose the dispensing portion, with the lever being lowered to rest on the top cover and the sealing portion being in contact with the bottom surface of the can end. In the fifth position, the top cover and the sealing portion expose at least a portion of the dispensing portion, with the lever of the top cover being lifted relative to the fourth position and the sealing portion being spaced a predetermined distance from the bottom surface of the can end. In the sixth position, the top cover and sealing portion expose at least a portion of the dispensing portion, with the lever of the top cover being lowered relative to the fifth position and the sealing portion being in contact with the bottom surface of the can end.

In certain embodiments, the can end is made of a material that is compatible with a material of at least one of the top cover and the sealing portion. Specifically, at least one of the top cover and the sealing portion is made of a polymeric material. The total weight of the polymeric material may be less than or equal to 10 grams.

In other embodiments, the lever may be constructed and arranged to operatively interact with the lever receiving portion. The top cover may be constructed and arranged to at least partially secure the top cover to the fixed element, and to mate with the lever. The top cover may be constructed and arranged to mate with another portion of the top cover and to at least partially secure the top cover to the fixed element. The top cover may be constructed and arranged to maintain alignment of the top cover with the channel guide. The arrangement is such that contents within the container are pressurized and the sealing portion is constructed and arranged to release pressure from within the container. The lever is configured to operatively interact with the sealing portion to release pressure from within the container. Specifically, pressure is released from the container when the lever is lifted from a resting position on the top cover to a predetermined angle. The arrangement is such that as the lever is lifted, a portion of the lever becomes aligned with the sealing portion to release pressure from within the container.

In a further embodiment, a closure system is configured to seal a container constructed and arranged to be mated with a container body. In a particular embodiment, the closure system includes a can end having a dispensing portion and a channel guide. The can end is constructed and arranged to be secured to an end of the container body. The closure system further includes a movable closure element having a top cover and a sealing portion. In one embodiment, the top cover includes a grip and the sealing portion operatively interacts with the top cover. The arrangement is such that as the top cover is engaged, the sealing portion moves in a vertical direction, and as the top cover is moved in a horizontal direction along the channel guide, the sealing portion moves in the horizontal direction.

Figures 1A, 1B, 1C:
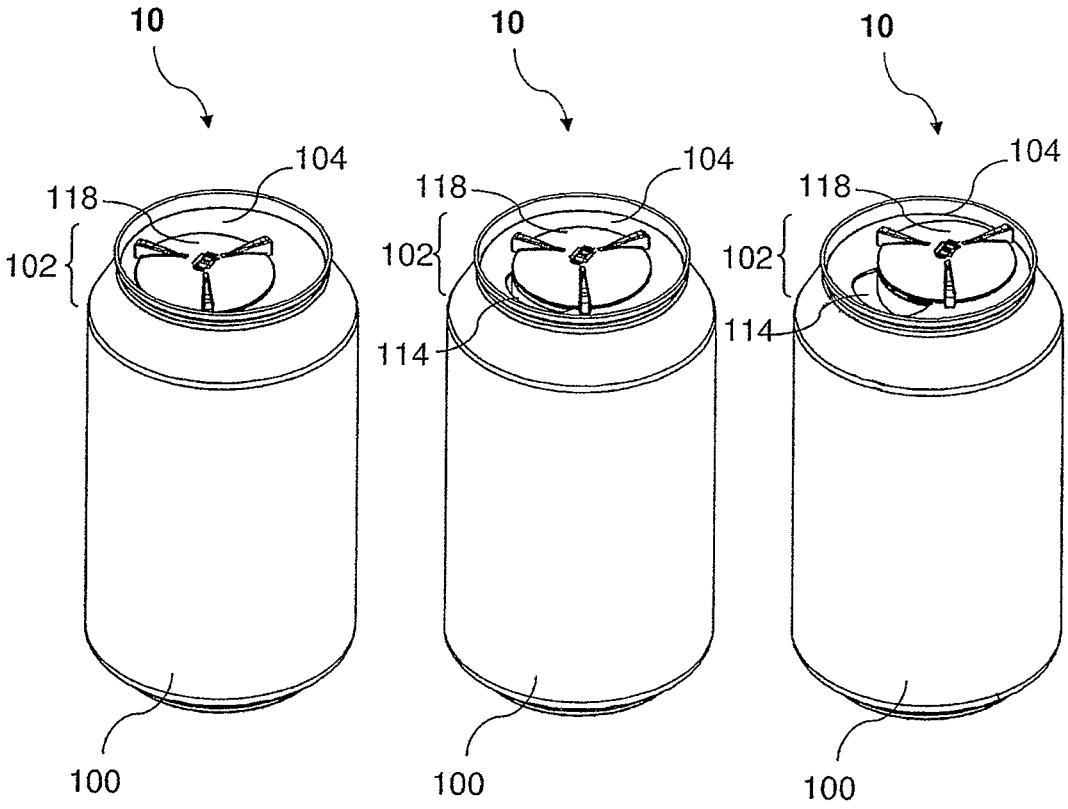
FIG. 1A illustrates an example of a perspective view of a beverage container, in accordance with certain examples.
FIG. 1B illustrates a perspective view of a beverage container, in accordance with certain examples.
FIG. 1C illustrates a perspective view of a beverage container, in accordance with certain examples.

Referring now to the figures, in one embodiment, FIGS. 1A-1C illustrate a beverage container 10 in which a container body 100 made from a conventional manufacturing process is used. Container body 100 is attached to closure system 102. Closure system 102 comprises a fixed element 104 and a movable closure element 106 (shown in FIGS. 2A and 2B). FIG. 1A is a perspective view of the beverage container and illustrates a beverage container 10 in the closed position. FIG. 1B is a perspective view of the beverage container, and illustrates a beverage container 10 in a partially opened position with top cover 118 partially exposing dispensing portion 114. FIG. 1C is a perspective view of the beverage container, and illustrates a beverage container 10 in a fully opened position with top cover 118 fully exposing dispensing portion 114.

Figure 2A:
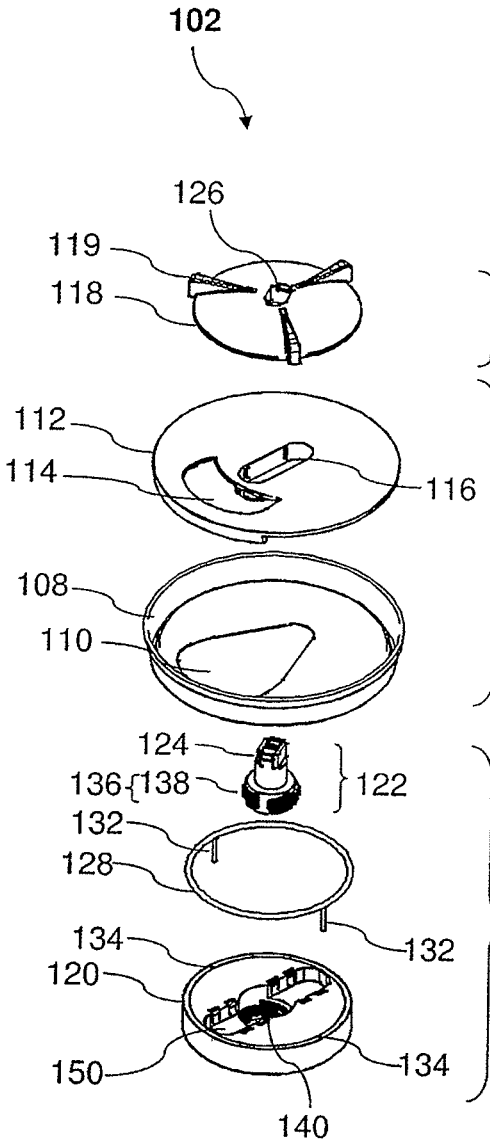
FIG. 2A illustrates a perspective exploded view of the closure system shown in FIGS. 1A-1C, in accordance with certain examples.
Figure 2B:
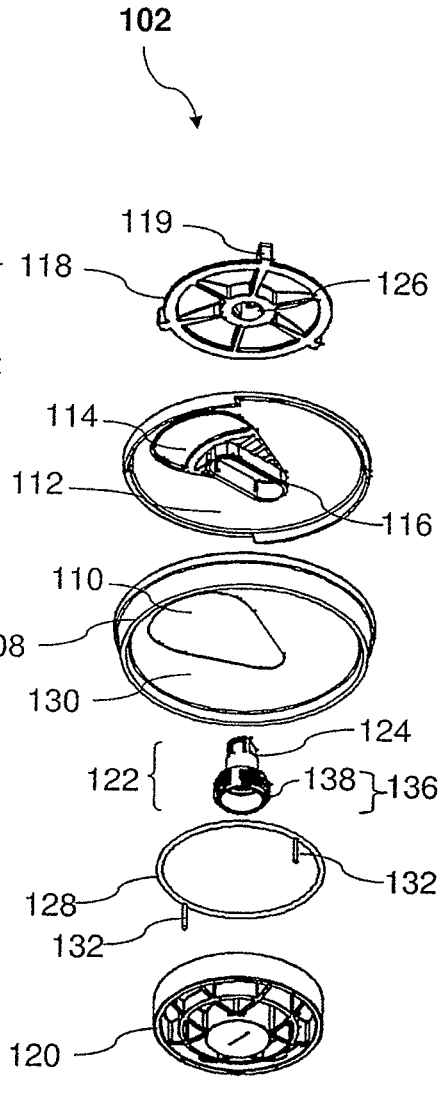
FIG. 2B illustrates a perspective exploded view of the closure system shown in FIGS. 1A-1C, in accordance with certain examples.

As illustrated in the exploded views of FIGS. 2A and 2B, closure system 102 of beverage container 10 of FIGS. 1A-1C comprises multiple components. As shown, fixed element 104 comprises can end 108 having dispensing portion 110. In this embodiment, fixed element 104 also comprises can cover 112 comprising dispensing portion 114 and channel guide 116. Fixed element 104 may be assembled by placing can cover 112 on can end 108, aligning dispensing portion 114 with dispensing portion 110, and aligning channel guide 116 with dispensing portion 110.

Closure system 102 of FIGS. 2A and 2B also comprises a movable closure element 106. As shown, movable closure element 106 comprises top cover 118 having grip 119 to assist a user in opening and closing the container. Movable closure element 106 also comprises stem 122 and sealing portion 120 having channel 150. Movable closure element 106 may be assembled by inserting top end 124 of stem 122 through dispensing portion 110 and channel guide 116 so that top end 124 of stem 122 can mate with opening 126 in top cover 118. Sealing portion 120 can be mated with gasket 128 to ensure a tight seal between the sealing portion and the bottom surface 130 of can end 108. This may be accomplished by aligning members 132 with openings 134 of sealing portion 120. Other various means of attaching gasket 128 to sealing portion 120 may be used as discussed above. Sealing portion 120 may be mated with stem 122, by mating bottom end 136 of stem 122 having threaded surface 138 with threaded section 140 of sealing portion 120. The mating of threaded surface 138 with threaded section 140 allows sealing portion 120 to move vertically, i.e., upwards or downwards relative to fixed element 104.

Figure 3A:
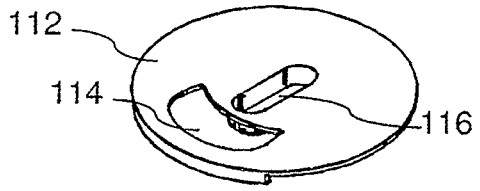
FIG. 3A illustrates a perspective view of a can cover of a closure system, in accordance with certain examples.
Figure 3B:
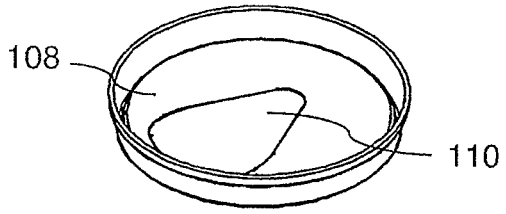
FIG. 3B illustrates a perspective view of can end of a closure system, in accordance with certain examples.
Figure 3C:
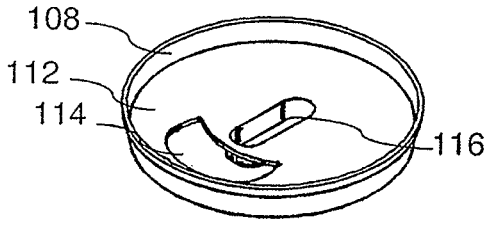
FIG. 3C illustrates a perspective view of a fixed element of a closure system, in accordance with certain examples.
Figure 3D:
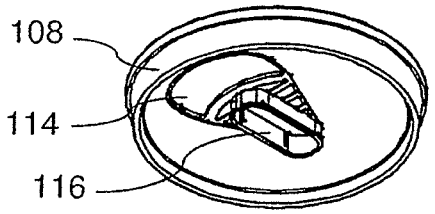
FIG. 3D illustrates a perspective view of a fixed element of a closure system, in accordance with certain examples.

In one embodiment, FIGS. 3A-3D illustrate one way that a two-component fixed element may be assembled. FIG. 3A illustrates can cover 112 comprising dispensing portion 114 and channel guide 116. FIG. 3B illustrates can end 108 comprising dispensing portion 110. To assemble the fixed element as shown in FIGS. 3C and 3D, an adhesive, for example a Food and Drug Administration approved adhesive, may be applied to a bottom surface of can cover 112 and/or top surface of can end 108. Can cover 112 and can end 108 may then be mated by aligning dispensing portion 114 and channel guide 116 of can cover 112 with dispensing portion 110 of can end 108. This allows channel guide 116 to reside below the surface of can end 108 through dispensing portion 110 of can end 108, as shown in FIG. 3D.

Figure 4A:
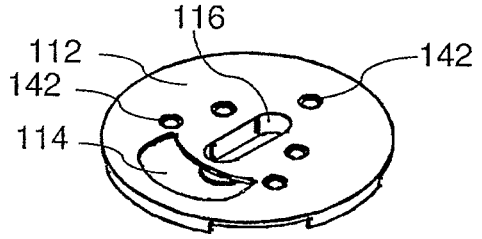
FIG. 4A illustrates a perspective view of a can cover of a closure system, in accordance with certain examples.
Figure 4B:
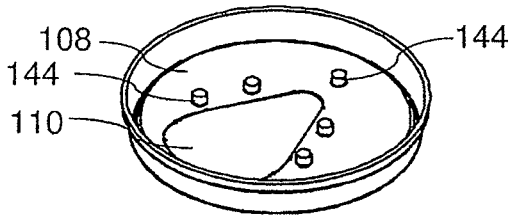
FIG. 4B illustrates a perspective view of a can end of a closure system, in accordance with certain examples.
Figure 4C:
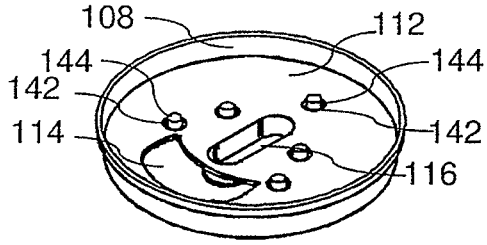
FIG. 4C illustrates a perspective view of a fixed element, in accordance with certain examples.
Figure 4D:
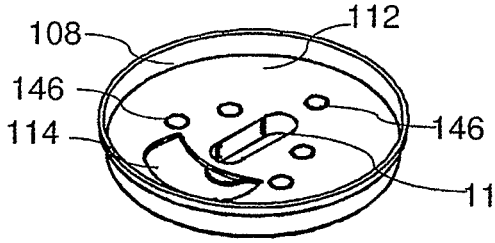
FIG. 4D illustrates a perspective view of a fixed element, in accordance with certain examples.

In another embodiment, FIGS. 4A-4D illustrate another way that a two-component fixed element may be assembled. FIG. 4A illustrates can cover 112 comprising dispensing portion 114, channel guide 116 and openings 142. FIG. 4B illustrate can cover 108 comprising dispensing portion 108 and pegs 144. To assemble the fixed element as shown in FIGS. 4C and 4D, openings 142 of can cover 112 are aligned with pegs 144 of can end 108, as can cover 112 is placed on top of can end 108. Once can cover 112 is in place on top of can end 108, pegs 144 are flattened against can cover 112 and can end 108 to form flattened pegs 146 which secure these two pieces in place to form the fixed element, as shown in FIGS. 4C and 4D.

Figure 5A:
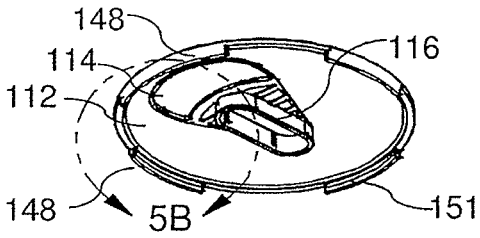
FIG. 5A illustrates a perspective view of a can cover, in accordance with certain examples.
Figure 5C:
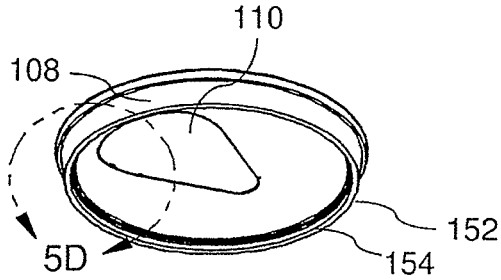
FIG. 5C illustrates a perspective view of a can end, in accordance with certain examples.
Figure 5B:
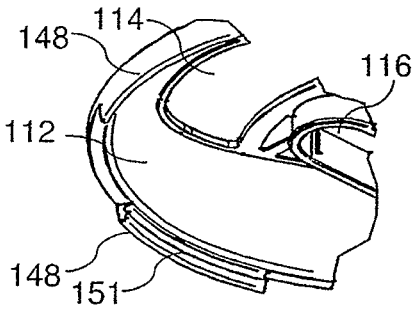
FIG. 5B illustrates a perspective view showing detail 5B of the can cover shown in FIG. 5A, in accordance with certain examples.
Figure 5D:
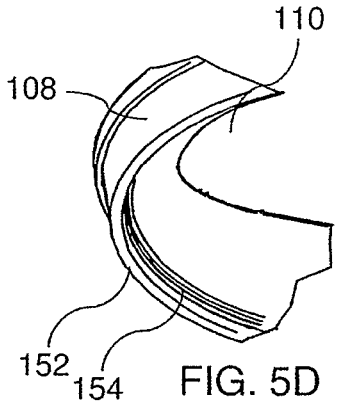
FIG. 5D illustrates a perspective view showing detail 5D of the can end shown in FIG. 5C, in accordance with certain examples.
Figure 5E:
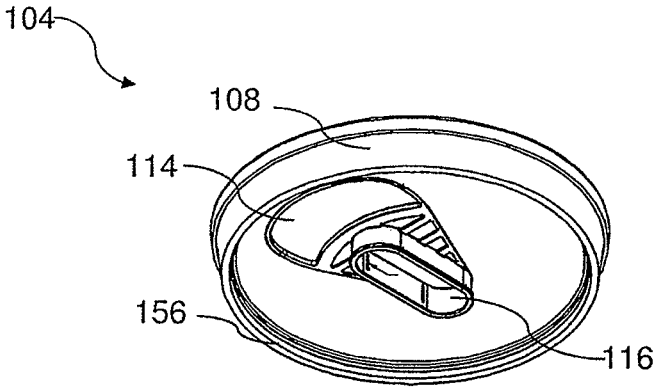
FIG. 5E illustrates a perspective view of a fixed element comprising the can cover and can end of FIGS. 5A-5D, in accordance with certain examples.

In another embodiment, FIGS. 5A-5E illustrate another way that a two-piece fixed element may be assembled. FIGS. 5A and 5B illustrate can cover 112 comprising dispensing portion 114, channel guide 116, and lip 148 having crimping groove 151. FIGS. 5C and 5D illustrate can end 108 comprising dispensing portion 110 and overhang 152 having crimp line 154. To assemble fixed element 104 as shown in FIG. 5E, lip 148 and overhang 152 are joined in and crimped together to form a crimped portion 156 of fixed element 104.

In another embodiment, snap hooks may be used to mate the components of the two-component fixed element. It will be within the ability of the person of ordinary skill in the art, given the benefit of the disclosure, to select or to design suitable shapes, sizes and materials for mating the components of the fixed element together.

Figure 6A:
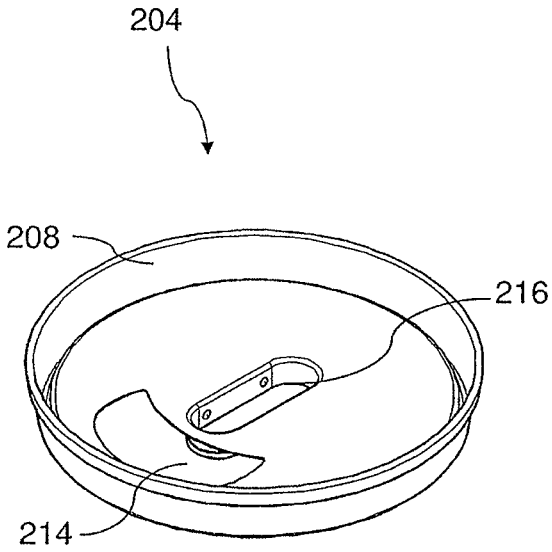
FIG. 6A illustrates a perspective view of a fixed element, in accordance with certain examples.
Figure 6B:
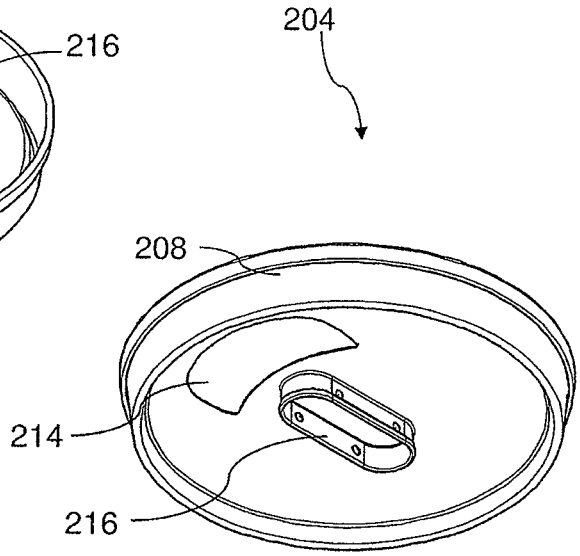
FIG. 6B illustrates a perspective view of a fixed element, in accordance with certain examples.

In yet another embodiment as shown in FIGS. 6A and 6B, the fixed element may be constructed as one piece. In this embodiment, fixed element 204 may be made of aluminum. Can end 208 comprises dispensing portion 214 and channel guide 216. In this embodiment, the starting material for can end 208 may be produced from conventional manufacturing processes from which dispensing portion 214 and channel guide 216 may be formed. This embodiment requires no can cover and streamlines the process of producing fixed element 204 for the closure system.

FIGS. 7A-8B illustrate perspective views of a portion of the closure system in accordance with certain embodiments. FIGS. 7A and 7B illustrate top cover 118 having grip 119, fixed element 104 having channel guide 116 and dispensing portion 110, and stem 122 having top end 124 and bottom end 136 prior to assembly. As shown, stem 122 is inserted into channel guide 116 of fixed element 104. Top end 124 of stem 122 is mated with opening 126 of top cover 118. Mating of these two components can be achieved by snap hooks 170 of top end 124 of stem 122 being inserted into grooves 172 of opening 126 of top cover 118, or by other various mating means as discussed above. FIGS. 8A and 8B illustrate this assembled portion of the closure element, from the top and bottom perspective views.

Figures 9A, 9B, 9C:
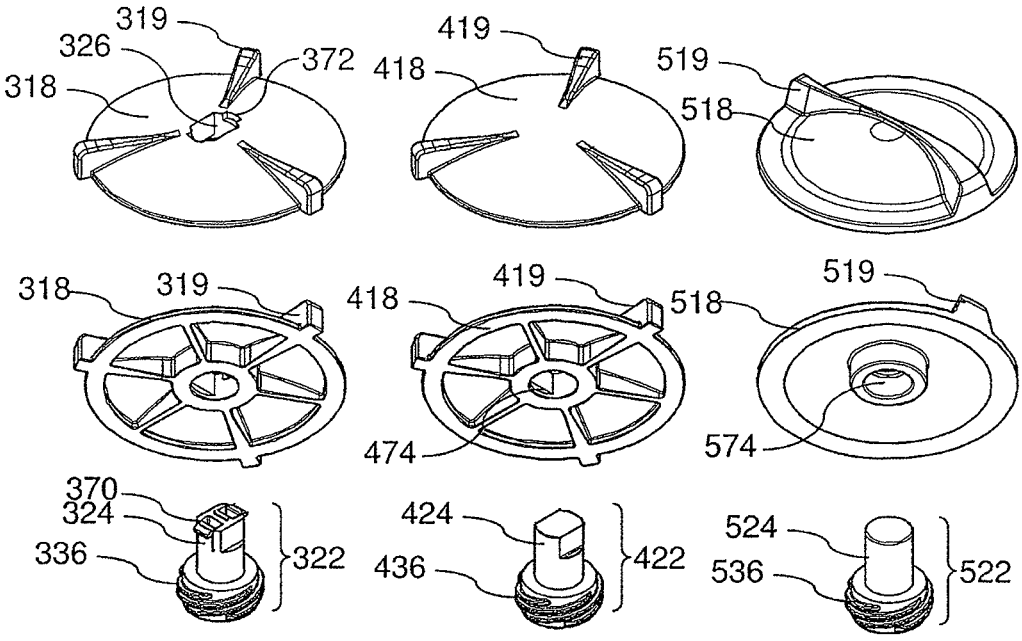
FIG. 9A illustrates an exploded perspective view of a portion of a closure system, in accordance with certain examples.
FIG. 9B illustrates an exploded perspective view of a portion of a closure system, in accordance with certain examples.
FIG. 9C illustrates an exploded perspective view of a portion of a closure system, in accordance with certain examples.
Figures 9D, 9E, 9F:
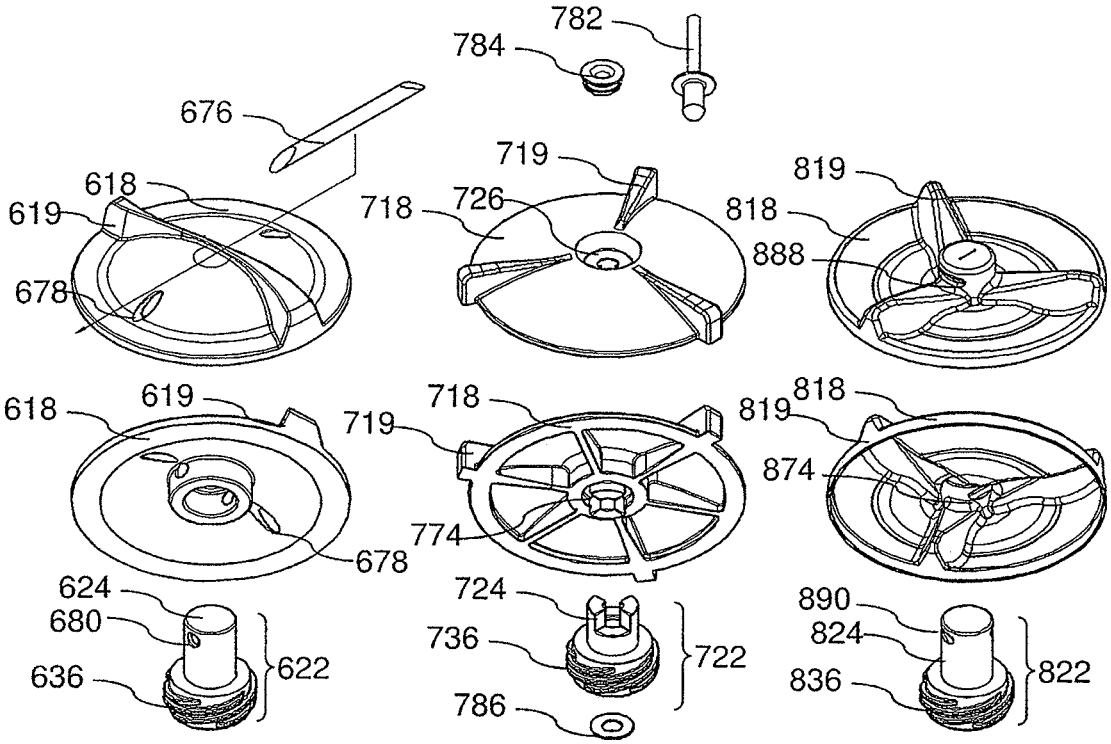
FIG. 9D illustrates an exploded perspective view of a portion of a closure system, in accordance with certain examples.
FIG. 9E illustrates an exploded perspective view of a portion of a closure system, in accordance with certain examples.
FIG. 9F illustrates an exploded perspective view of a portion of a closure system, in accordance with certain examples.

FIGS. 9A-9F illustrate various other methods for assembling the top cover, stem, and fixed element (not shown in FIGS. 9A-9F) together. For example, FIG. 9A again illustrates the use of snap hooks 370 of top end 324 of stem 322 which can mate with grooves 372 of opening 326 of top cover 318. FIG. 9B illustrates the use of an adhesive which may be applied to top end 424 of stem 422, to opening 474 of top cover 418, or to both top end 424 and opening 474 to achieve the mating of these components. Spin welding may also be used to mate these components as shown in FIG. 9C. In another embodiment, fastener 676 may be inserted through openings 678 of top cover 618 and openings 680 of top end 624 of stem 622. FIG. 9E illustrates pre-crimped rivet 782 which is inserted into opening 726 of top cover 718. Fixed element (not shown) is placed below top cover 718, followed by stem 722 which is inserted into opening 774 along with washer 786. Once each of these components is in place, pre-crimped rivet 782 is crimped, as shown in 784 to mate the components together. In another example, FIG. 9F illustrates stem 822 which may be inserted into opening 884 so that these components may be crimped together at crimping area 888 of top cover 818 and crimping groove 890 of stem 822. It will be within the ability of the person of ordinary skill in the art, given the benefit of the disclosure, to select or to design suitable mating configurations for the components of the closure element as disclosed herein.

Figure 10A:
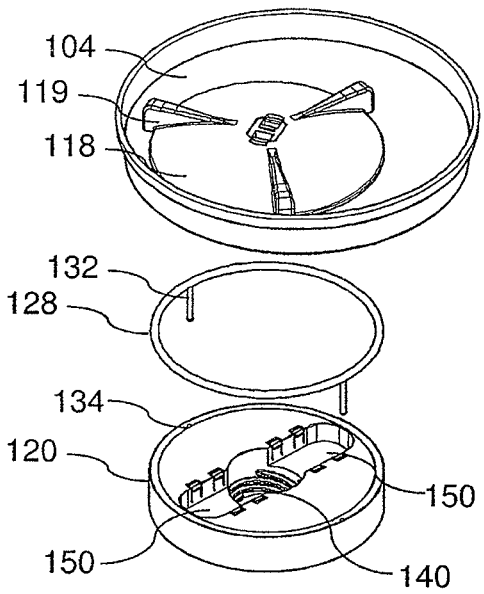
FIG. 10A illustrates an exploded perspective view of a portion of a closure system, in accordance with certain examples.
Figure 10B:
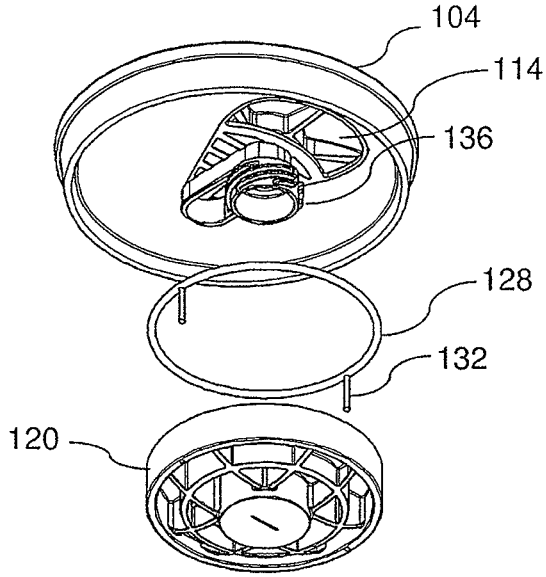
FIG. 10B illustrates an exploded perspective view of a portion of a closure system, in accordance with certain examples.

Once stem 136, top cover 118 and fixed element 104 are assembled, sealing portion 120 may be attached as shown in FIGS. 10A and 10B. Gasket 128 can be secured to sealing portion 120 by aligning members 122 with opening 134 of sealing portion 120. Once gasket 128 is in place, sealing portion 120 is screwed into place by mating bottom end 136 of stem 122 with threaded section 140 of sealing portion 120. This completes assembly of the closure element, which is now ready to be mated with a container body in one of the various ways described above, or by any other suitable means.

Figure 11A:
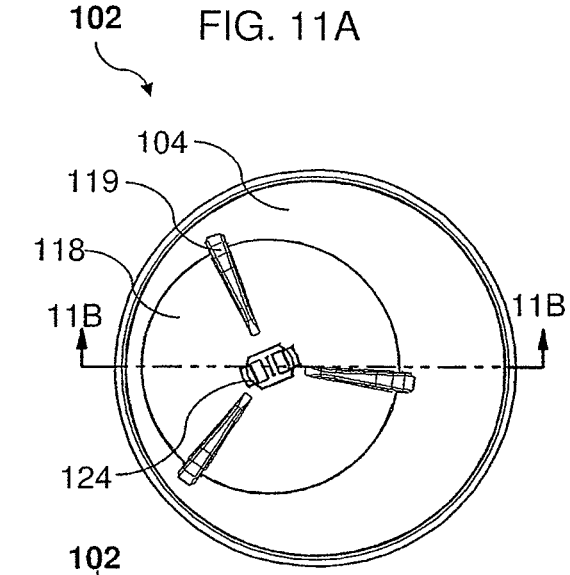
FIG. 11A illustrates an aerial view of a closure system, in accordance with certain examples.
Figure 11B:
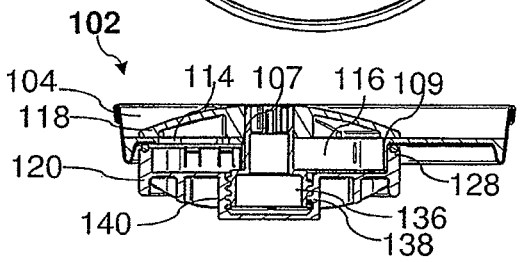
FIG. 11B illustrates a cross-sectional view of the closure system shown in FIG. 11A along section line 11B-11B, in accordance with certain examples.

Upon first use of a container comprising closure system 102, closure element 102 is located at a first position as shown in FIGS. 11A and 11B. At this first, closed, locked position, top cover 118 is resting on fixed element 104, covering dispensing portion 114, and is mated with top end 124 of stem 122. Sealing portion 120 is in contact with the bottom surface of fixed element 104 and forms a tight seal with use of gasket 128.

Figure 12A:
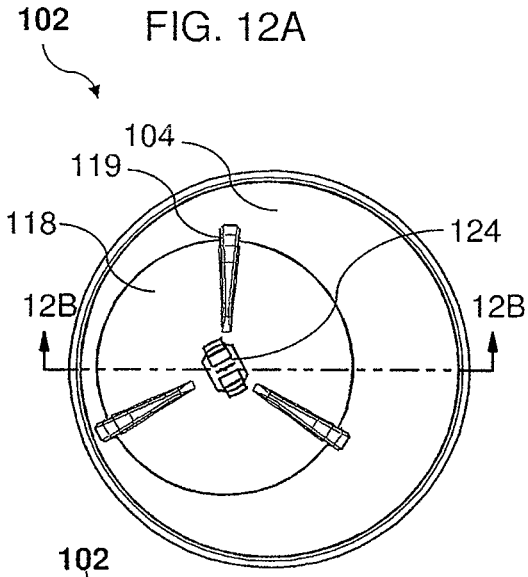
FIG. 12A illustrates an aerial view of a closure system, in accordance with certain examples.
Figure 12B:
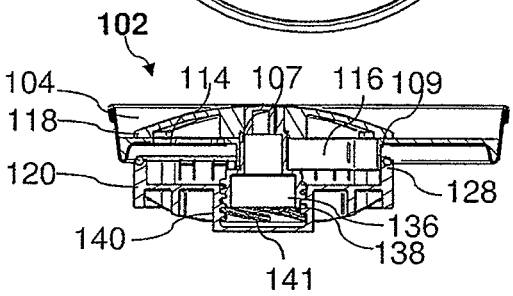
FIG. 12B illustrates a cross-sectional view of the closure system shown in FIG. 12A along section line 12B-12B, in accordance with certain examples.

FIGS. 12A and 12B illustrate a second position in which closure system 102 is in a closed, unlocked position. Top cover 118, with use of grips 119 is rotated in a clockwise direction. As shown in FIG. 12A, stem 122 is also rotated with top cover 118. FIG. 12B illustrates the effect that rotation of top cover 118 has on sealing portion 120. As shown in FIG. 12B, sealing portion 120 is no longer in contact with the bottom surface of fixed element 304, and has moved a predetermined distance in a downward direction as evidenced by the appearance of a section 141 of threaded portion 140 of sealing portion 120.

By releasing sealing portion 120 from the bottom surface of fixed element 104, the user may now slide top cover 118 from first end 107 of channel guide 116 to second end 109 of channel guide 116 or anywhere in between such as a predetermined distance from first end 107 of channel guide 116. By moving top cover 118 to a predetermined distance from first end 107 of channel guide 116 or to second end 109 of channel guide 116, dispensing portion 114 of fixed element 104 is revealed partially as shown in FIGS. 13A and 13B (at a fifth position) or fully, as shown in FIGS. 14A and 14B (at a third position). These positions represent partially open, unlocked or fully open, unlocked positions.

Figure 15A:
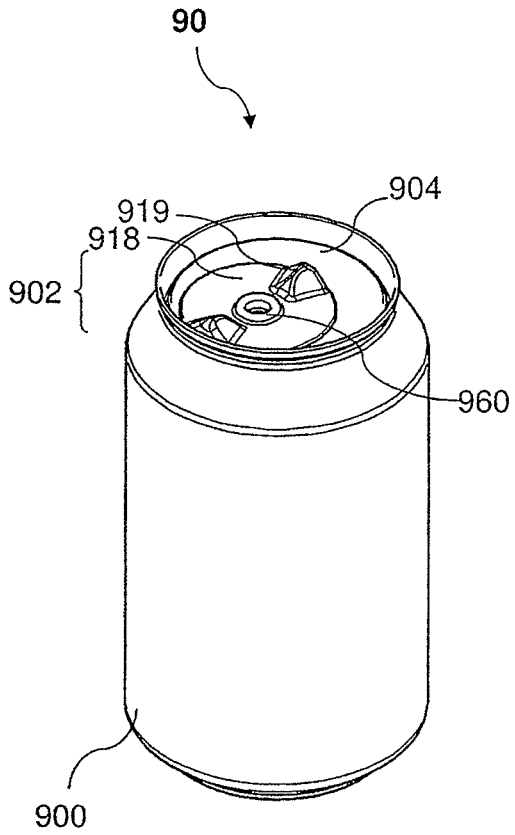
FIG. 15A illustrates an example of a perspective view of a beverage container, in accordance with certain examples.
Figure 15B:
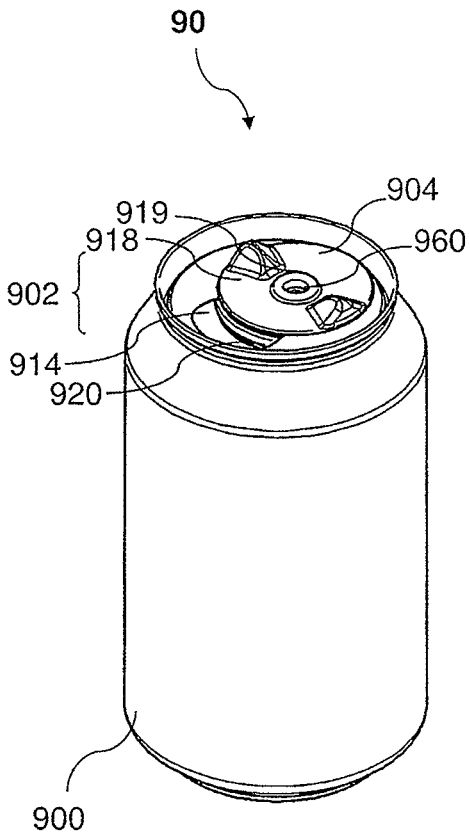
FIG. 15B illustrates an example of a perspective view of a beverage container, in accordance with certain examples.

In another embodiment, FIGS. 15A and 15B illustrate perspective views of a reclosable beverage container 90 that may be completely constructed of aluminum. Beverage container 90 comprises container body 900 and closure system 902. Closure system 902 comprises fixed element 904. As shown in FIGS. 15A and 15B movable closure element comprises top cover 918 having grip 919, and rivet 960. FIG. 15B also shows movable closure element comprising sealing portion 920 in addition to top cover 618 having grip 619, and secured with rivet 960.

Figure 16A:
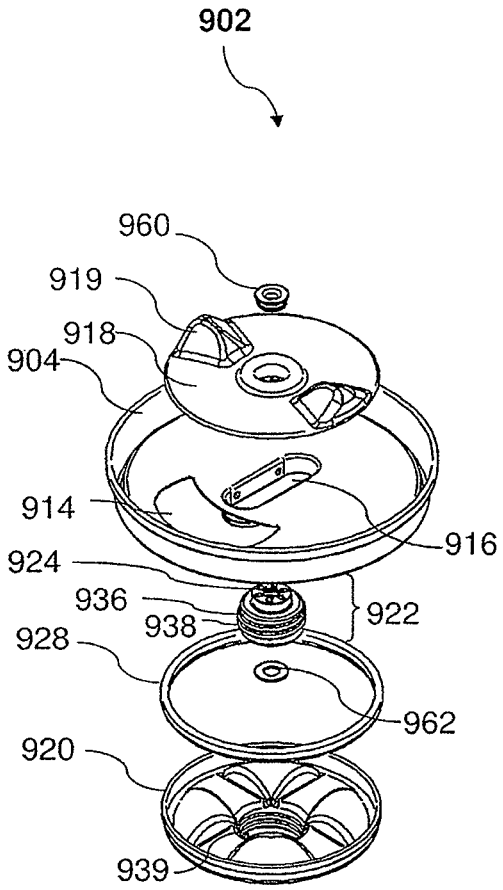
FIG. 16A illustrates a perspective exploded view of the closure system shown in FIGS. 15A and 15B, in accordance with certain examples.
Figure 16B:
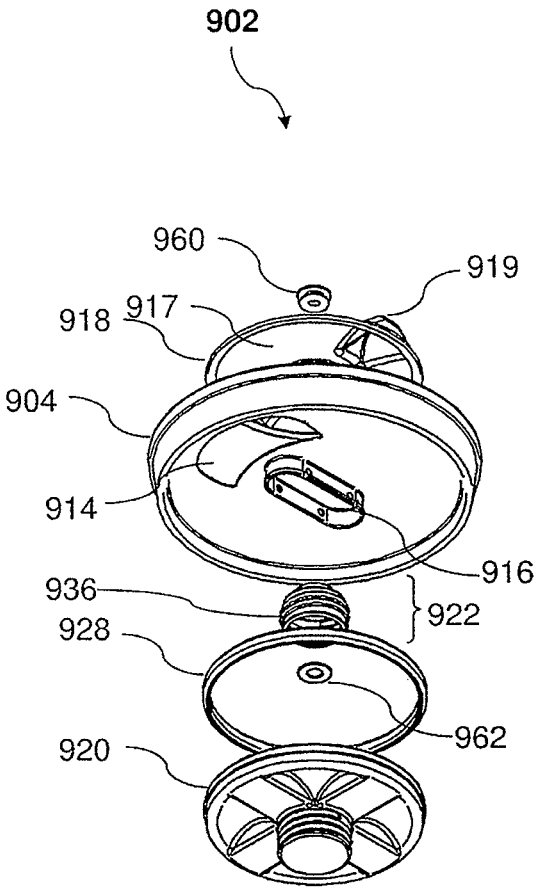
FIG. 16B illustrates a perspective exploded view of the closure system shown in FIGS. 15A and 15B, in accordance with certain examples.

The exploded view of FIGS. 16A and 16B of closure system 902 illustrated in FIGS. 15A and 15B shows each of the components of closure element 902. As shown, FIGS. 16A and 16B illustrate components made of aluminum, with the exception of gasket 928, which may be made of a polymeric material. Rivet 960 assists in mating top end 924 of stem 922 with top cover 918. To accomplish this, stem 922 is inserted through channel guide 916, allowing fixed element 904 to be positioned against bottom surface 917 of top cover 918. Gasket 928 can now be put in place on sealing portion 920 having a male threaded surface 939 which mates with bottom end 936 of stem 922. Bottom end 936 has female threaded surface 938. In alternative embodiments, threaded surface 939 may have a male thread, while threaded surface 938 may have a female thread. FIGS. 16A and 16B illustrate washer 962, which assists in mating sealing portion 920 and stem 922.

Figure 17A:
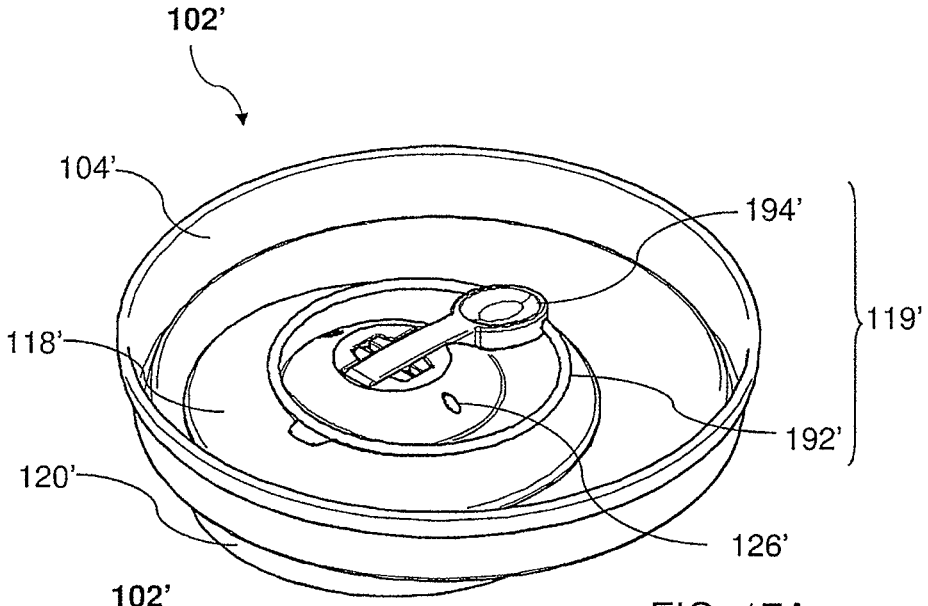
FIG. 17A illustrates a perspective view of a closure system, in accordance with certain examples.
Figure 17B:
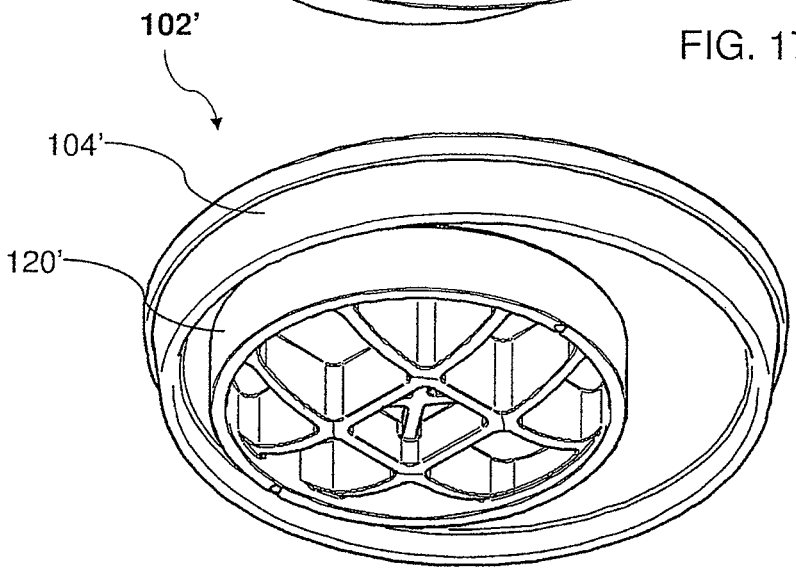
FIG. 17B illustrates another perspective view of the closure system shown in FIG. 17A, in accordance with certain examples.

In another embodiment, closure system 102' is illustrated in FIGS. 17A and 17B and comprises fixed element 104' and movable closure element comprising top cover 118' and sealing portion 120'. Top cover 118' comprises grip 119'. In this embodiment, grip 119' comprises ring 192' and lever 194' and assists the user in moving top cover 118' in a desired direction, for example, horizontally, and also allows sealing portion 120' to move in a desired direction, for example, vertically. In other embodiments, the ring may be optional. Top cover 118' also comprises openings 126' that allow for securing of grip 119' to top cover 118' using a fastener.

Figure 18A:
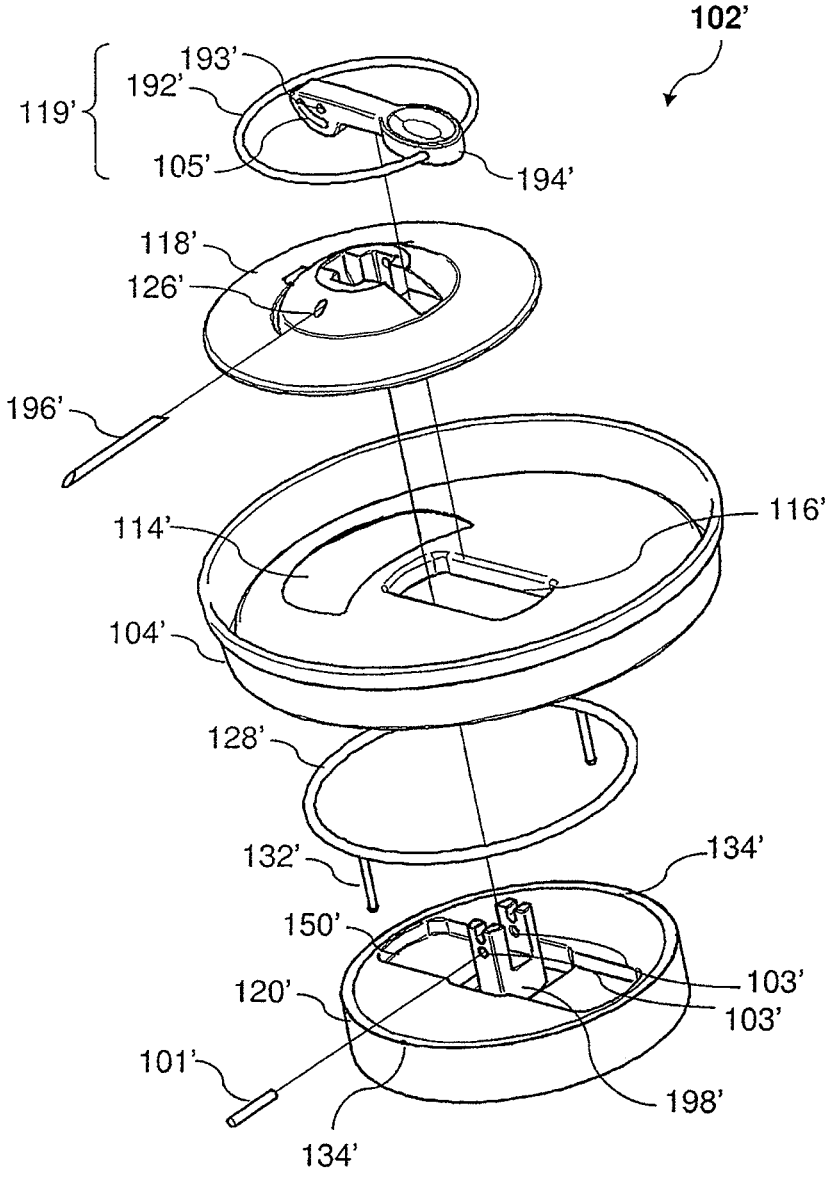
FIG. 18A illustrates an exploded perspective view of the closure system shown in FIGS. 17A and 17B, in accordance with certain examples.
Figure 18B:
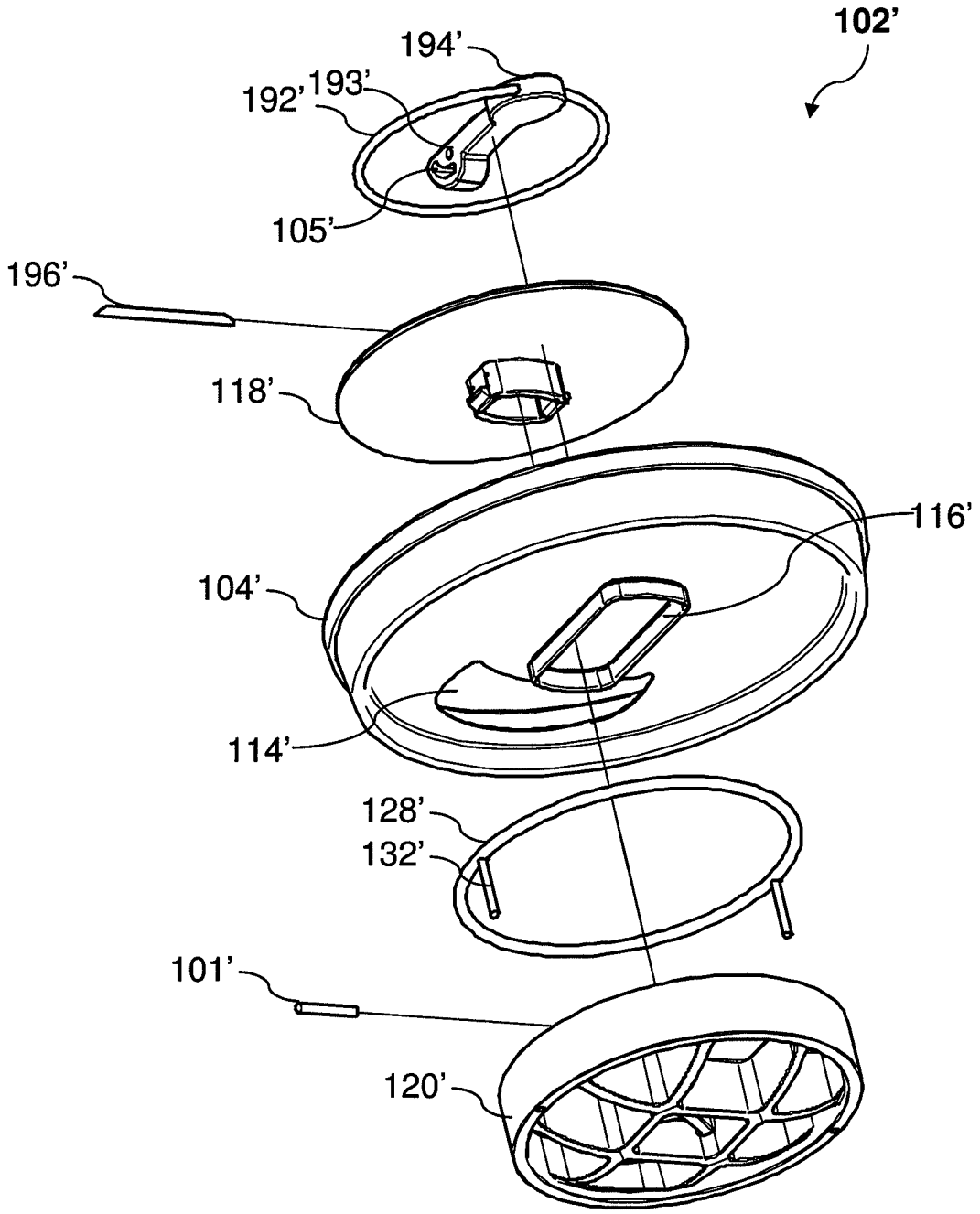
FIG. 18B illustrates another exploded perspective view of the closure system shown in FIGS. 17A and 17B, in accordance with certain examples.

FIGS. 18A and 18B illustrate removable closure element 102' in exploded views. As shown, grip 119' comprises ring 192' and lever 194' which may be fastened to top cover 118' by placing fastener 196' through opening 126' of top cover 118' and opening 193' of grip 119'. Fastener 196' may be any device or material suitable for joining or affixing top cover 118' and grip 119'. For example, fastener 196' may be a wire, a wire coated in plastic, a hinge, spring, bolt, screw, nail, clasp, peg, or pin, for example, a cotter pin. The fixed element 104', which may be made of one or more components, as discussed above, comprises a dispensing portion 114' and a channel guide 116'. Sealing portion 120' comprises lever receiving portion 198' which resides in channel 150'. Sealing portion 120' may also comprise gasket 128' which is attached to sealing portion 120' by mating member 132' with openings 134'. Top cover 118' and grip 119' may be mated with fixed element 104' and sealing portion 120' by inserting lever 194' through top cover 118' and channel guide 116', and mating lever 194' with lever receiving portion 198'. These components are connected by inserting fastener 101' through opening 103' of lever receiving portion 198' and opening 105' of lever 194'.

Figure 19A:
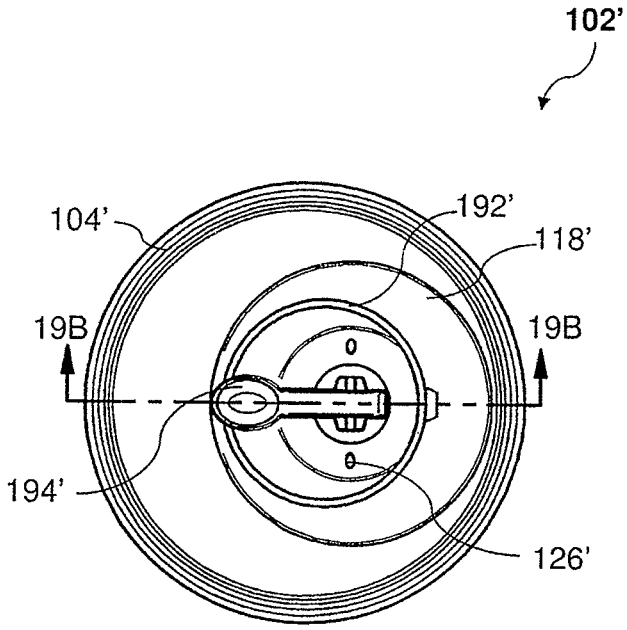
FIG. 19A illustrates an aerial view of the closure system shown in FIGS. 17A and 17B, in accordance with certain examples.
Figure 19B:
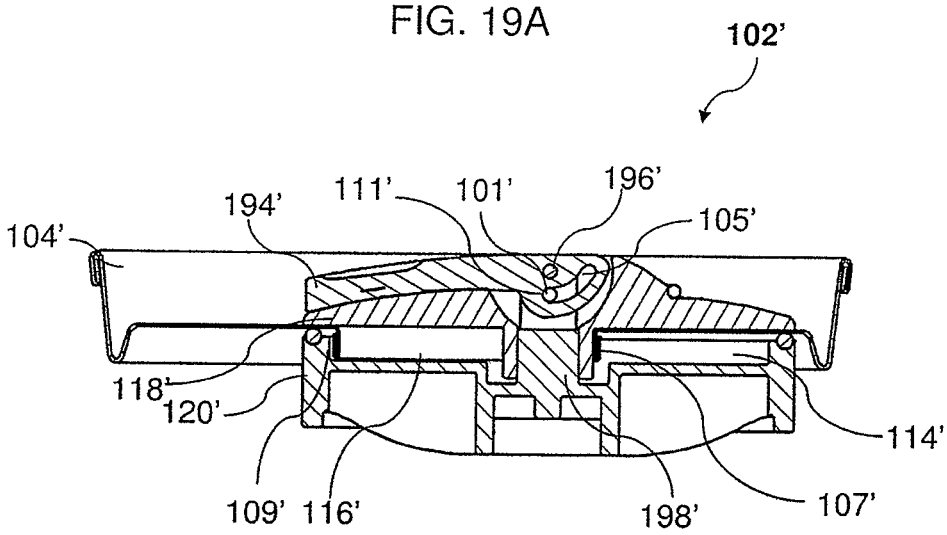
FIG. 19B illustrates a cross-sectional view along section line 19B-19B of the closure system shown in FIG. 19A, in accordance with certain examples.

FIGS. 19A-22B illustrate various positions of closure system 102' during operation. FIGS. 19A and 19B illustrate the closure system in a closed, locked position, wherein top cover 118' is covering dispensing portion 114' of fixed element 104'. Ring 192' and lever 194' are resting horizontally on top cover 118' with fastener 101' at first end 111' of opening 105'. Sealing portion 120' resides up against the bottom surface of fixed element 104', with lever receiving portion 198' residing at a first end 107' of channel guide 116'. In this closed position, closure system 102' provides for a tight seal that prevents liquids from escaping a container that utilizes this closure system.

Figure 20A:
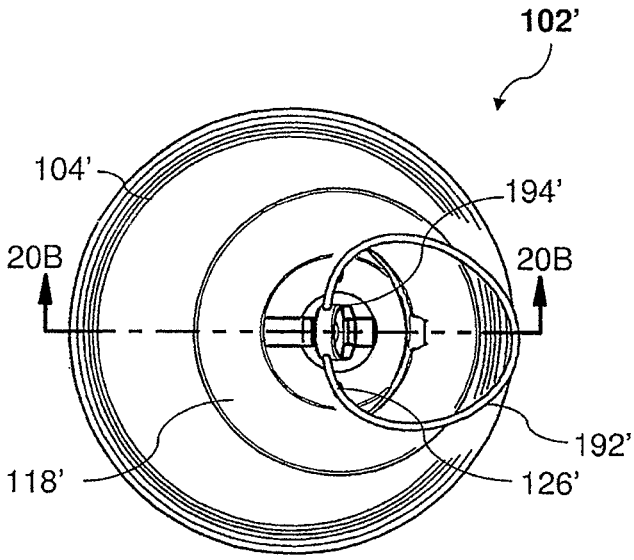
FIG. 20A illustrates an aerial view of a closure system, in accordance with certain examples.
Figure 20B:
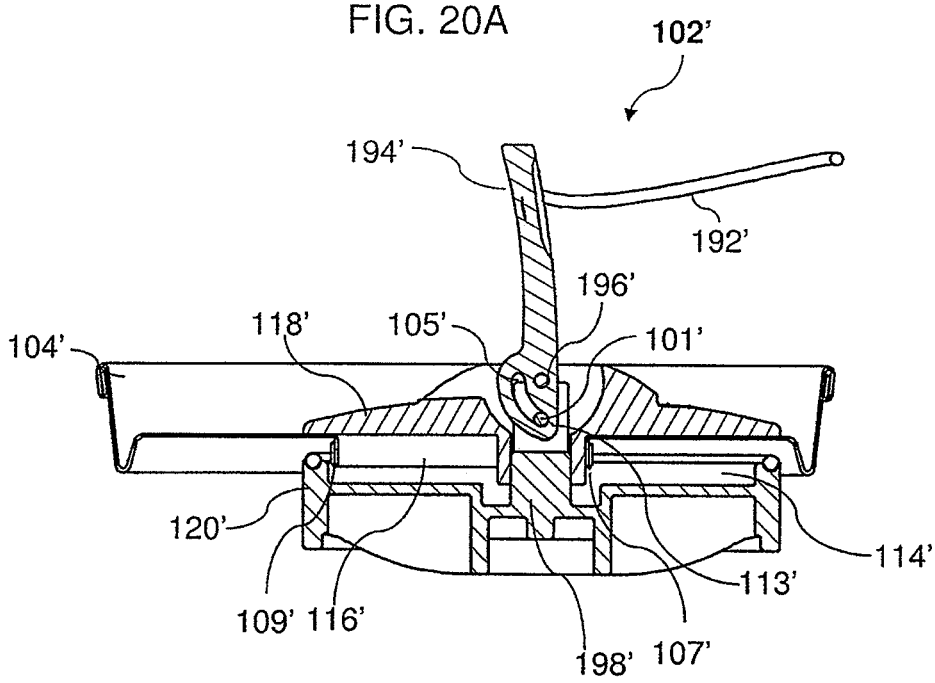
FIG. 20B illustrates a cross-sectional view along section line 20B-20B of the closure system shown in FIG. 20A, in accordance with certain examples.

FIGS. 20A and 20B illustrate closure system 102' in closed, unlocked position, wherein dispensing portion 114' is still covered by top cover 118' but sealing portion 120' no longer resides up against the bottom surface of fixed element 104'. As shown, ring 192' has been moved such that lever 194' is no longer resting on top cover 118' and is instead lever 194' is in a position perpendicular to lever 194' in the closed position. Fastener 101' follows opening 105' to reside at second end 113' of opening 105' which causes lever receiving portion 198', and thus sealing portion 120', to move vertically downwards by a predetermined distance away from the bottom surface of fixed element 104'.

Figure 21A:
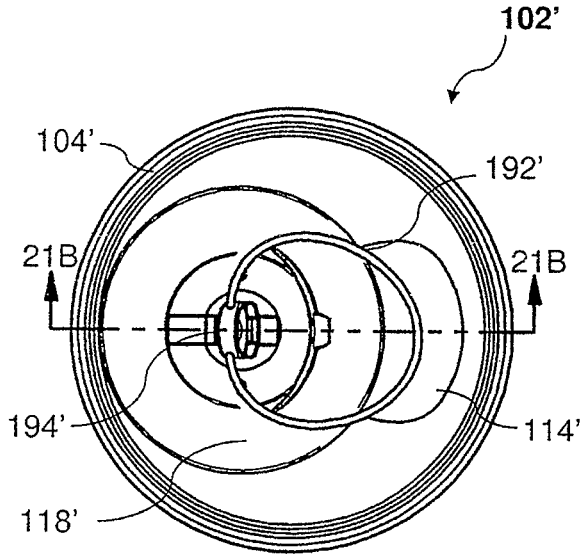
FIG. 21A illustrates an aerial view of a closure system, in accordance with certain examples.
Figure 21B:
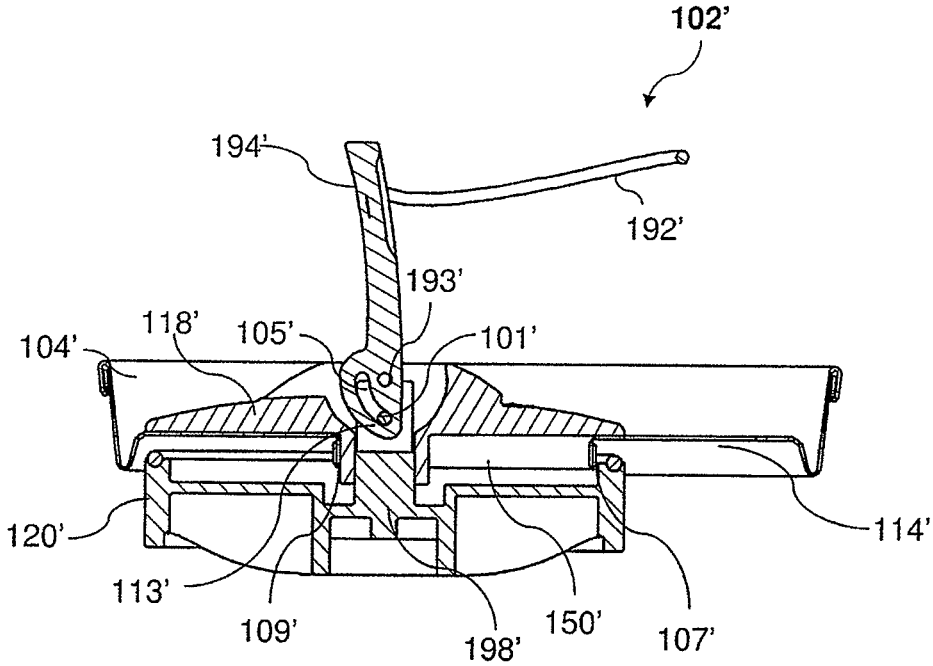
FIG. 21B illustrates a cross-sectional view along section line 21B-21B of the closure system shown in FIG. 21A, in accordance with certain examples.

FIGS. 21A and 21B illustrate closure system 102' in an open, unlocked position, wherein top cover 118' is no longer covering dispensing portion 114'. As shown, ring 192' and lever 194' are still in a position wherein they are not resting on top cover 118'. Lever 194' has moved in a horizontal direction, which also moves top cover 118' and sealing portion 120' in a horizontal direction. Lever receiving portion 198' now resides at second end 109' of channel guide 116'. Sealing portion 120' remains at a predetermined distance away from the bottom surface of fixed element 104'.

Figure 22A:
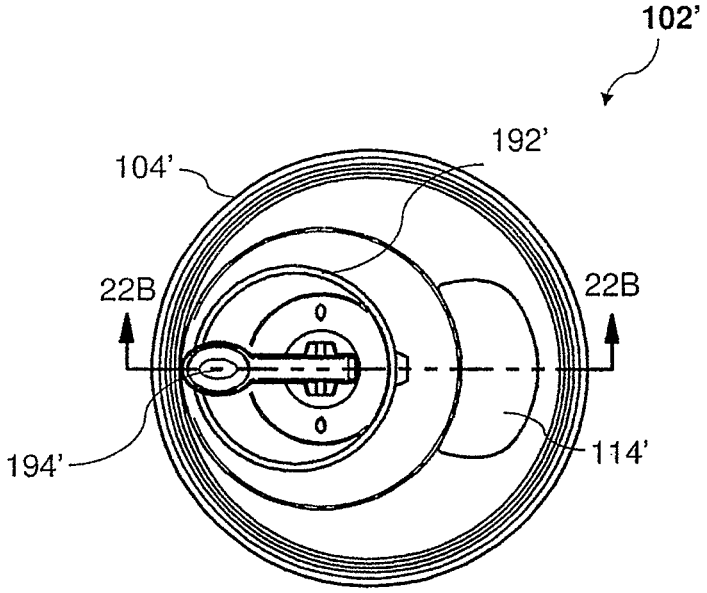
FIG. 22A illustrates an aerial view of a closure system, in accordance with certain examples.
Figure 22B:
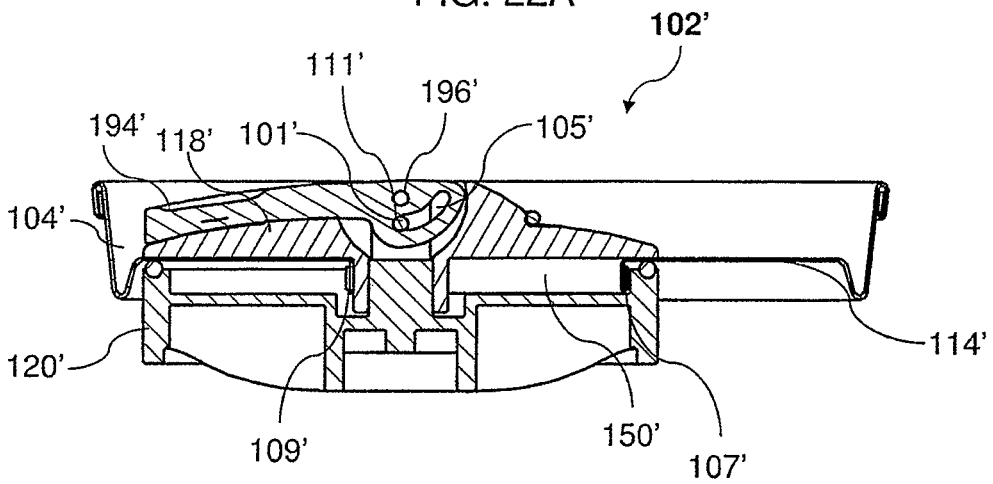
FIG. 22B illustrates a cross-sectional view along section line 22B-22B of the closure system shown in FIG. 22A, in accordance with certain examples.

FIGS. 22A and 22B illustrate closure system 102' in an open, locked position with sealing portion 120' up against the bottom surface of fixed element 104'. Closure system 102' is in an open position, wherein top cover 118' is no longer covering dispensing portion 114'. As shown, ring 192' and lever 194' have been moved and are now resting on top cover 118'. Fastener 101' follows opening 105' to reside at first end 113' of opening 105' which causes lever receiving portion 198', and thus sealing portion 120', to move vertically upwards by a predetermined distance so that sealing portion 120' resides up against the bottom surface of fixed element 104'.

Figure 23A:
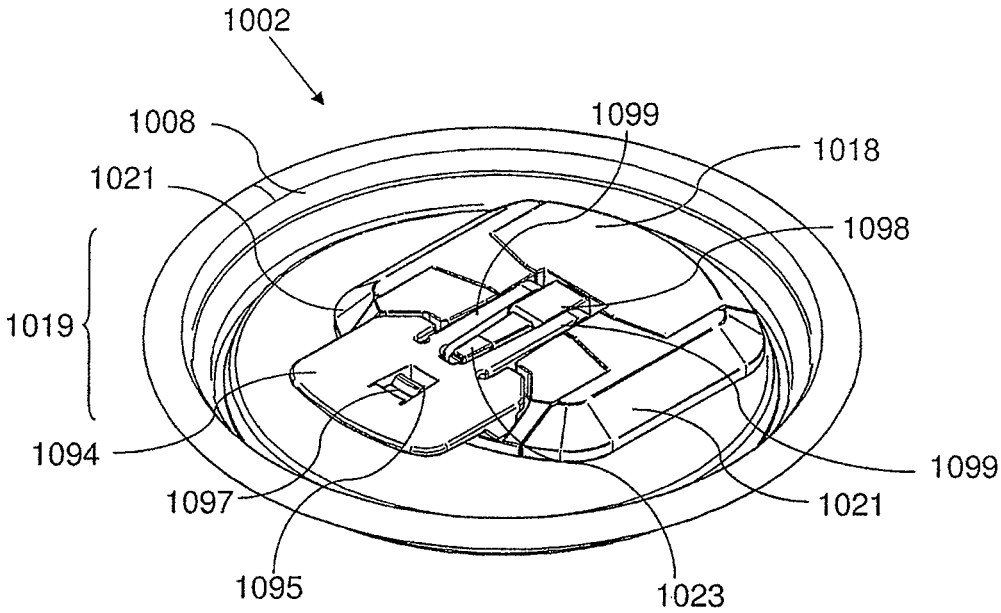
FIG. 23A illustrates a perspective view of a closure system, in accordance with certain examples.
Figure 23B:
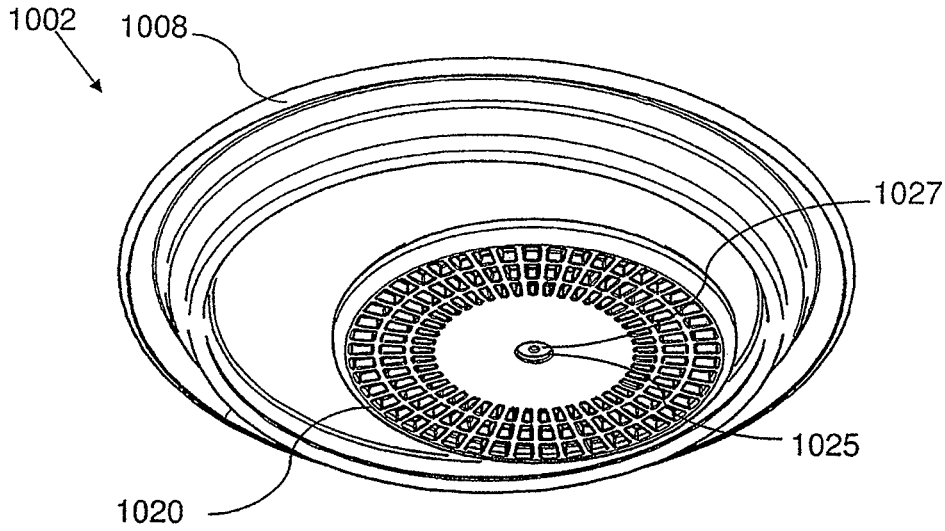
FIG. 23B illustrates a perspective view of a closure system, in accordance with certain examples.

In another embodiment, closure system 1002 is illustrated in FIGS. 23A and 23B and comprises fixed element 1004 (or can end 1008) and movable closure element 1006 comprising top cover 1018 and sealing portion 1020. Top cover 1018 comprises lever 1094 and assists the user in moving top cover 1018 in a desired direction, for example horizontally, and also allows sealing portion 1020 to move in a desired direction, for example vertically.

As shown in FIG. 23A, lever 1094 comprises groove 1095 that can mate with snap hook 1097 on top cover 1018. Although the mating of lever 1094 and top cover 1018 are depicted in FIG. 23A as a snap hook and opening, other types of mating techniques can be used, such as those recited above.

Top cover 1018 as shown in FIG. 23A also comprises arms 1021 that can take part in securing top cover 1018 on can end 1008.

Also shown in FIG. 23A is lever receiving portion 1098 of sealing portion 1020. As will be described in further detail below, prongs 1099 of lever 1094 are mated with lever receiving portion 1098 and thus allow sealing portion 1020 to interact with lever 1094.

As shown in FIG. 23B, sealing portion 1020 can reside up against the bottom surface of can end 1008. Sealing portion 1020 comprises opening 1025 and over-mold 1027 that can assist in releasing pressure, if any, from within the can.

Figure 24A:
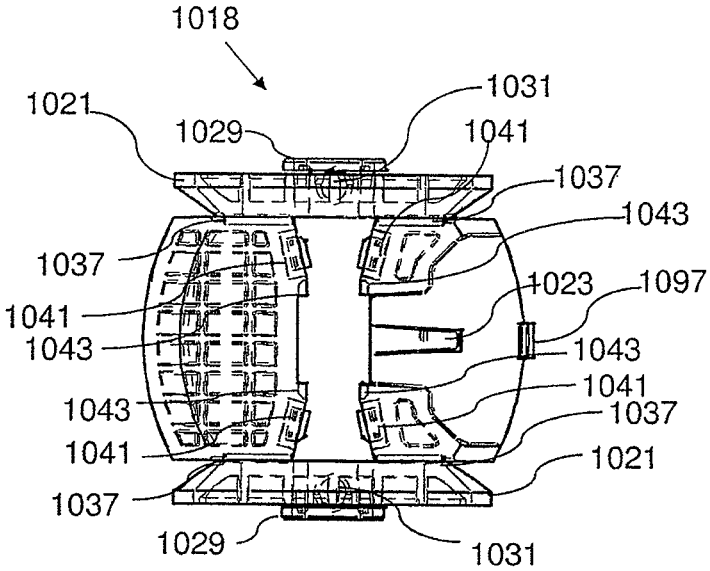
FIG. 24A illustrates a plan view of a top cover, in accordance with certain examples.
Figure 24B:
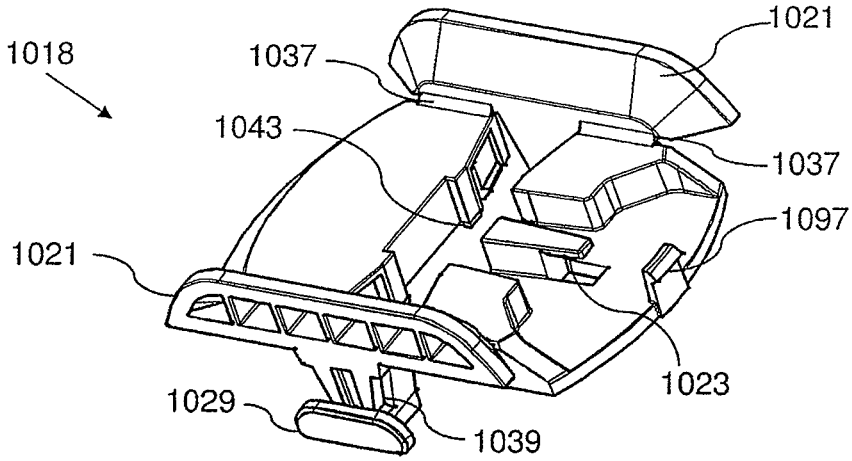
FIG. 24B illustrates a perspective view of the top cover of FIG. 24A, in accordance with certain examples.

FIGS. 24A and 24B illustrate an aerial view and a perspective view of top cover 1018 without lever 1094. Top cover 1018 comprises several components including arms 1021, wings 1029, and tamper evident feature 1023. As top cover 1018 is positioned on the can end during assembly, arms 1021 bend downward at hinges 1037. Arms 1021 of top cover 1018 comprise openings 1031 which can mate with ends 1035 of pin 1033 of lever 1094, shown, for example in FIGS. 25A-25C. Arms 1021 also comprise grooves 1039 which can mate with snap hooks 1041 located on the underside of top cover 1018. Top cover 1018 also comprises projections 1043 which are located on the underside of top cover 1018, and assist in ensuring proper alignment of top cover 1018 with the channel guide of the can end.

Figure 25A:
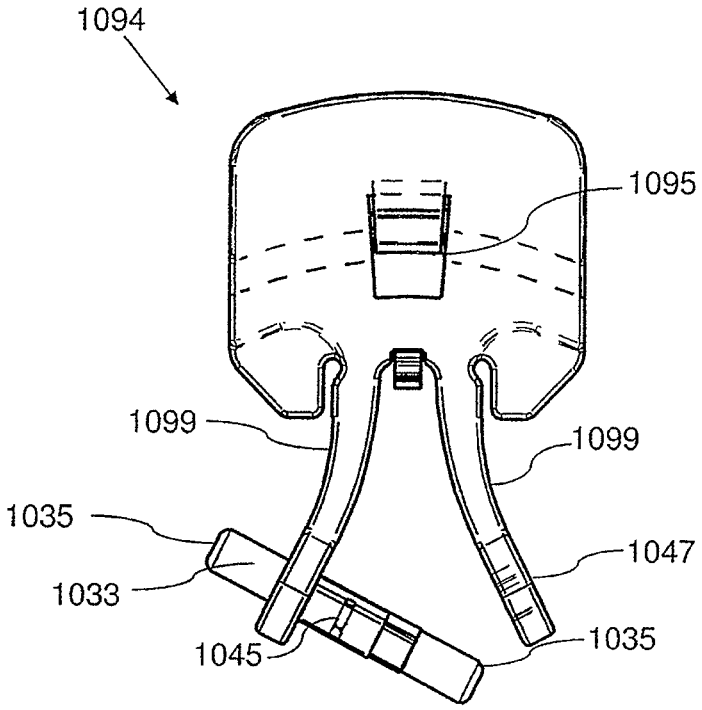
FIG. 25A illustrates a plan view of a lever, in accordance with certain examples.
Figure 25B:
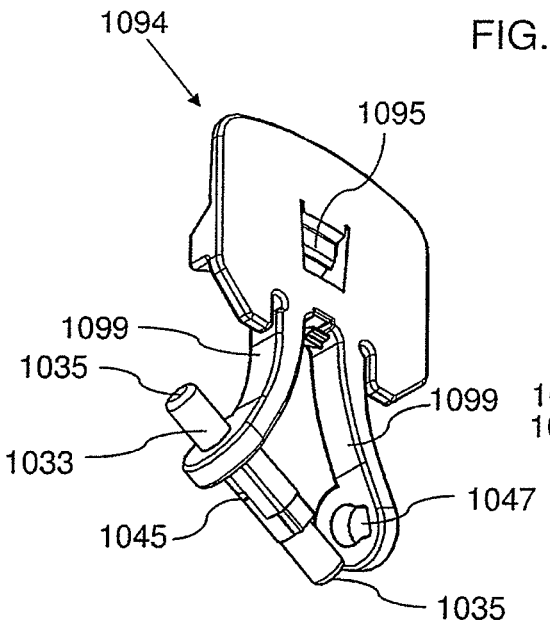
FIG. 25B illustrates a perspective view of the lever of FIG. 25A, in accordance with certain examples.
Figure 25C:
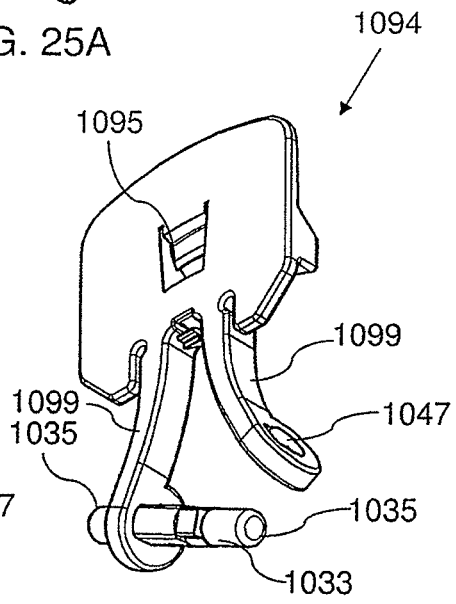
FIG. 25C illustrates another perspective view of the lever of 25A, in accordance with certain examples.

FIGS. 25A-25C illustrate aerial and perspective views of lever 1094 of top cover 1018. Lever 1094 comprises prongs 1099, wherein prior to assembly of the closure system, pin 1033 is mated to one of prongs 1099. Pin 1033, which will be accepted by opening 1003 in lever receiving portion 1098 as shown in FIGS. 28A-33C, will also be accepted by opening 1047 in prong 1099 of lever 1094. Pin 1033 comprises opening 1045 which can assist in releasing pressure from with the container. As discussed above, ends 1035 of pin 1033 will mate with openings 1031 in arms 1021 of top cover 1018 to assist in securing the components of top cover 1020 to one another and to fixed element 1008. A cross-section of the width of pin 1033 and opening 1003 can be of various shapes and sizes such that pin 1033, upon movement of lever 1094 may operatively interact with sealing portion 1020, to move sealing portion 1020 in a desired direction, for example vertically downward or upward.

Figure 26A:
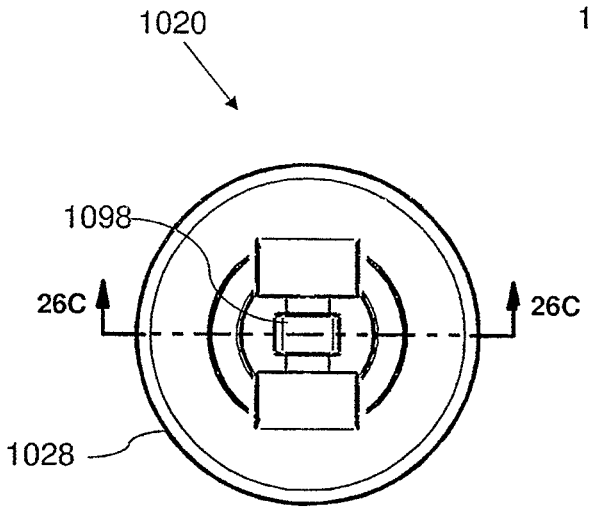
FIG. 26A illustrates a top plan view of a sealing portion, in accordance with certain examples.
Figure 26B:
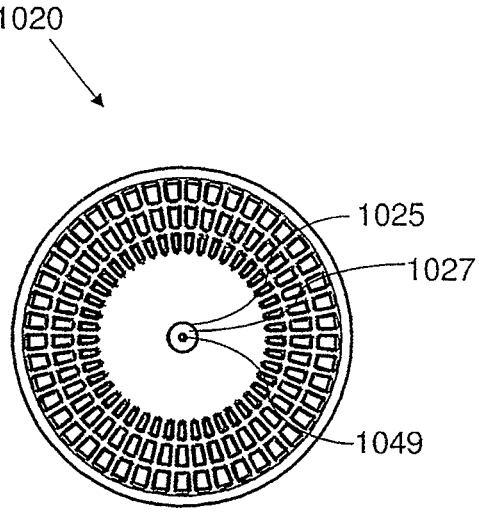
FIG. 26B illustrates a bottom plan view of a sealing portion, in accordance with certain examples.
Figure 26C:
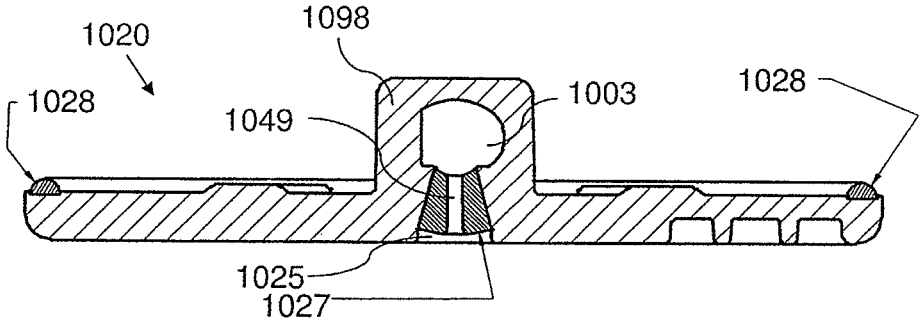
FIG. 26C illustrates a cross-sectional side view along section line 26C-26C of the sealing portion of FIG. 26A, in accordance with certain examples.
Figure 27A:
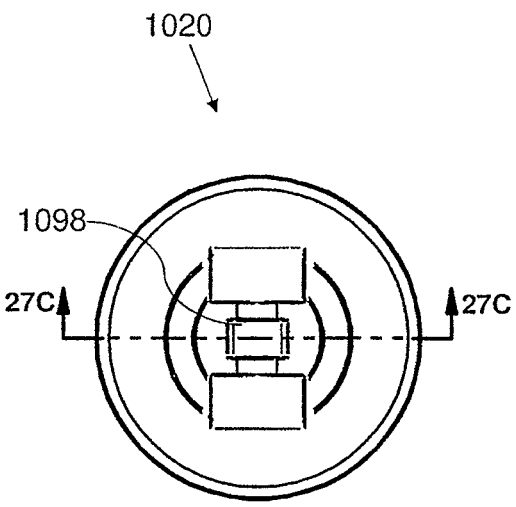
FIG. 27A illustrates a top plan view of a sealing portion, in accordance with certain examples.
Figure 27B:
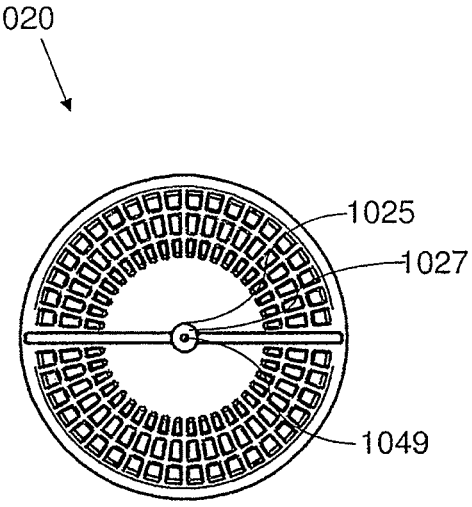
FIG. 27B illustrates a bottom plan view of a sealing portion, in accordance with certain examples.
Figure 27C:
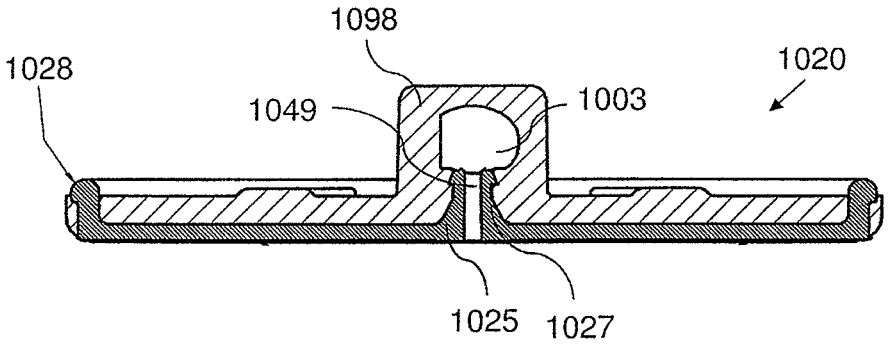
FIG. 27C illustrates a cross-sectional side view along section line 27C-27C of the sealing portion of FIG. 27A, in accordance with certain examples.

FIGS. 26A-27C illustrate aerial and cross-sectional views of sealing portion 1020. In FIGS. 26A-C, gasket 1028 and over-mold 1027 comprising opening 1049 are manufactured as separate pieces, while in FIGS. 27A-27C, gasket 1028 and over-mold 1027 comprising 1049 are manufactured as one piece. FIGS. 26A and 27A illustrate aerial views of the surface of sealing portion 1020 that can come into contact with the bottom surface of can end 1008, and show gasket 1028 and lever receiving portion 1098. FIGS. 26B and 27B illustrate aerial views of the surface of sealing portion 1020 that is opposite the surface that comes into contact with the inner side of the can end, and show opening 1025 and over-mold 1027. FIGS. 26C and 27C illustrate cross-sectional views of sealing portion 1020. In FIG. 26C, gasket 1028 and over-mold 1027 are manufactured as separate pieces, while in FIG. 27C, gasket 1028 and over-mold 1027 are manufactured as one piece. Lever receiving portion 1098 comprises opening 1003 which may mate with lever 1094 by way of pin 1033.

Figure 28A:
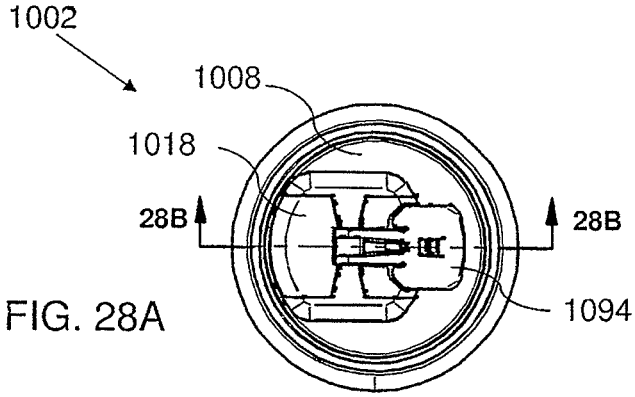
FIG. 28A illustrates a top plan view of a closure system, in accordance with certain examples.
Figure 28B:
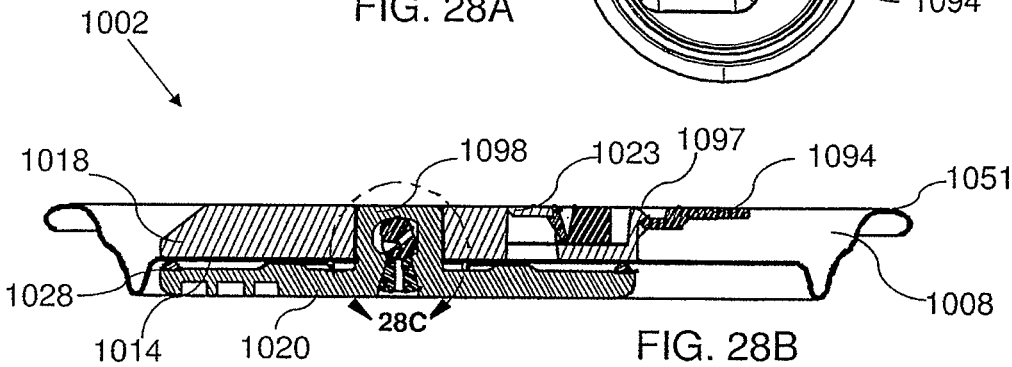
FIG. 28B illustrates a cross-sectional side view along section line 28B-28B of the closure system of FIG. 28A, in accordance with certain examples.
Figure 28C:
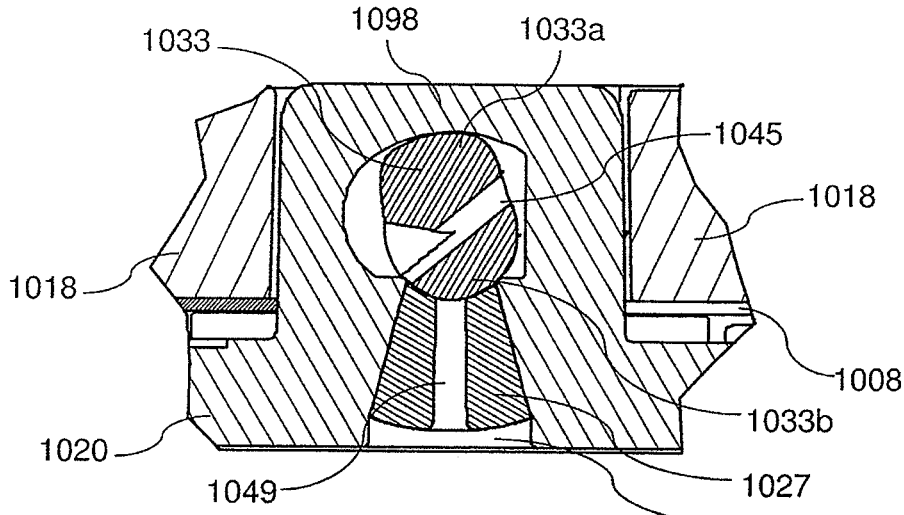
FIG. 28C illustrates a cross-sectional view of the closure system of FIG. 28A, showing detail 28C of FIG. 28B, in accordance with certain examples.

FIGS. 28A-34C illustrate top plan and cross-sectional views of fully assembled closure system 1002 at various positions of operation. FIGS. 28A-C illustrate closure system 1002 in a closed position wherein top cover 1018 is positioned above dispensing portion 1014 and sealing portion 1020 resides up against the bottom surface of can end 1008. In this closed position, lever 1094 is resting on top cover 1018 and is locked in place by mating snap hook 1097 of top cover 1018 with groove 1095 of lever 1094. The lever is no taller than lip 1051 of can end 1008, allowing for ease of stacking containers on top of each other. Additionally illustrated in FIG. 28B, tamper evident feature 1023 is positioned so that it indicates that the closure system has not yet been opened by a user. In this closed position, opening 1045 of pin 1033 is not aligned with opening 1049 of over-mold 1027. Top portion 1033*a* of pin 1033 is in contact with lever receiving portion 1020, while bottom portion 1033*b* of pin 1033 is in contact with over-mold 1027, thereby creating a valve in a closed position. Over-mold 1027 may be at least partially held in place up against bottom portion 1033*b* due to any pressure within the container.

Figure 29A:
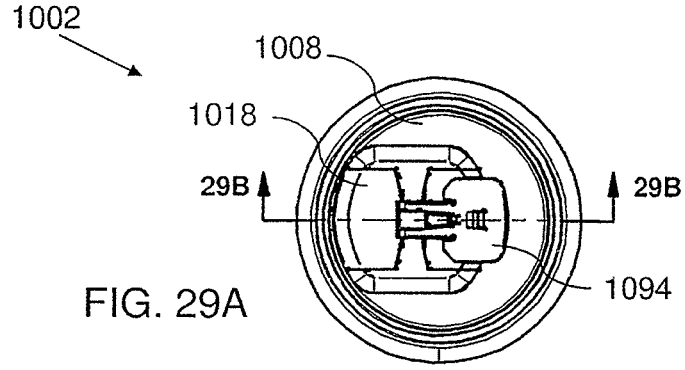
FIG. 29A illustrates a top plan view of a closure system, in accordance with certain examples.
Figure 29B:
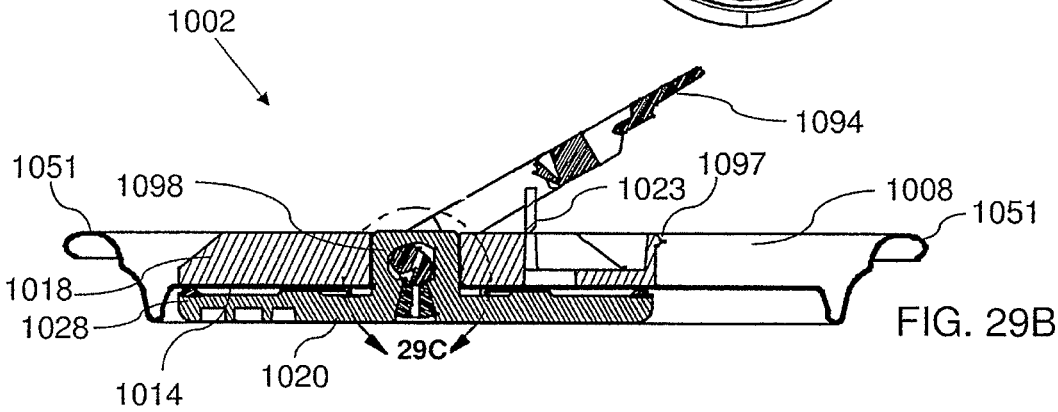
FIG. 29B illustrates a cross-sectional side view along section line 29B-29B of the closure system of FIG. 29A, in accordance with certain examples.
Figure 29C:
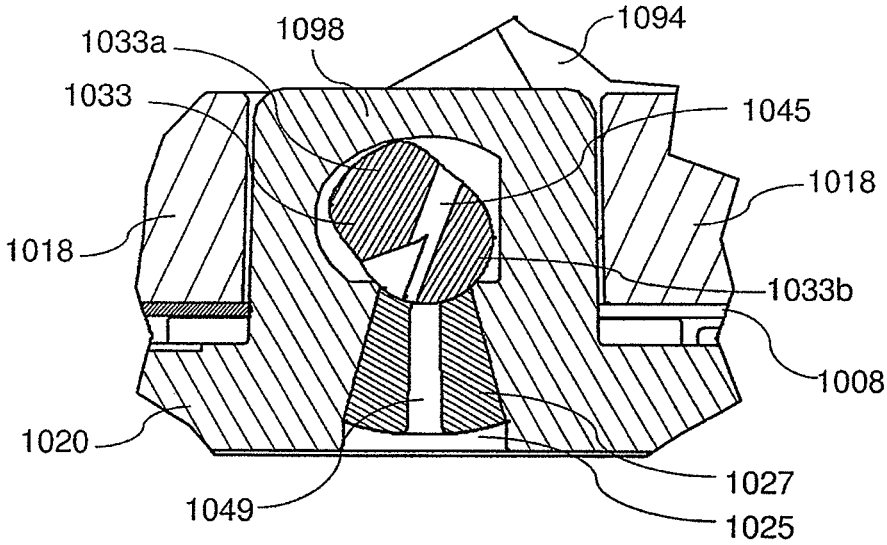
FIG. 29C illustrates a cross-sectional view of the closure system of FIG. 29A, showing detail 29C of FIG. 29B, in accordance with certain examples.
Figure 35A:
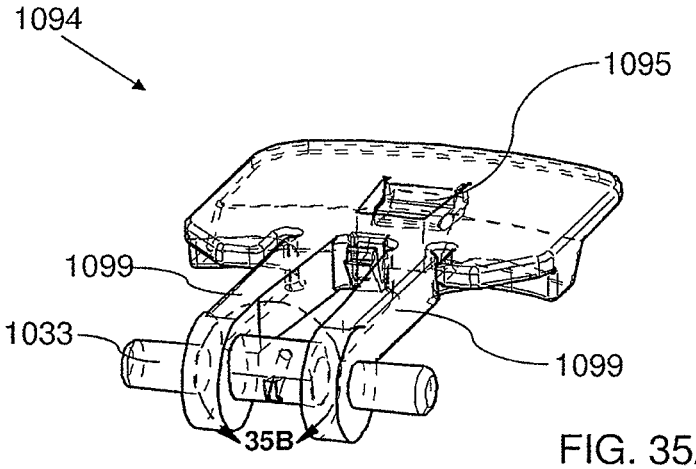
FIG. 35A illustrates a perspective view of the lever of FIGS. 28A-33C, in accordance with certain examples.
Figure 35B:
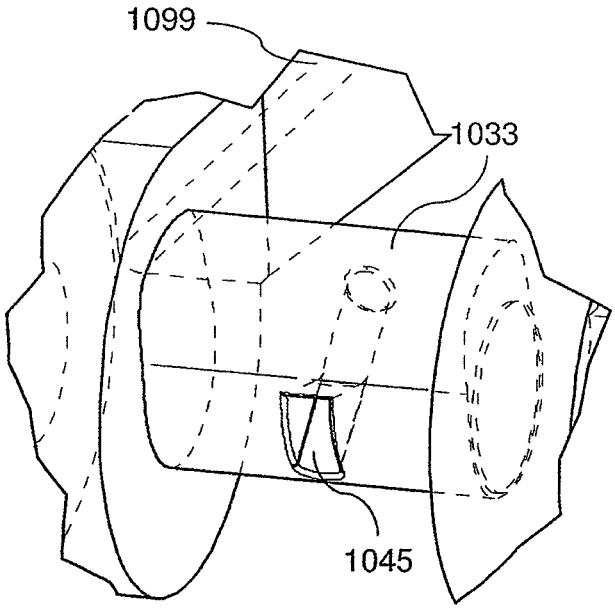
FIG. 35B illustrates a perspective view of the lever of FIG. 35A, showing detail 35B of FIG. 35A, in accordance with certain examples.

FIGS. 29A-29C illustrate top plan and cross-sectional views of fully assembled closure system 1002 in which lever 1094 has been lifted to begin the opening process. At this position, top cover 1018 is still positioned above dispensing portion 1014 and sealing portion 1020 resides up against the bottom surface of can end 1008. Lifting lever 1094 to a first pre-determined angle releases it from top cover 1018 at snap hook 1097 and also rotates pin 1033 such that opening 1045 begins to align with opening 1049 of over-mold 1027, allowing the valve to be in a partially opened position. Top portion 1033*a* of pin 1033 is still partially in contact with lever receiving portion 1020, while bottom portion 1033*b* of pin 1033 is still partially in contact with over-mold 1027. FIGS. 35A-35B illustrate perspective views of lever 1094 showing opening 1045 in pin 1033. As discussed above, as opening 1045 begins to align with opening 1049, pressure from within the container, if any, may be released. As shown in FIG. 29B, tamper evident feature 1023, is now shown in an upright position, which indicates that closure system 1002 has been opened. The first pre-determined angle may be between, for example, about 35 degrees to about 55 degrees.

FIGS. 30A-30C illustrate top plan and cross-sectional views of fully assembled closure system 1002 in which lever 1094 has been lifted to a second pre-determined angle to fully align opening 1045 of pin 1033 with opening 1049 of over-mold 1027, allowing the valve to be in an opened position. Portion 1033*c* of pin 1033 is positioned to operatively interact with lever receiving portion 1098 to begin to move sealing portion 1020 in a downward direction away from can end 1008. Top portion 1033*a* and bottom portion 1033*b* of pin 1033 are no longer in contact with lever receiving portion 1020. The second pre-determined angle may be between, for example, about 45 degrees to about 75 degrees.

Figure 31A:
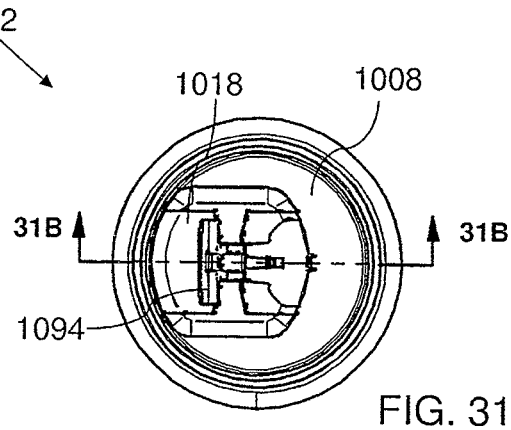
FIG. 31A illustrates a top plan view of a closure system, in accordance with certain examples, in accordance with certain examples.
Figure 31B:
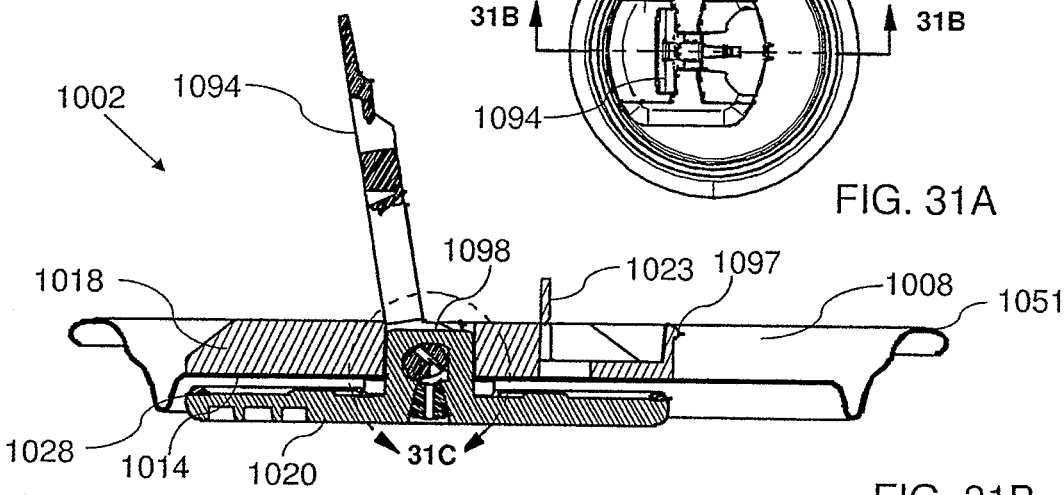
FIG. 31B illustrates a cross-sectional side view along section line 31B-31B of the closure system of FIG. 31A, in accordance with certain examples.
Figure 31C:
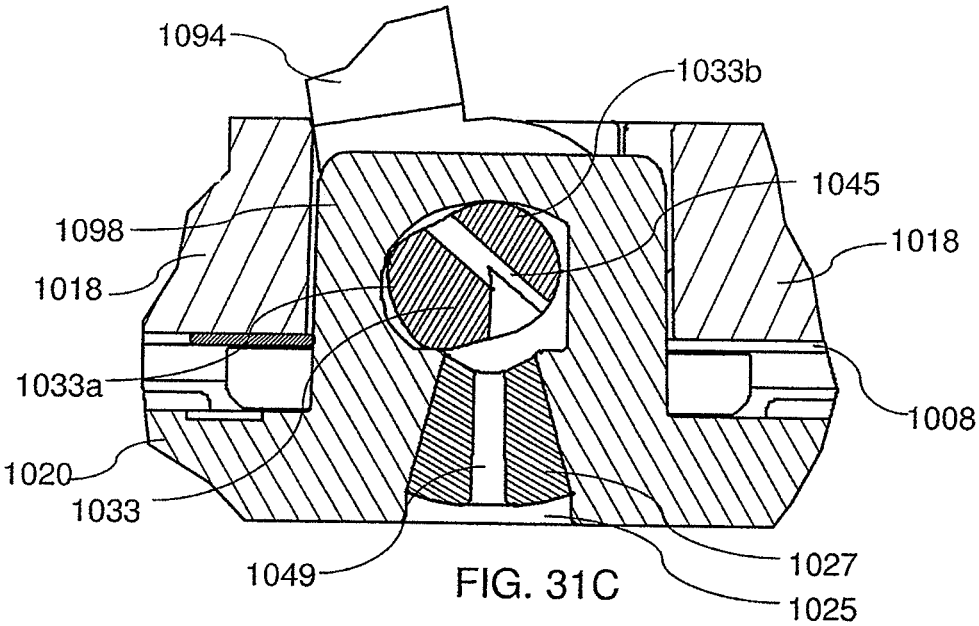
FIG. 31C illustrates a cross-sectional view of the closure system of FIG. 31A, showing detail 31C of FIG. 31B, in accordance with certain examples.

FIGS. 31A-31C illustrate top plan and cross-sectional views of fully assembled closure system 1002 in which the lever has been further lifted to a third pre-determined angle, allowing pin 1033 to move sealing portion 1020 to its most downward position. In this position, sealing portion 1020 is no longer in contact with the bottom surface of can end 1008, and lever 1094 has reached its widest angle, due to top portion 1033*a* and bottom portion 1033*b* being configured within opening 1003 to prevent further lifting of lever 1094. In this position, the valve is still in an opened position. The third pre-determined angle may be between, for example, about 65 degrees to about 125 degrees.

Figure 32A:
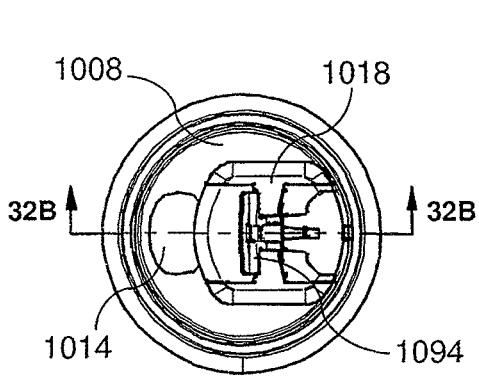
FIG. 32A illustrates a top plan view of a closure system, in accordance with certain examples.
Figure 32B:
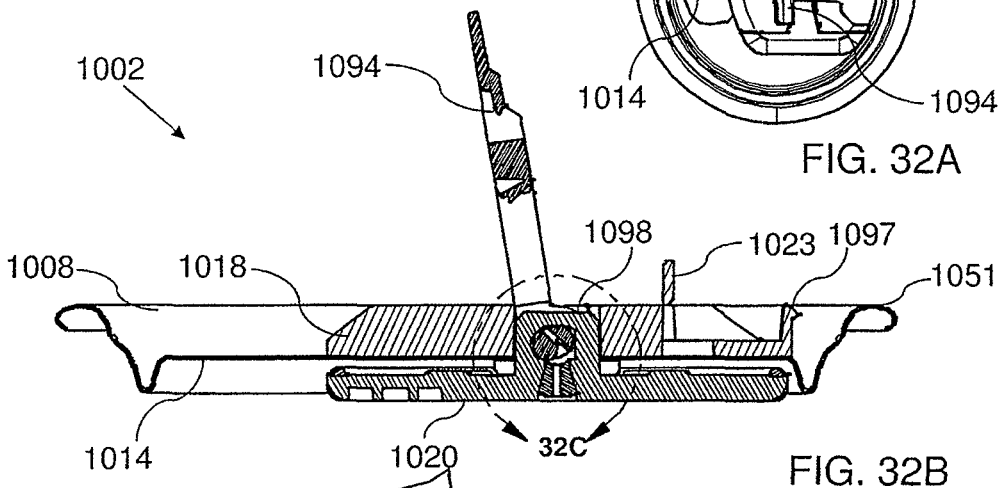
FIG. 32B illustrates a cross-sectional side view along section line 32B-32B of the closure system of FIG. 32A, in accordance with certain examples.
Figure 32C:
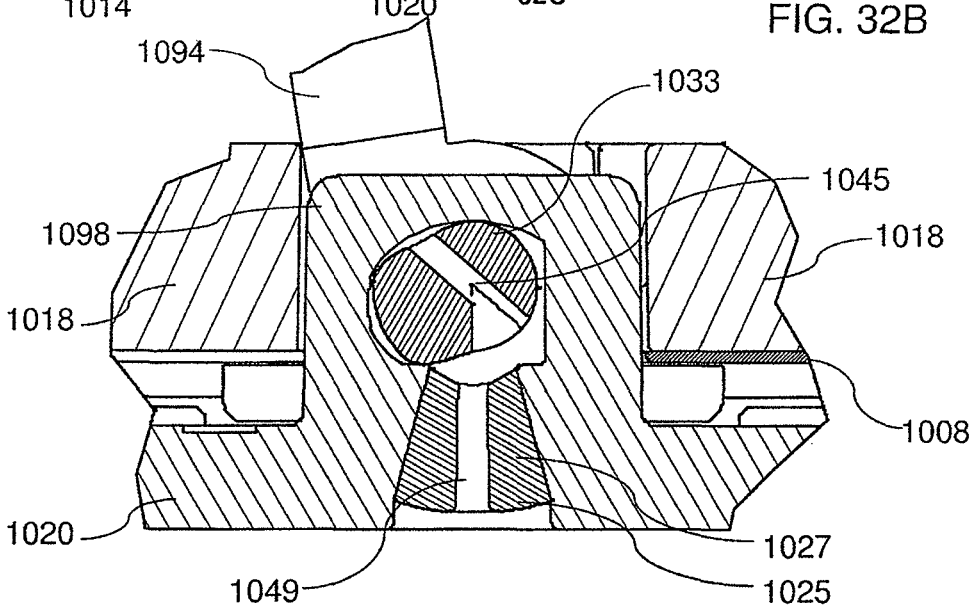
FIG. 32C illustrates a cross-sectional view of the closure system of FIG. 32A, showing detail 32C of FIG. 32B, in accordance with certain examples.

FIGS. 32A-32C illustrate top plan and cross-sectional views of fully assembled closure system 1002 in which the movable closure element, including top cover 1018 comprising lever 1094 and sealing portion 1020, has been moved horizontally along can end 1008. In this position, lever 1094 remains in the lifted position as shown in FIGS. 31A-31C, and sealing portion 1020 remains at a distance from bottom surface of can end 1008, with the valve still in an opened position. As shown in these figures, dispensing portion 1014 is now exposed to allow for a user to pour or otherwise remove contents from the container.

Figure 33A:
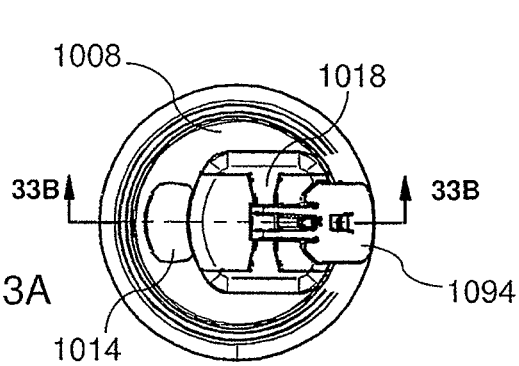
FIG. 33A illustrates a top plan view of a closure system, in accordance with certain examples.
Figure 33B:
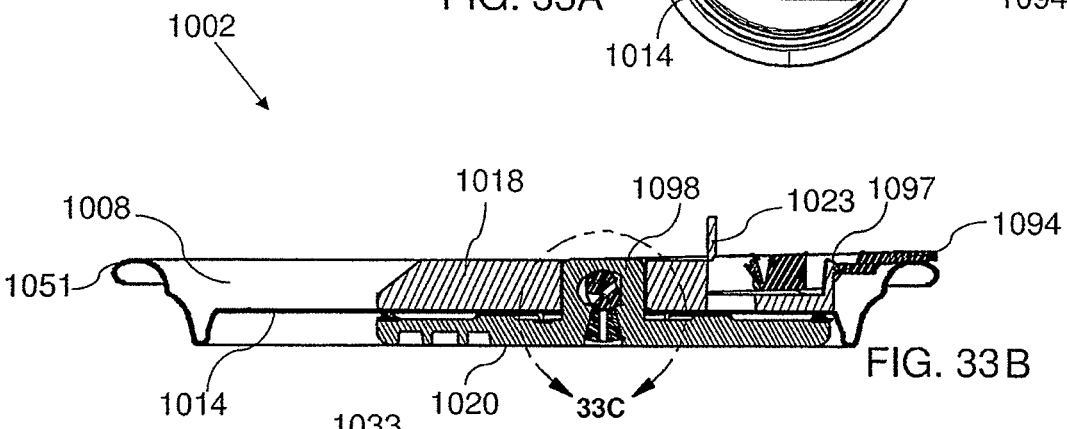
FIG. 33B illustrates a cross-sectional side view along section line 33B-33B of the closure system of FIG. 33A, in accordance with certain examples.
Figure 33C:
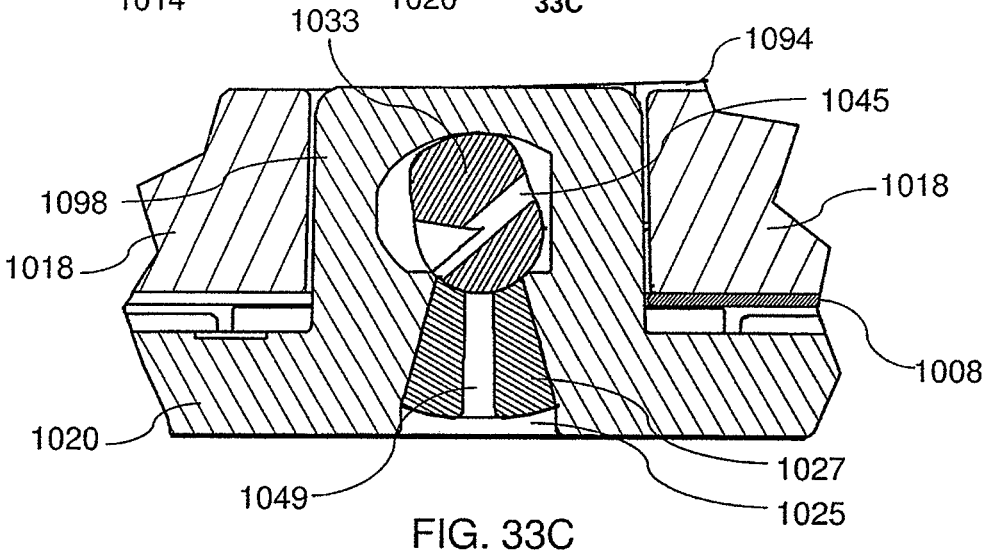
FIG. 33C illustrates a cross-sectional view of the closure system of FIG. 33A, showing detail 33C of FIG. 33B, in accordance with certain examples.

FIGS. 33A-33C illustrate top plan and cross-sectional views of fully assembled closure system 1002 in which the movable closure element, including top cover 1018 comprising lever 1094 and sealing portion 1020, remain in a position such that dispensing portion 1014 is exposed, as shown in FIGS. 32A-33C. In this position, lever 1094 has been lowered, reversing the direction in which pin 1033 is rotated, such that sealing portion 1020 is once again positioned up against the bottom surface of can end 1008. Lowering lever 1094 also rotates pin 1033 such that opening 1043 of pin 1033 is not aligned with opening 1049 of over-mold 1027. Top portion 1033*a* of pin 1033 is again in contact with lever receiving portion 1020, while bottom portion 1033*b* of pin 1033 is in contact with over-mold 1027, thereby moving the valve to the closed position, and demonstrating the reclosability of the container.

Figure 34A:
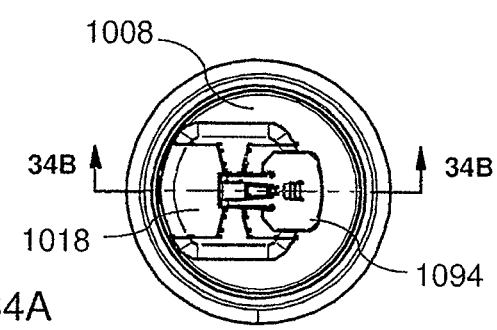
FIG. 34A illustrates a top plan view of a closure system, in accordance with certain examples.
Figure 34B:
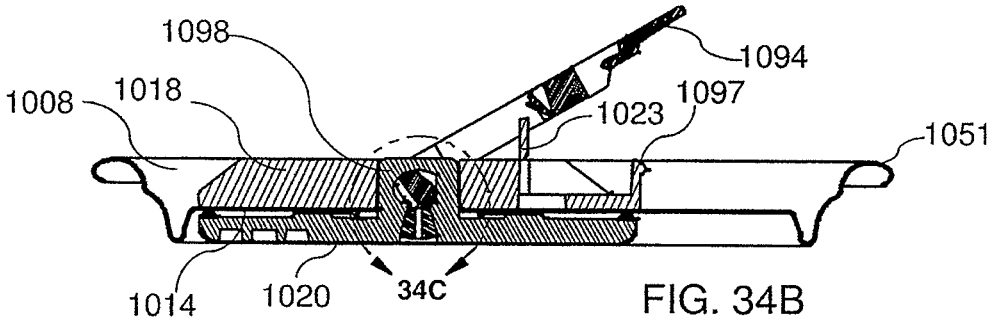
FIG. 34B illustrates a cross-sectional side view along section line 34B-34B of the closure system of FIG. 34A, in accordance with certain examples.
Figure 34C:
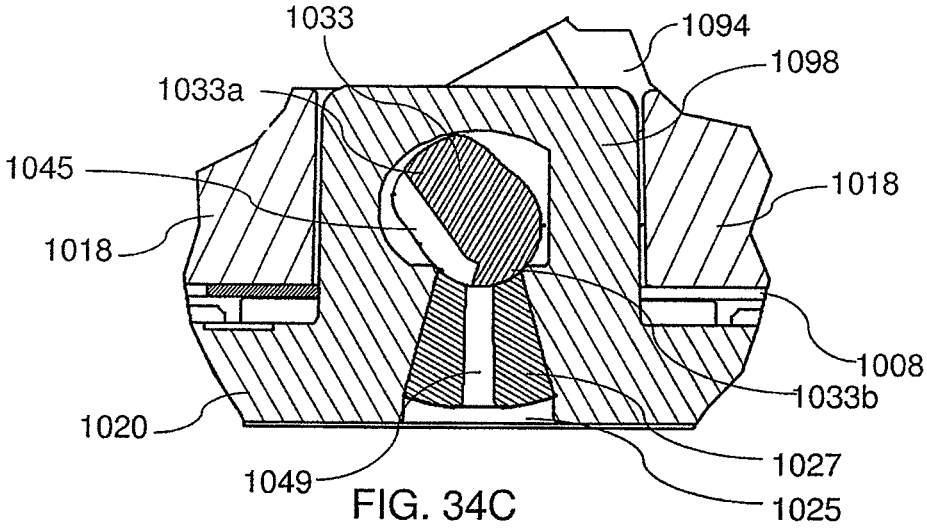
FIG. 34C illustrates a cross-sectional view of the closure system of FIG. 34A, showing detail 34C of FIG. 34B, in accordance with certain examples.
Figure 36A:
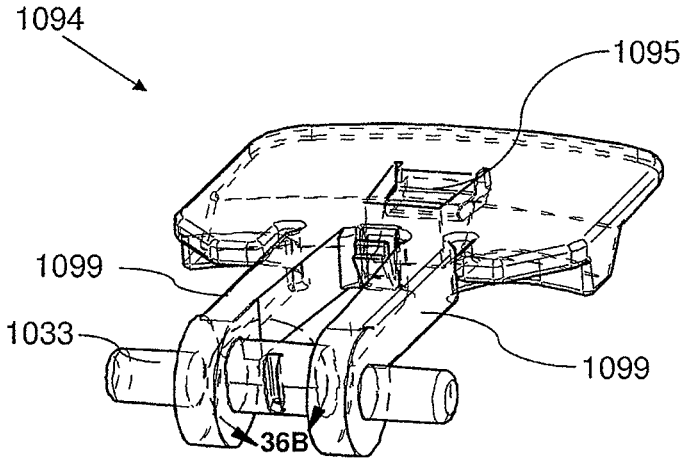
FIG. 36A illustrates a perspective view of the lever of FIGS. 34A-34C, in accordance with certain examples.
Figure 36B:
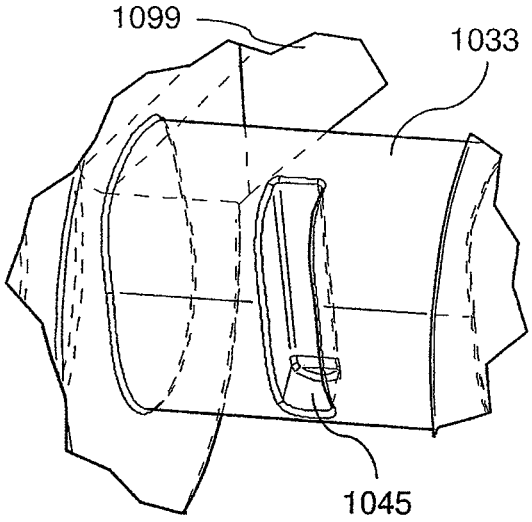
FIG. 36B illustrates a perspective view of the lever of FIG. 36A, showing detail 36B of FIG. 36A, in accordance with certain examples.

In an additional embodiment FIGS. 34A-34C illustrate top plan and cross-sectional views of fully assembled closure system 1002 in which lever 1094 has been lifted to begin the opening process. At this position, top cover 1018 is still positioned above dispensing portion 1014 and sealing portion 1020 is resting up against the inner side of can end 1008. Lifting lever 1094 to a first pre-determined angle releases it from top cover 1018 at snap hook 1097 and also rotates pin 1033 such that opening 1045 begins to align with opening 1049 of over-mold, allowing the valve to be in a partially opened position. Top portion 1033*a* of pin 1033 is still partially in contact with lever receiving portion 1020, while bottom portion 1033*b* of pin 1033 is still partially in contact with over-mold 1027. In this embodiment, opening 1045 takes the form of a slit or indent on a surface of pin 1033, rather than an opening that goes through the width of pin 1033. FIGS. 36A-36B illustrate perspective views of slit or indent opening 1045 in pin 1033. As discussed above, as slit or indent opening 1045 begins to align with opening 1049, pressure from within the container, if any, may be released. As shown in FIG. 29B, tamper evident feature 1023, is now in an upright position, which indicates that the closure system has been opened.

To assemble the closure system of certain embodiments described above, lever receiving portion 1098 of sealing portion 1020 is mated with lever 1094 of top cover 1018 by way of pin 1033. A first end 1035 of pin 1033 of lever 1094 is inserted through opening 1003 in lever receiving portion 1098. Subsequently, open prong 1099 of lever 1094 having opening 1047 is mated with first end 1035 of pin 1033. The channel guide of can end 1008 is then aligned with lever 1094 such that it is allowed to pass through the channel guide. In certain examples, the channel guide of can end 1008 is aligned at a position which is approximately 90 degrees from its' final positioning within closure system 1002. Can end 1008 resides on sealing portion 1020. Lever 1094 of the partially assembled closure system is then inserted through the remaining portion of top cover 1018. The remaining portion of top cover 1018 is then lowered, and arms 1021 of top cover 1018 are also pivoted such that the ends 1035 of pin 1033 of lever 1094 are mated with openings 1031 of arms 1021. Once top cover 1018 is lowered to a predetermined distance from can end 1008, for example 0.02 inches from can end 1008, and arms 1021 are at a predetermined angle from can end 1008, for example 5 degrees from can end 1008, can end 1008 can be rotated 90 degrees allowing portions of top cover 1018, including arms 1021 and hooks 1029 to snap into place and be secured can end 1008. Top cover 1021 also comprises projections 1043 which align within the channel guide of can end 1008 and assist in ensuring proper alignment of top cover 1018 with the channel guide of the can end.

Another embodiment of the disclosure is directed to a closure system for sealing a container constructed to be mated with a container body. Referring to FIGS. 37A and 37B, a closure system generally indicated at 1100 is shown without the container body. As shown, the closure system 1100 includes a fixed element embodying a can end 1102 and a movable closure element generally indicated at 1104. In FIGS. 37A and 37B, the movable closure element 1104 is illustrated in a first, closed position. The can end 1102 includes a rim portion (not designated) that is configured to be secured to an end of the container body.

Specifically, with reference to FIGS. 43A, 43B, 43C and 43D, the can end 1102 is configured to be suitably secured to the container body (not shown), and includes a body 1106 having dispensing portion 1108 and a channel guide 1110 formed in body 1106 of the can end. The channel guide 1110 includes a first end 1112 and a second end 1114. The movable closure element 1104 includes a top cover 1116 and a sealing portion 1118.

The top cover 1116, in the shown embodiment, includes a body 1120 and a separate lever 1122 that is configured to be pivotably secured to the body 1120. The lever 1122 includes a bar element 1124. A pair of notches each indicated at 1126 are formed in the body 1120 of the top cover 1116. The arrangement is such that the lever 1122 is capable of pivoting with respect to the top cover 1116, the purpose of which will be described in greater detail below.

Figure 43A:
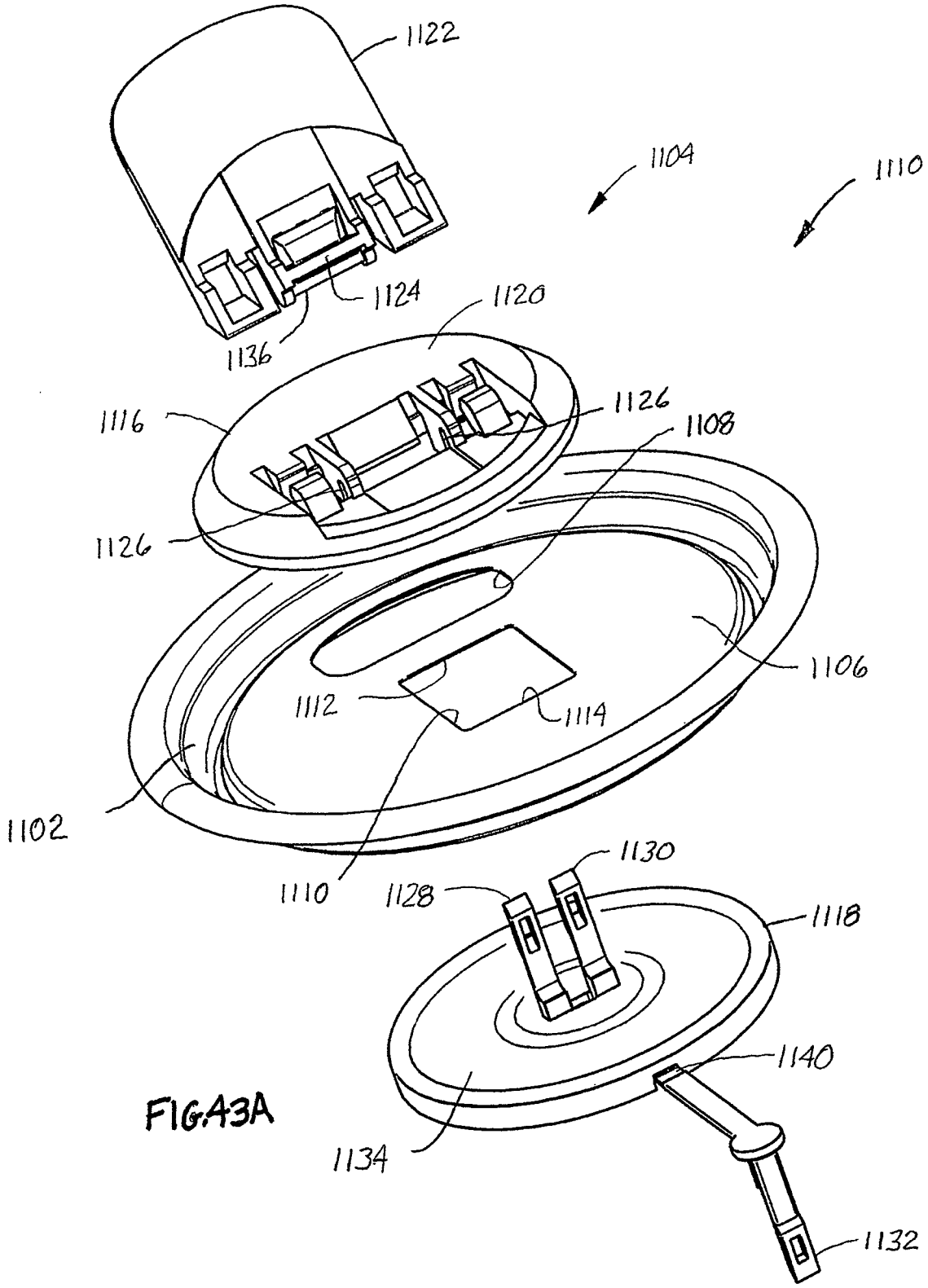
FIG. 43A illustrates an exploded top perspective view of the closure system in a first position, in accordance with certain examples.
Figure 43B:
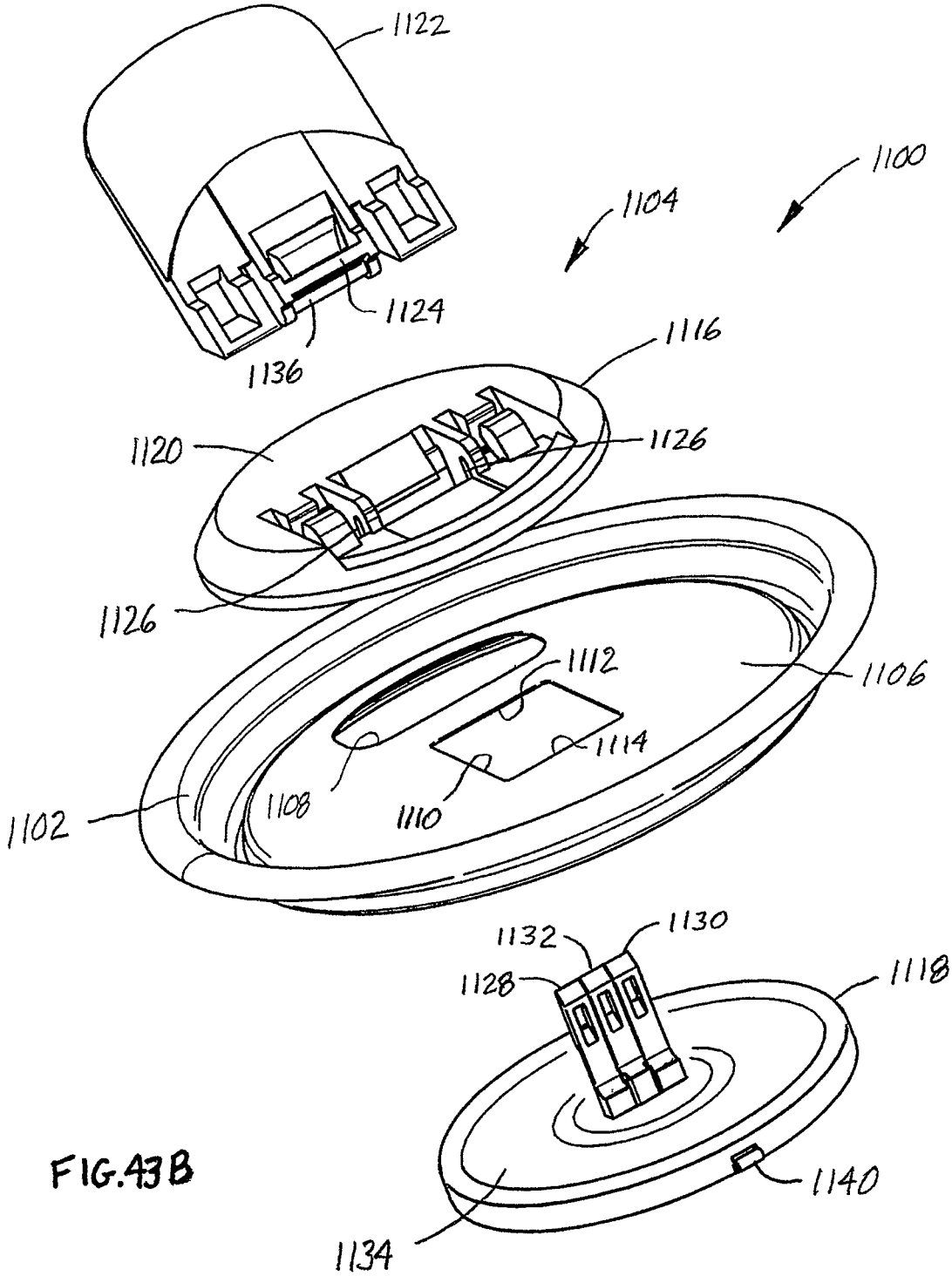
FIG. 43B illustrates an exploded perspective view of the closure system shown in FIG. 43A in a second position, in accordance with certain examples.
Figure 43C:
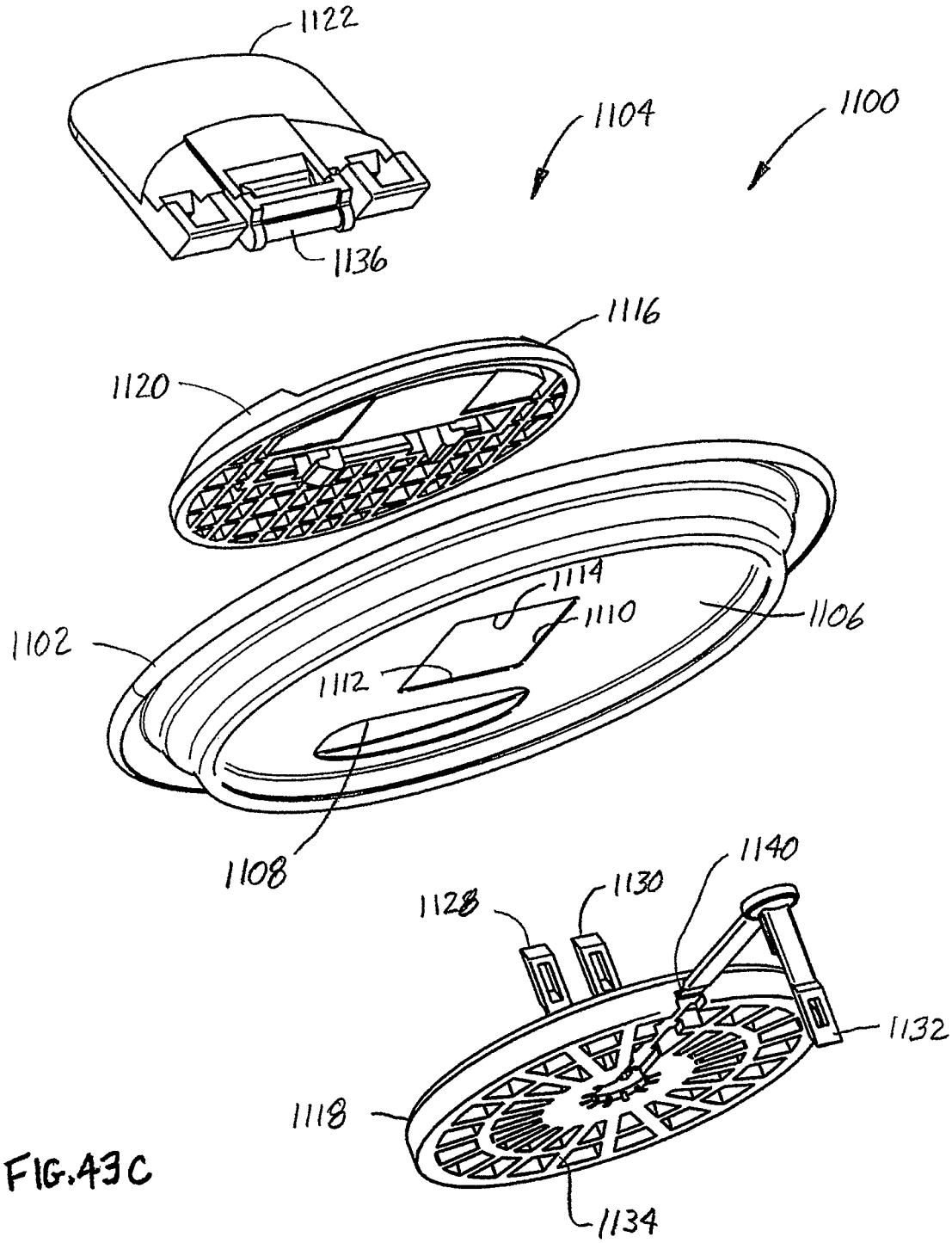
FIG. 43C illustrates an exploded bottom perspective view of the closure system shown in FIG. 43A, in accordance with certain examples.
Figure 43D:
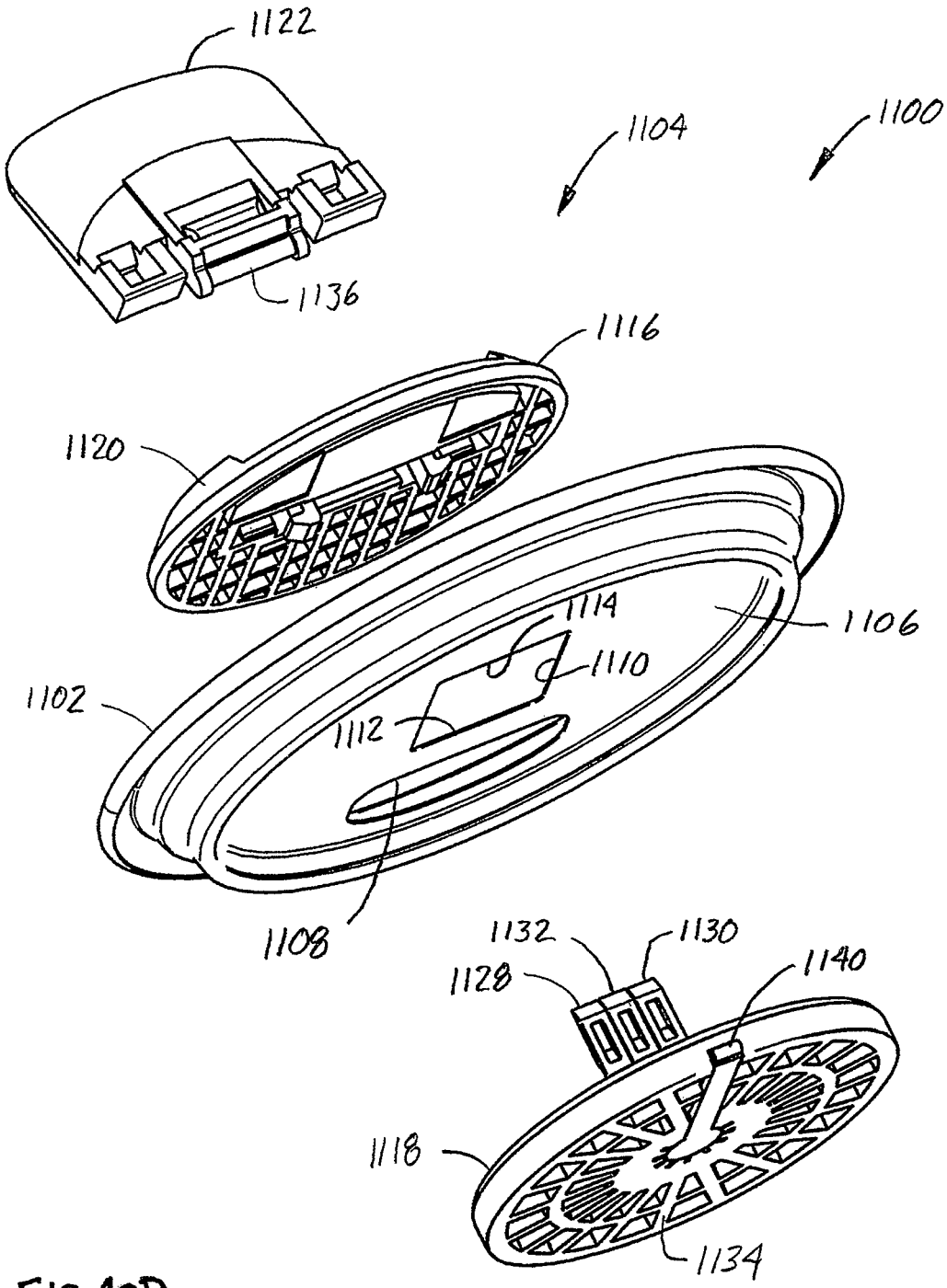
FIG. 43D illustrates an exploded bottom perspective view of the closure system shown in FIG. 43B, in accordance with certain examples.

The sealing portion 1118 includes a lever receiving portion, which in the shown embodiment is represented by three fingers 1128, 1130 and 1132 that extend upwardly from the sealing portion 1118. The fingers 1128, 1130 and 1132 are configured to secure the sealing portion 1118 to the top cover 1116, which will be described in greater detail below with reference to FIGS. 52 and 53. Finger 1132 is flexibly connected to a body 1134 of the sealing portion 1118. The finger 1132 is capable of being moved from the position illustrated in FIG. 43A to a position in which the finger 1132 is disposed between fingers 1128, 1130, which is illustrated in FIG. 43B. FIG. 43C illustrates the middle finger 1132 extended laterally from the body 1134 of the sealing portion 1118 and FIG. 43D illustrates the middle finger 1132 extending between fingers 1128, 1130. The flexibility of the middle finger 1132 enables the middle finger to move vertically with respect to the outer fingers 1128, 1130 when positioned between the outer fingers.

The arrangement is such that when the lever 1122 is lifted, which will be described below, the fingers 1128, 1130, 1132 accept a portion 1136 of the lever to move the sealing portion 1118 with respect to the can end 1102. In this position, the top cover 1116 is capable of being moved horizontally from the first end 1112 to the second end 1112 of the channel guide 1110 to expose the dispensing portion 1108. The particular movement of the closure element 1104 will be described in greater detail below with reference to FIGS. 37-42.

FIGS. 37A and 37B illustrate a sealed position in which the top cover 1116 covers the dispensing portion 1108. In this position, the lever 1122 rests on the body 1120 of the top cover 1116, and the sealing portion 1118 is in contact with a bottom surface 1138 of the can end 1102 to seal the dispensing portion 1108. Contents within container body are blocked from flowing out of the container body.

Figure 38A:
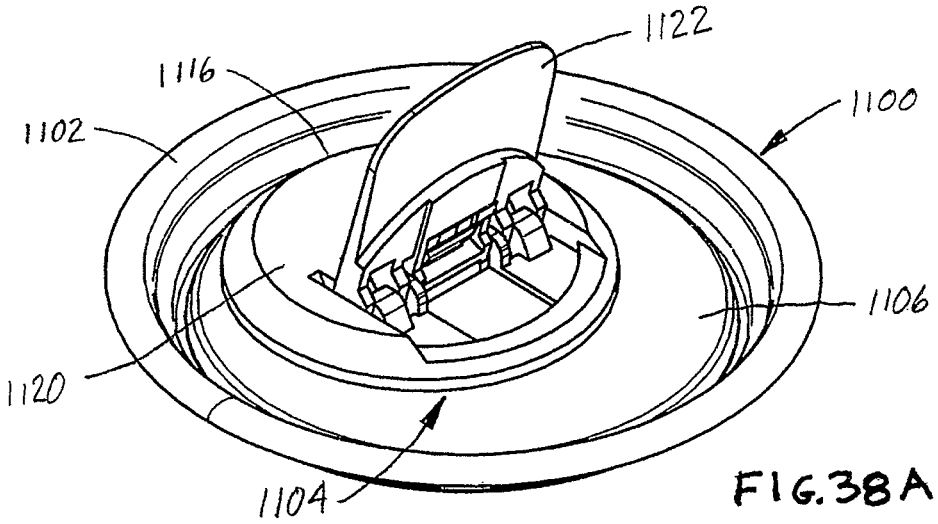
FIG. 38A illustrates a top perspective view of the closure system, in accordance with certain examples.
Figure 38B:
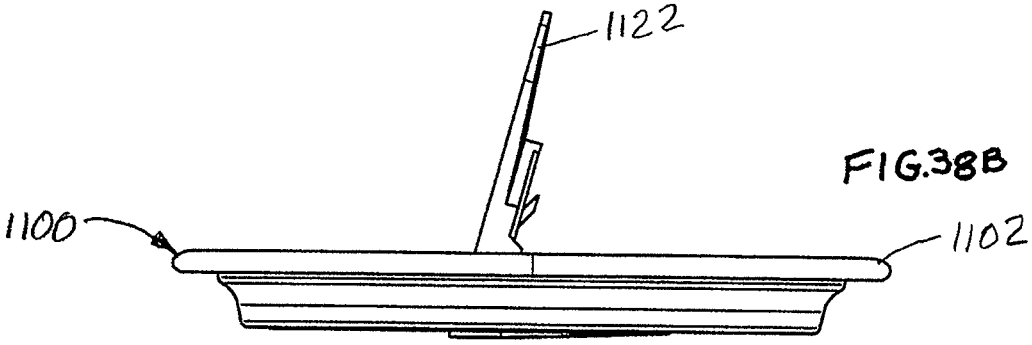
FIG. 38B illustrates a side view of the closure system of FIG. 38A, in accordance with certain examples.
Figure 38C:
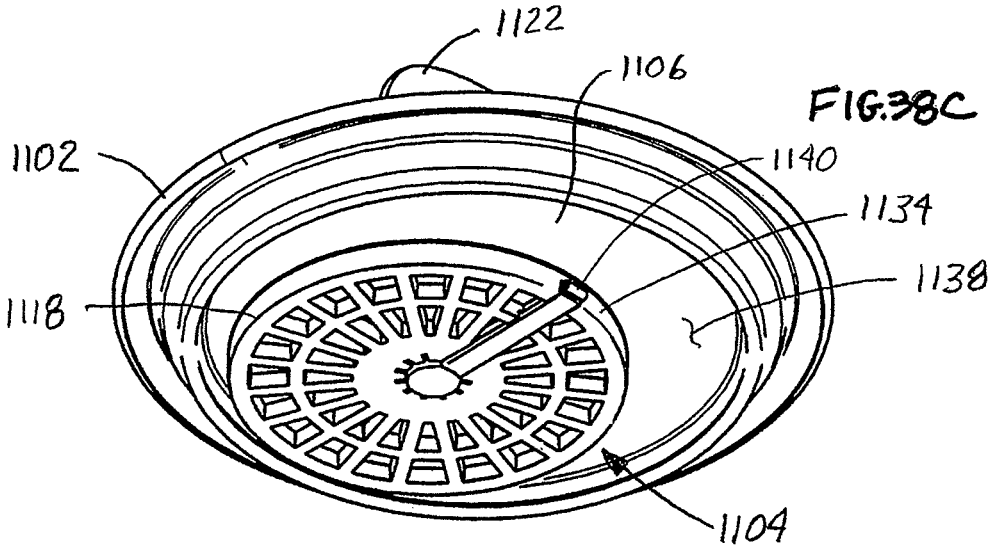
FIG. 38C illustrates a bottom perspective view of the closure system of FIG. 38A, in accordance with certain examples.

FIGS. 38A, 38B and 38C illustrate a valve open position in which the top cover 1116 covers the dispensing portion 1108 and the lever 1122 is lifted short of attaining a vertical position with respect to the body 1120 of the top cover to create an initial pressure release. Specifically, pressure is released from the container when the lever 1122 is lifted from a resting position on the top cover 1116 to a predetermined angle. As shown, the sealing portion 1118 maintains its contact with the bottom surface 1138 of the can end 1102 to seal the dispensing portion 1108.

Figure 39A:
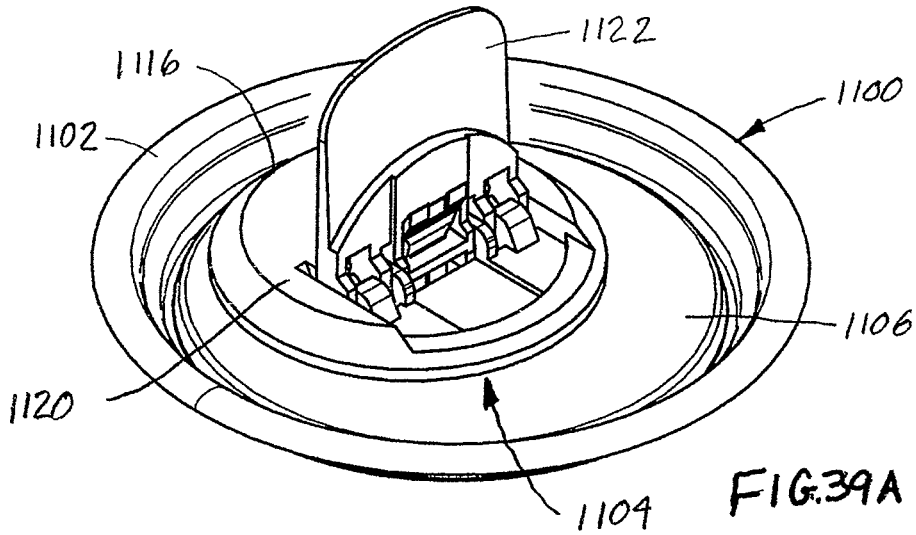
FIG. 39A illustrates a top perspective view of the closure system, in accordance with certain examples.
Figure 39B:
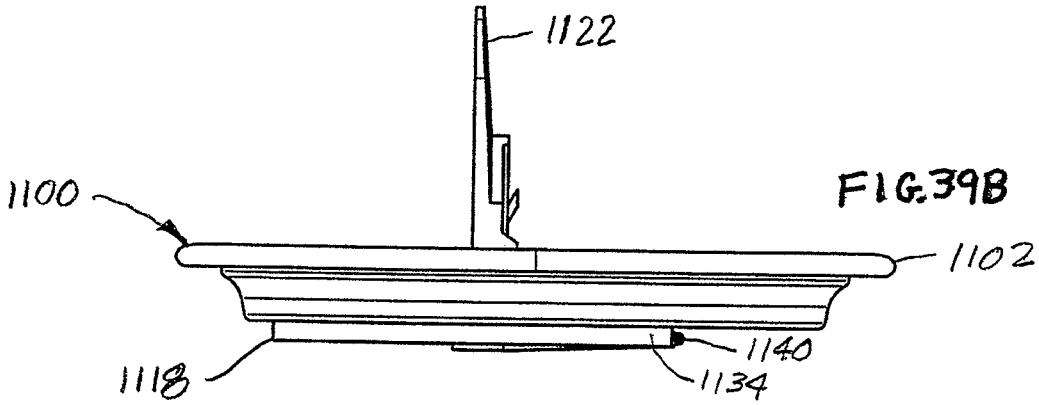
FIG. 39B illustrates a side view of the closure system of FIG. 39A, in accordance with certain examples.
Figure 39C:
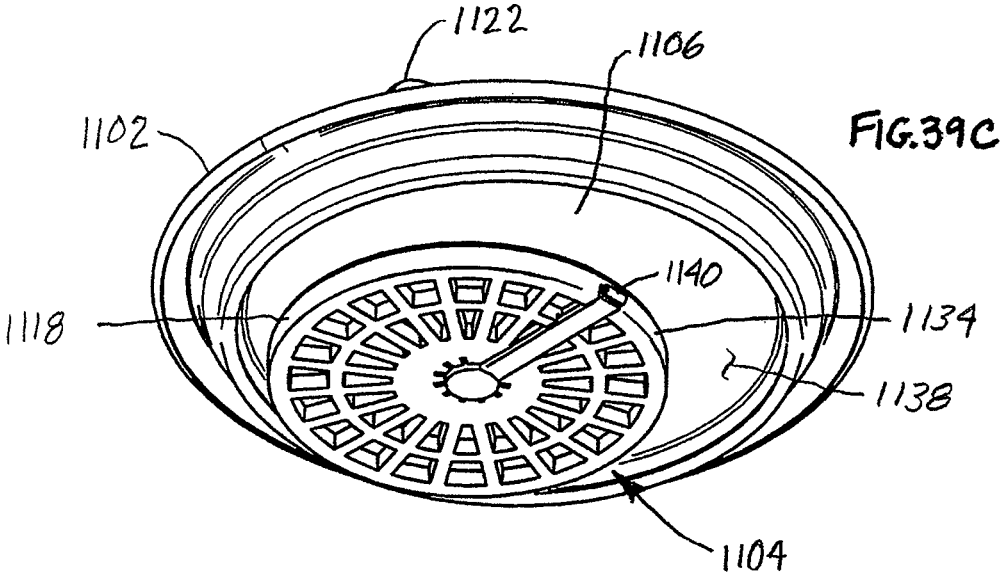
FIG. 39C illustrates a bottom perspective view of the closure system of FIG. 39A, in accordance with certain examples.

FIGS. 39A, 39B and 39C illustrate a position in which the top cover 1116 covers the dispensing portion 1108 and the lever 1122 is further lifted so that it attains a vertical position with respect to the body 1120 of the top cover. In this position, the portion 1136 of the lever 1122 engages the fingers 1128, 1130, 1132. As shown, the sealing portion 1118 is spaced a distance from the bottom surface 1138 of the can end 1102. The movement of the sealing portion 1118 is caused by the portion 1136 of the lever 1122 engaging the fingers 1128, 1130 and 1132 thereby causing the movement of the fingers.

Figure 40A:
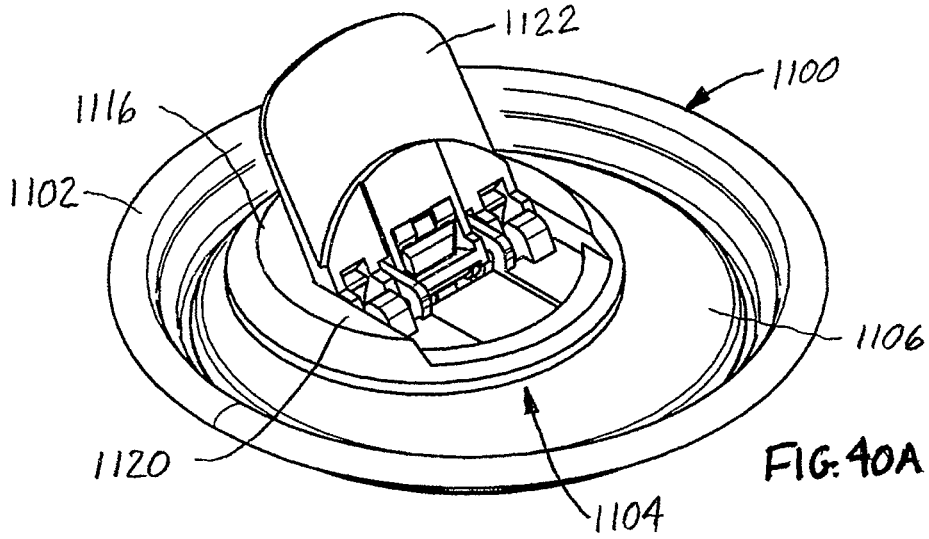
FIG. 40A illustrates a top perspective view of the closure system, in accordance with certain examples.
Figure 40B:
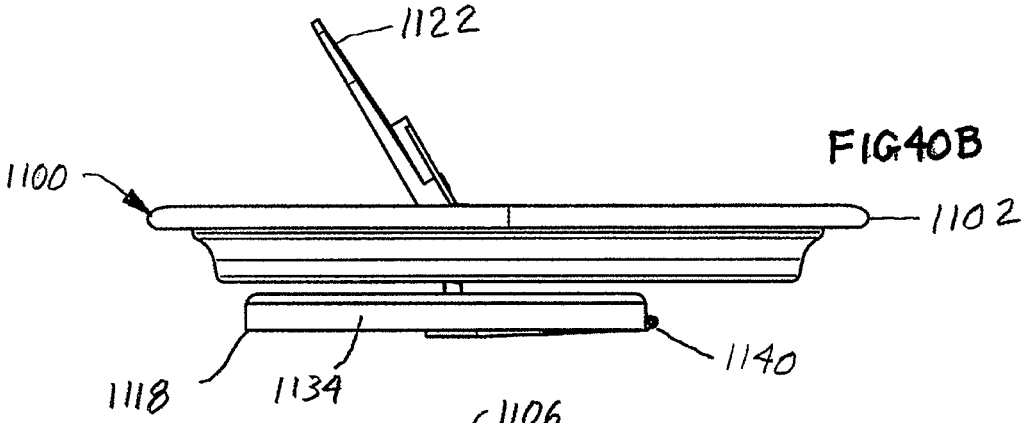
FIG. 40B illustrates a side view of the closure system of FIG. 40A, in accordance with certain examples.
Figure 40C:
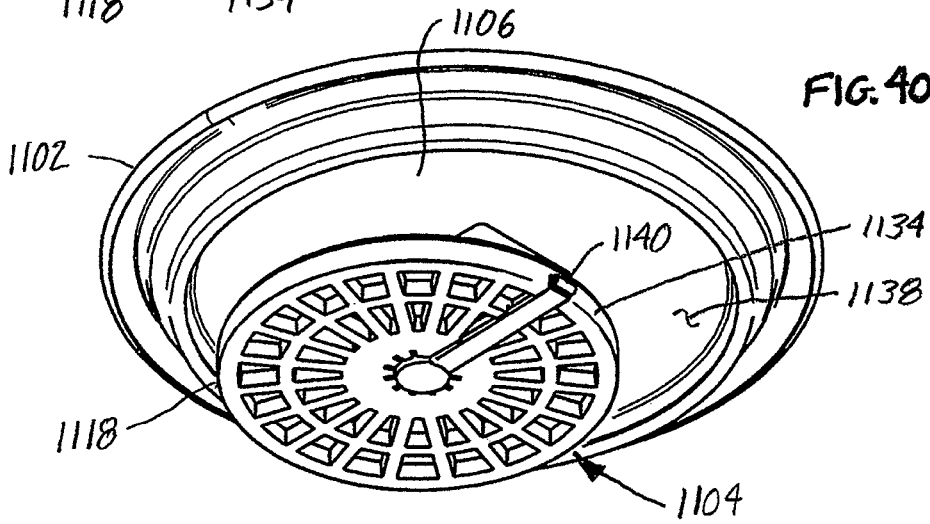
FIG. 40C illustrates a bottom perspective view of the closure system of FIG. 40A, in accordance with certain examples.

FIGS. 40A, 40B and 40C illustrate a position in which the top cover 1116 covers the dispensing portion 1108 and the lever 1122 is further lifted beyond the vertical position illustrated in FIGS. 39A and 39B. In this position, the portion 1136 of the lever 1122 engages the fingers 1128, 1130 and 1132 so as to further move the sealing portion 1118 a predetermined distance from the bottom surface 1138 of the can end 1102. In this position, the sealing portion 1118 achieves a maximum downward position.

Figure 41A:
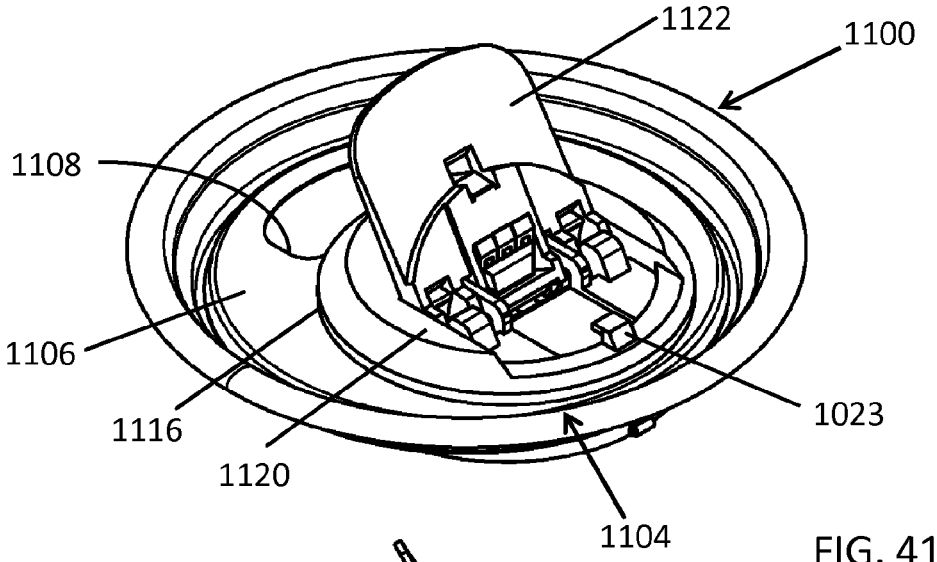
FIG. 41A illustrates a top perspective view of the closure system, in accordance with certain examples.
Figure 41B:
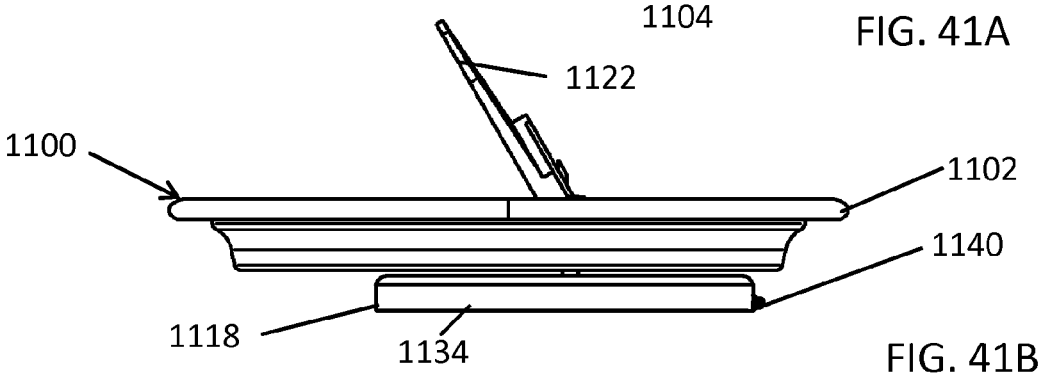
FIG. 41B illustrates a side view of the closure system of FIG. 41A, in accordance with certain examples.
Figure 41C:
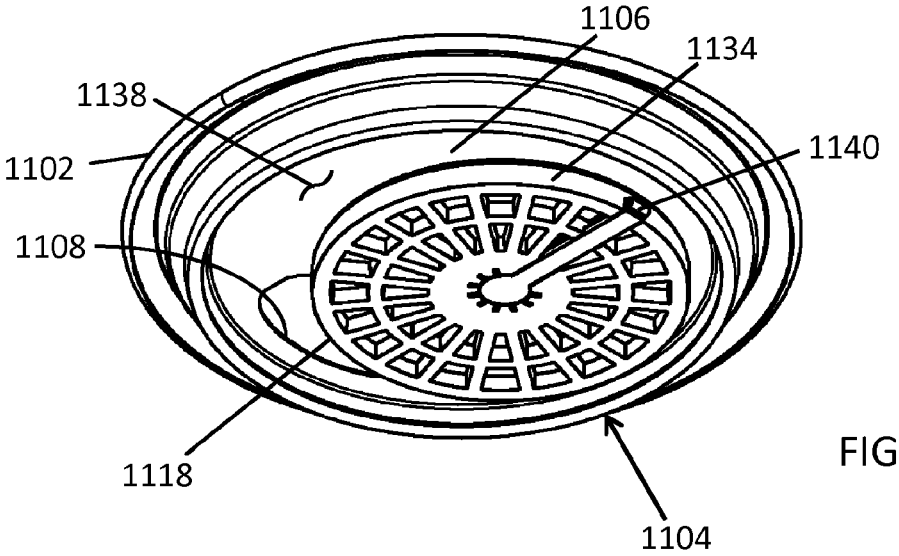
FIG. 41C illustrates a bottom perspective view of the closure system of FIG. 41A, in accordance with certain examples.

FIGS. 41A, 41B and 41C illustrate a position in which the top cover 1116 and the sealing portion 1118 expose the dispensing portion 1108. Specifically, with the sealing portion 1118 spaced from the can end 1102, the top cover 1116 and the sealing portion 1118 can be moved horizontally from the first end 1112 to the second end 1114 of the channel guide 1110 to expose the dispensing portion 1108. As shown, the lever 1122 is maintained in the position of the lever shown in FIGS. 40A and 40B.

Figure 42A:
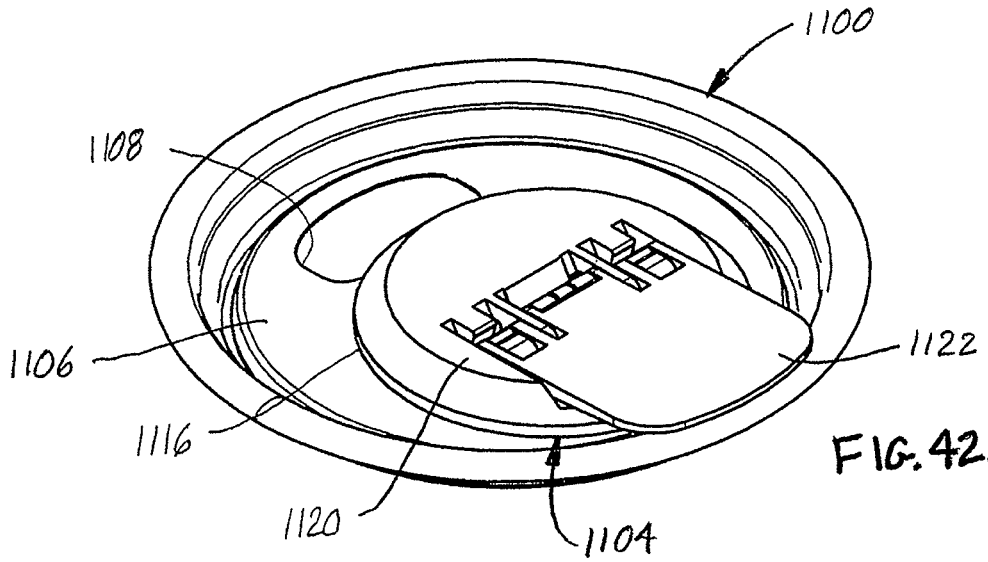
FIG. 42A illustrates a top perspective view of the closure system, in accordance with certain examples.
Figure 42B:
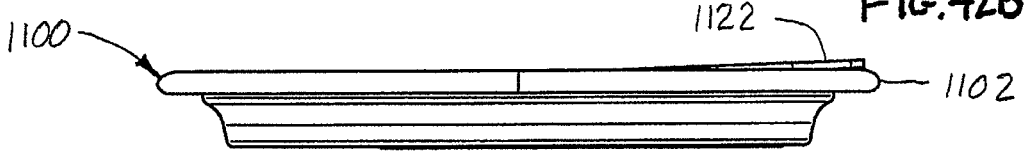
FIG. 42B illustrates a side view of the closure system of FIG. 42A, in accordance with certain examples.
Figure 42C:
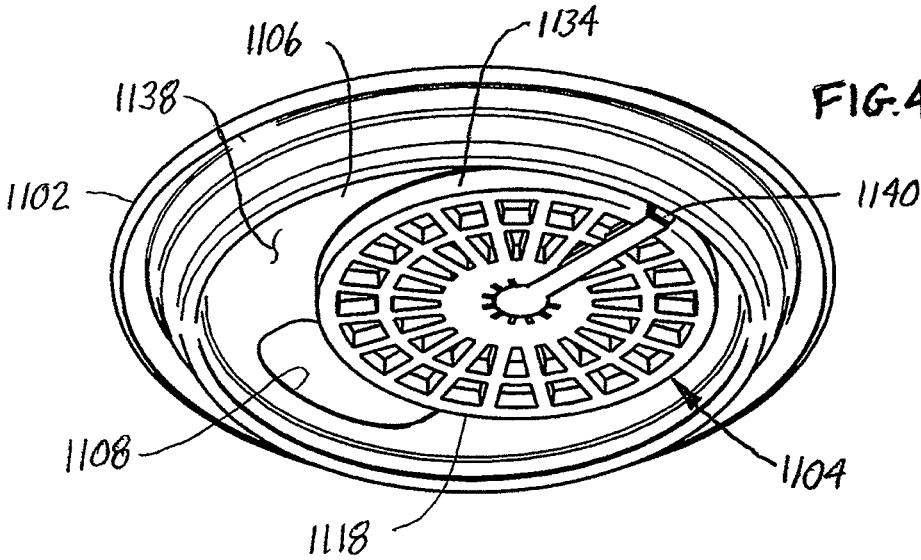
FIG. 42C illustrates a bottom perspective view of the closure system of FIG. 42A, in accordance with certain examples.

And finally, FIGS. 42A, 42B and 42C illustrate a position in which the top cover 1116 and the sealing portion 1118 expose the dispensing portion 1108, with the lever 1122 being lowered to the position shown in FIG. 37A to rest on the top cover 1116. As shown, the sealing portion 1118 is in contact with the bottom surface 1138 of the can end 1102. In this position, which may be referred to as a dispensing position, the contents of the container body may be emptied.

Figure 44A:
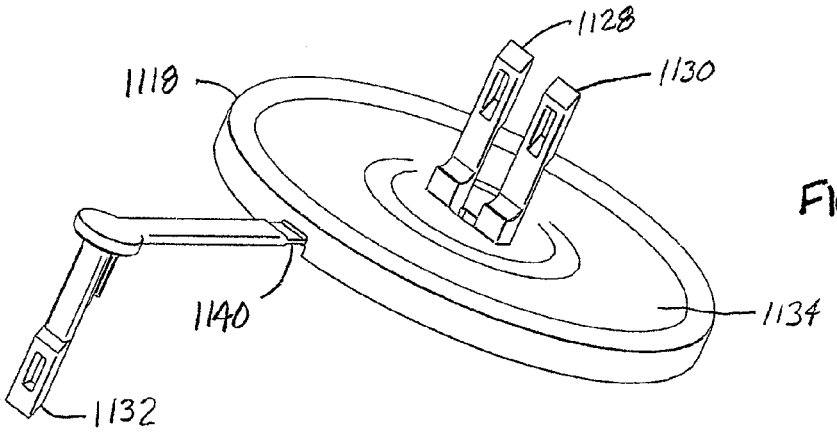
FIG. 44A illustrates a top perspective view of a sealing portion in a first position, in accordance with certain examples.
Figure 44B:
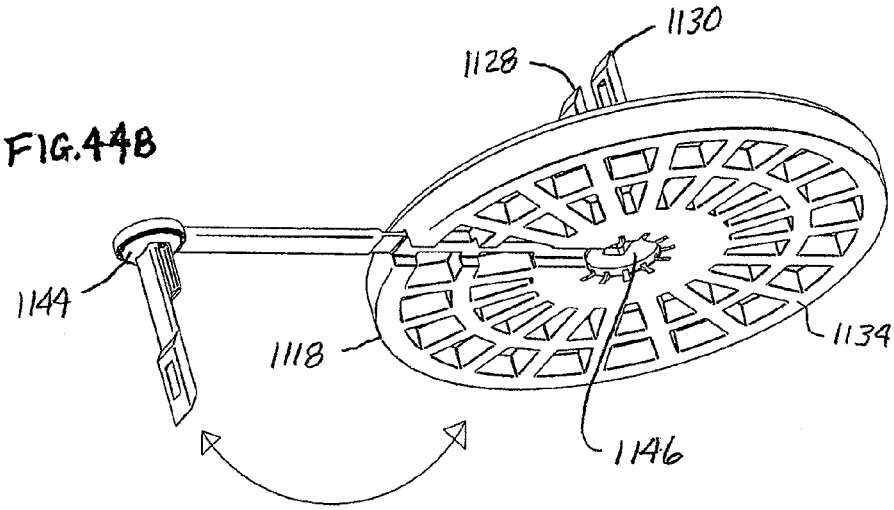
FIG. 44B illustrates a bottom perspective view of the sealing portion of FIG. 44A, in accordance with certain examples.
Figure 44C:
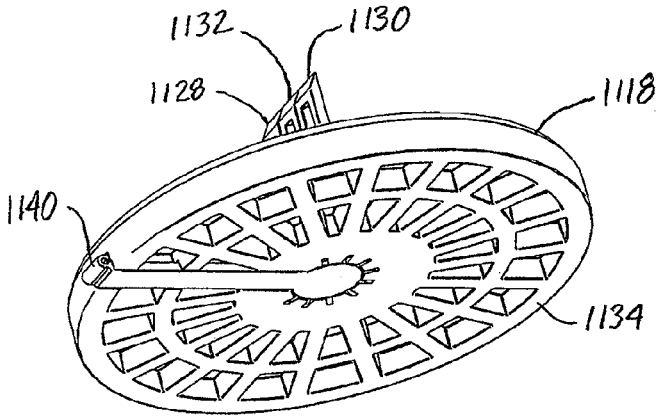
FIG. 44C illustrates a bottom perspective view of the sealing portion in a second position, in accordance with certain examples.
Figure 44D:
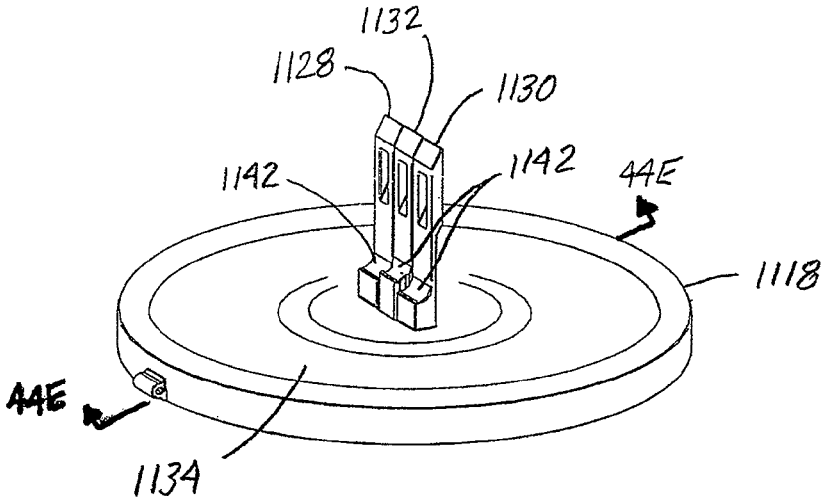
Figure 44E:
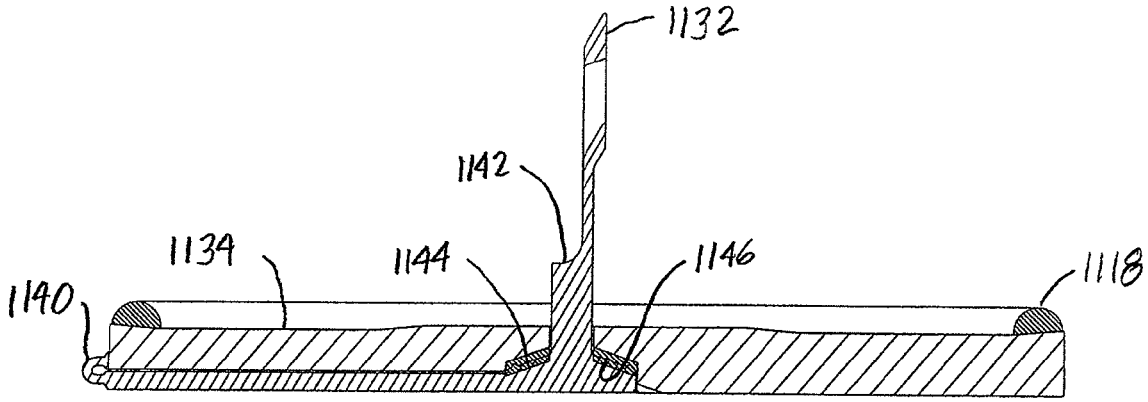

Turning now to FIGS. 44A, 44B, 44C, 44D and 44E, the movement of the middle finger 1132 with respect to the body 1134 of the sealing portion 1118 is illustrated. FIGS. 44A and 44B illustrate the middle finger 1132 in an extended position. It should be understood that the middle finger 1132 may sometimes be referred to as a valve, which will be apparent as the description of the closure system 1100 proceeds. The middle finger 1132 includes a flexible hinge 1140 that enables the movement of the finger. FIGS. 44C, 44D and 44E illustrate the middle finger 1132 in the position in which the middle finger extends between the outer fingers 1128, 1130. Referring particularly to FIG. 44D, each finger 1128, 1130 and 1132 includes a surface 1142 formed by a widening of the finger. The surfaces 1142 are configured to engage the portion 1136 of the lever 1122 when the lever is pivotably secured to the top cover 1116. As shown, the surface 1142 of the middle finger 1132 is elevated relative to the surfaces 1142 of the outer fingers 1128, 1130. Referring now to FIG. 44E, the middle finger 1132 includes a valve 1144 that is received within a valve seat 1146 formed in the bottom surface 1138 of the sealing portion 1118.

Figure 45A:
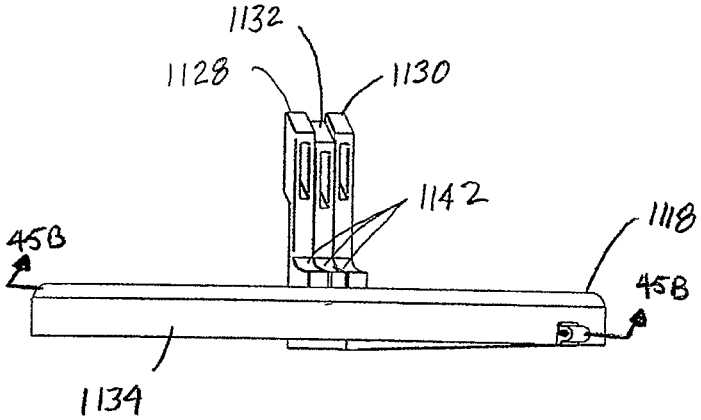
Figure 45B:
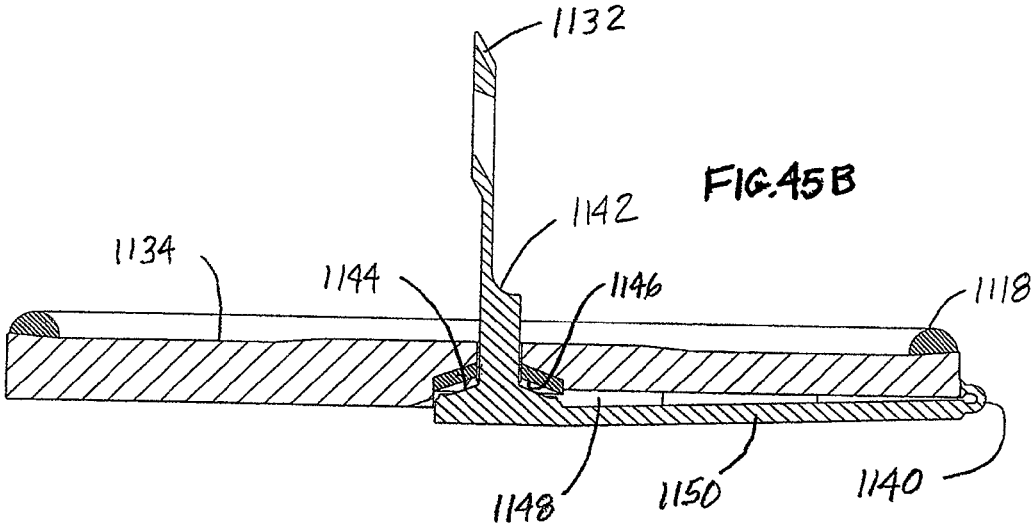

Referring to FIGS. 45A and 45B, the surface 1142 of the middle finger 1132 is shown to be at the same elevation as the surfaces 1142 of all of the outer fingers 1128, 1130. This movement is achieved by the engagement of the portion 1136 of the lever 1122 when the lever is pivoted in the manner described above. This movement of the lever 1122 results in the downward motion of the middle finger 1132 relative to the outer fingers 1128, 1130. As shown in FIG. 45B, the valve 1144 is moved away from the valve seat 1146 thereby creating a space 1148 between a body portion 1150 of the middle finger 1132 and the sealing portion 1118. This space 1148 enables an initial release of pressure of the contents of the container body when opening the movable closure element 1104 by initially pivoting the lever 1122. The body 1134 of the sealing portion 1118 may include a rubber seal (not designated) to create a sealing engagement of the sealing portion with the bottom surface 1138 of the can end 1102. Additionally, the valve seat 1146 may include a rubber overmold to create a sealing engagement of the valve 1144 with the valve seat.

Figure 46A:
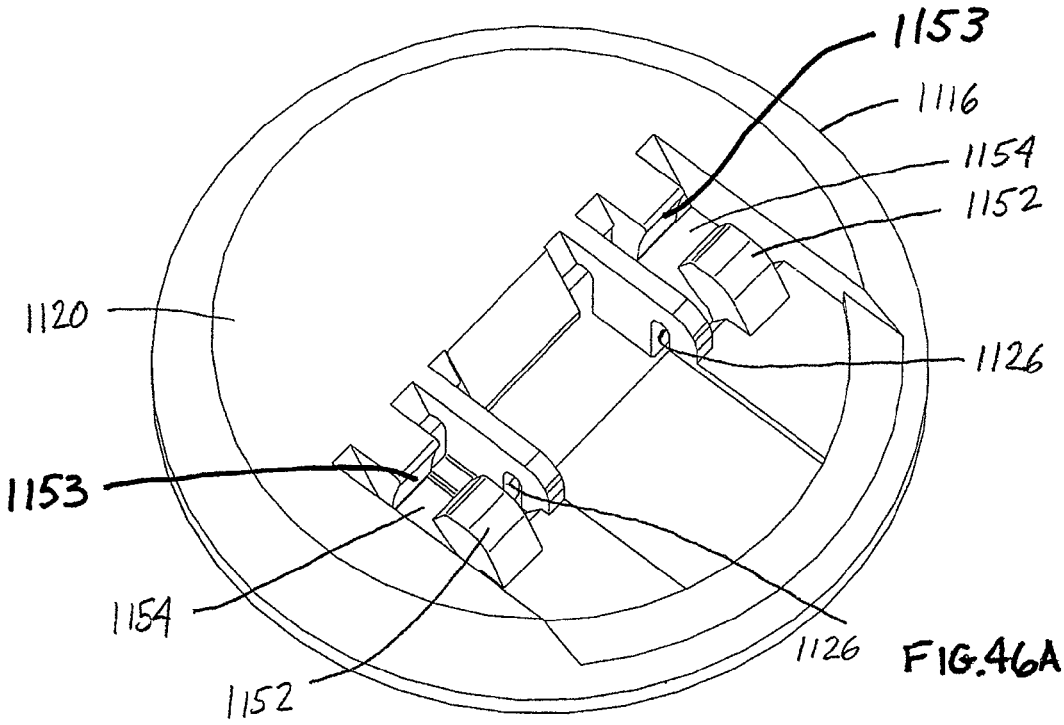
Figure 46B:
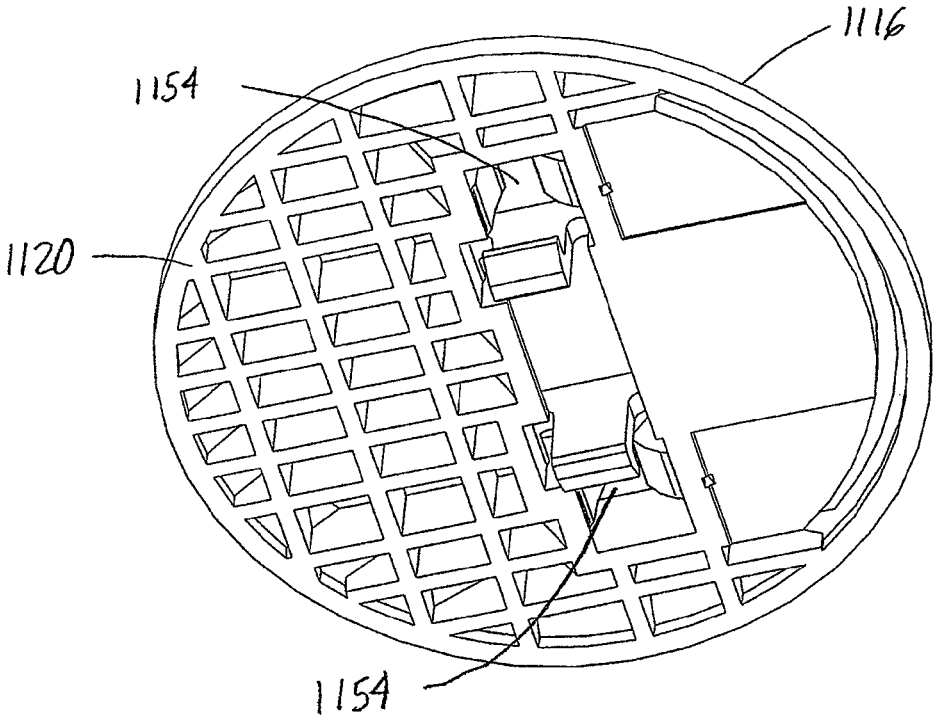

FIGS. 46A and 46B illustrate the top cover 1116 having the body 1120. In one embodiment, the body 1120 of the top cover 1116 further includes a pair of first latch elements, each indicated at 1152, and a second pair of latch elements, each indicated at 1153, configured to secure the lever 1122 to the top cover. The body 1120 of the top cover 1116 includes a pair of slots, each indicated at 1154, which are disposed between respective latch elements 1152, 1153. The slots 1154 are configured to receive end elements, each indicated at 1156, of the lever 1122 when pivoting the lever. The slots 1154 serve as guides for the end elements 1156 of the lever 1122 when pivoting the lever from its flush position to its fully pivoted position.

Referring to FIG. 46B, the body 1120 of the top cover 1116 further includes two snap hooks, each indicated at 1158, which attach the top cover 1116 to the can end 1102 as the snap hooks enter into the channel guide 1110. The snap hooks 1158 also glide along the channel guide 1110 as the top cover 1116 moves horizontally along the channel guide to maintain alignment of the top cover with the channel guide. The notches 1126 provide some flexibility to the snap hooks 1158 when inserting the snap hooks into the channel guide 1110.

Specifically, with reference to FIGS. 47A, 47B, 47C, 47D and 47E and to FIGS. 48A, 48B, 48C and 48D, the pivotal connection of the lever 1122 to the top cover 1116 and the manner in which the lever pivots relative to the top cover is illustrated. The end elements 1156 are received within their respective slots 1154 formed in the body 1120 of the top cover 1116. This configuration enables the lever 1122 to rotate or pivot with respect to the top cover 1116. The latch elements 1152, 1153 are designed to provide a guide for the lever 1122 as the lever pivots. FIGS. 47B and 48A illustrate the lever 1122 resting on the top cover 1116. FIGS. 47C and 48B illustrate the lever 1122 pivoting away from the top cover 1116 short of a vertical position with the end elements 1156 entering into their respective slots 1154. FIGS. 47D and 48C illustrate the lever 1122 in a vertical position with respect to the top cover 1116. And FIGS. 47E and 48D illustrate the lever 1122 beyond a vertical position with respect to the top cover 1116.

The arrangement is such that the portion 1136 of the lever 1122 is designed to push down on the surfaces 1142 of the fingers 1128, 1130 and 1132. When the lever 1122 is swiveled toward an open (pivoted) position, the portion 1136 applies a downward force on the surface 1142 of the middle finger 1132 to move the valve 1144 from the valve seat 1146. Once the surfaces 1142 of the fingers 1128, 1130 and 1132 are level with one another, the portion 1136 moves the sealing portion 1118 downwards.

The assembly of the closure system 1100 is as follows. Referring to FIGS. 49A, 49B and 49C, the top cover 1116 is secured to the can end 1102 by inserting the snap hooks 1158 into the channel guide 1110 of the can end. This is best shown in FIG. 49C, which illustrates the snap hooks 1158 engaging the body 1106 of the can end 1102.

FIGS. 50A, 50B and 50C illustrate the attachment of the lever 1122 to the top cover 1116. The lever 1122 is positioned over the top cover 1116 as shown in FIG. 50A. Next, the end elements 1156 of the lever 1122 is received within the slots 1154 of the top cover 1116. In this position, the end elements 1156 are capable of entering into their respective slots 1154 as shown in FIG. 50B. As the lever 1122 is pivoted, the portion 1136 moves downward within the channel guide 1110. The pivoting movement of the lever 1122 is shown in FIG. 50C.

Next, the sealing element 1118 is secured to the top cover 1116 by inserting the fingers 1128, 1130 and 1132 up through the channel guide 1110. This is illustrated in FIGS. 51A, 51B, 51C, 51D and 51E. As shown in FIGS. 51A and 51B, the middle finger 1132 is moved so that it is disposed between the two outer fingers 1128, 1130. Referring to FIGS. 51C, 51D and 51D, the middle finger 1132 (as well as the outer fingers 1128, 1130) includes an opening 1160 that is sized to receive a hook 1162 of the lever 1122. Referring to FIGS. 52A, 52B and 52C and to FIGS. 53A, 53B and 53C, when inserting the fingers 1128, 1130 and 1132 into the channel guide 1110, the fingers extend up through an opening or slot 1164 formed in the lever 1122 with the lever in its fully pivoted position (beyond a vertical position). In this position, the hook 1162 is received within the opening 1160 to secure the sealing element 1118 to the top cover 1116. Additionally, the hook 1162, when the lever 1122 is fully pivoted, applies a downward force on surface 1160 to maximize the distance in which the sealing element 1118 is moved away from the can end 1102.

FIGS. 54A, 54B and 54C illustrates the closure system 1100 in the sealed position. As shown, the lever 1122 rests on the body 1120 of the top cover 1116, and the sealing portion 1118 is in contact with the bottom surface 1138 of the can end 1102 to seal the dispensing portion 1108. The lever 1122 bends the fingers 1128, 1130 and 1132 so that the fingers wrap around the portion 136 to pull the sealing portion 1118 upwardly towards the surface 1138 of the can end 1102. In this position, the valve 1144 is seated firmly within the valve seat 1146 to block any transfer of fluid from the container body to atmosphere.

During operation, in a first position, the top cover 1116 covers the dispensing portion 1108, the lever 1122 of the top cover is resting on the top cover, and the sealing portion 1118 is in contact with the bottom surface 1138 of the can end 1102. In a second position, the top cover 1116 covers the dispensing portion 1108, the lever 1122 is lifted relative to the first position, and the sealing portion 1118 is spaced a distance from the bottom surface 1138 of the can end 1102. In this position, the movement of the sealing portion 1118 from the can end 1102 releases pressure from within the container. In a particular embodiment, a portion of the lever 1122 may be aligned with the sealing portion 1118 to release pressure from within the container. In a third position, the top cover 1116 and the sealing portion 1118 expose the dispensing portion 1108, and the sealing portion is spaced a distance from the bottom surface 1138 of the can end 1102. In a fourth position, the top cover 1116 and the sealing portion 1118 expose the dispensing portion 1108, the lever 1122 is lowered to rest on the top cover, and the sealing portion is in contact with the bottom surface 1138 of the can end 1102. In this position, a person is able to drink from the container.

In a fifth position, the top cover 1116 and the sealing portion 1118 expose at least a portion of the dispensing portion 1108, the lever 1122 of the top cover is lifted relative to the fourth position, and the sealing portion is spaced predetermined distance from the bottom surface 1138 of the can end 1102. In a sixth position, the top cover 1116 and the sealing portion 1118 expose at least a portion of the dispensing portion 1108, the lever 1122 of the top cover is lowered relative to the fifth position, and the sealing portion is in contact with the bottom surface 1138 of the can end 1102. In this position, the container is vented.

In certain embodiments, the end can 1102 (otherwise referred to as the fixed element) is made of a material that is compatible with a material of at least one of the top cover 1116 and the sealing portion 1118. In a particular embodiment, at least one of the top cover 1116 and the sealing portion 1118 is made of a polymeric material, with a total weight of the polymeric material being less than or equal to 10 grams. In another embodiment, the top cover 1116 may be configured to indicate whether the closure system 1100 has been opened.

Any of the arrangements described above may be used for beverages, foods, other consumable goods, or non-consumable goods. Additionally, as described above, containers may be made from any material known to those skilled in the art, depending on the use and function of the part or component. For example, container bodies and base plates may be made from aluminum materials used in the conventional manufacturing of can bodies. The fixed element, top cover, and sealing portion, may be formed from common molding and extrusion processes to create reproducible tolerances. The movable closure elements may be formed from polypropylene, while the can cover and stem may be manufactured from polyethylene terephthalate. Alternatively, the can end may be manufactured from aluminum materials used in the conventional manufacturing of can bodies. The gasket may be made of silicon, rubber, plastic, or the like. In certain examples, one or more components of the closure system may be formed from one or more polymeric materials. Typically, the polymeric material is a recyclable material that is compatible with other components of the closure system and with the contents of the container. The total weight of the polymeric material used in the closure system may be less than a predetermined amount such as a standard maximum weight based on industry standards, or recommended or mandated by governmental guidelines. Preferably, the total weight of the polymeric material used in the closure system is less than 10 grams, less than 8 grams, less than 6.5 grams, less than 5 grams, less than 3.75 grams, or less than 3.2 grams.

Although the containers and methods of making them have been described above in terms of certain examples and embodiments, various alterations, modifications, substitutions, additions and improvements will be readily apparent to the person of ordinary skill in the art, given the benefit of the disclosure. Such alterations, modifications, substitutions, additions and improvements are intended to be within the scope and spirit of the containers disclosed here. It is also intended that the indefinite articles "a" and "an," as used above and in the appended claims, mean one or more of the articles which they modify, and that the terms "include," "including" and "having" are interchangeable with the open ended term "comprising." Only the transitional phrases "consisting of" and "consisting essentially of," are closed or semi-closed transitional phrases, respectively, with respect to the claims.

Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for the use of the ordinal term) to distinguish the claim elements.

Those skilled in the art should appreciate that the parameters and configurations described herein are exemplary and that actual parameters and/or configurations will depend on the specific application in which the systems and techniques of the invention are used. Those skilled in the art should also recognize, or be able to ascertain, using no more than routine experimentation, equivalents to the specific examples of the invention. It is therefore to be understood that the examples described herein are presented by way of example only and that, within the scope of the appended claims and equivalents thereto, the invention may be practiced otherwise than as specifically described.

What is claimed is:

1. A closure system for sealing a container constructed and arranged to be mated with a container body, the closure system comprising:

a fixed element comprising a can end comprising a dispensing portion and a channel guide having a first end and a second end, the fixed element constructed and arranged to be secured to an end of the container body; and a movable closure element comprising:

a top cover comprising a lever and snap hooks engaged at least partially with the channel guide and constructed and arranged to allow horizontal movement of the top cover along at least a portion of the channel guide while restricting movement of the top cover in other directions, the top cover covering the dispensing portion in a first position; and a sealing portion comprising a lever receiving portion constructed and arranged to accept the lever such that, as the lever is lifted, the sealing portion moves in a downward direction away from the can end to a predetermined distance from a bottom surface of the can end, and as the top cover is moved horizontally from the first end of the channel guide to the second end of the channel guide the sealing portion is moved horizontally at the predetermined distance with the top cover and the dispensing portion is exposed.

2. The closure system of claim 1, wherein at the first position the top cover covers the dispensing portion, the lever of the top cover is resting on the top cover, and the sealing portion is in contact with a bottom surface of the can end;

at a second position the top cover covers the dispensing portion, the lever is lifted relative to the first position, and the sealing portion is spaced a predetermined distance from the bottom surface of the can end; and at a third position the top cover and the sealing portion expose the dispensing portion, and the sealing portion is spaced a predetermined distance from the bottom surface of the can end.

3. The closure system of claim 2, wherein at a fourth position the top cover and the sealing portion expose the dispensing portion, the lever is lowered to rest on the top cover, and the sealing portion is in contact with the bottom surface of the can end.

4. The closure system of claim 3, wherein at a fifth position the top cover and the sealing portion expose at least a portion of the dispensing portion, the lever of the top cover is lifted relative to the fourth position, and the sealing portion is spaced a predetermined distance from the bottom surface of the can end.

5. The closure system of claim 4, wherein at a sixth position the top cover and sealing portion expose at least a portion of the dispensing portion, the lever of the top cover is lowered relative to the fifth position, and the sealing portion is in contact with the bottom surface of the can end.

6. The closure system of claim 5, wherein the fixed element is made of a material that is compatible with a material of at least one of the top cover and the sealing portion.

7. The closure system of claim 6, wherein at least one of the top cover and the sealing portion is made of a polymeric material.

8. The closure system of claim 7, wherein the total weight of the polymeric material is less than or equal to 10 grams.

9. The closure system of claim 1, wherein the lever is constructed and arranged to operatively interact with the lever receiving portion.

10. The closure system of claim 9, wherein the top cover is constructed and arranged to at least partially secure the top cover to the fixed element.

11. The closure system of claim 10, wherein the top cover is constructed and arranged to mate with the lever.

12. The closure system of claim 11, wherein the top cover is constructed and arranged to maintain alignment of the top cover with the channel guide.

13. The closure system of claim 9, wherein contents within the container are pressurized and the sealing portion is constructed and arranged to release pressure from within the container.

14. The closure system of claim 13, wherein the lever operatively interacts with the sealing portion to release pressure from within the container.

15. The closure system of claim 14, wherein pressure is released from the container when the lever is lifted from a resting position on the top cover to a predetermined angle.

16. The closure system of claim 15, wherein as the lever is lifted, a portion of the lever becomes aligned with the sealing portion to release pressure from within the container.

17. The closure system of claim 1, wherein the top cover is constructed and arranged to secure the lever in a resting position.

18. A closure system for sealing a container constructed and arranged to be mated with a container body, the closure system comprising:

a fixed element comprising a can end comprising a dispensing portion and a channel guide, the fixed element constructed and arranged to be secured to an end of the container body;

a movable closure element comprising a top cover comprising a grip and snap hooks positioned at least partially within the channel guide and constructed and arranged to allow horizontal movement of the top cover along at least a portion of the channel guide while restricting movement of the top cover in other directions, the top cover covering the dispensing portion in a first position; and a sealing portion constructed and arranged to operatively interact with the top cover, such that as the top cover is engaged, the sealing portion moves in a vertical direction to a predetermined distance from a bottom surface of the can end, and as the top cover is moved in a horizontal direction along the channel guide, the sealing portion moves in the horizontal direction at the predetermined distance.

* * * * *